US007931350B2

(12) United States Patent
Furukawa et al.

(10) Patent No.: US 7,931,350 B2
(45) Date of Patent: Apr. 26, 2011

(54) WASTE LIQUID TANK, LIQUID EJECTION DEVICE, AND IMAGE FORMING APPARATUS

(75) Inventors: Juichi Furukawa, Kanagawa (JP); Shigeaki Kimura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 1018 days.

(21) Appl. No.: 11/801,103

(22) Filed: May 7, 2007

(65) Prior Publication Data

US 2007/0273725 A1 Nov. 29, 2007

(30) Foreign Application Priority Data

May 25, 2006 (JP) ..... 2006-144788
Feb. 14, 2007 (JP) ..... 2007-034055

(51) Int. Cl.
*B41J 2/165* (2006.01)

(52) U.S. Cl. ..... 347/36

(58) Field of Classification Search ..... 347/22, 347/36

See application file for complete search history.

(56) References Cited

U.S. PATENT DOCUMENTS

| | | | | |
|---|---|---|---|---|
| 6,155,666 | A * | 12/2000 | Sugimoto et al. | 347/24 |
| 6,203,137 | B1 * | 3/2001 | Niimura et al. | 347/36 |
| 2006/0087530 | A1 | 4/2006 | Furukawa | |
| 2007/0058009 | A1 | 3/2007 | Furukawa et al. | |

FOREIGN PATENT DOCUMENTS

| | | |
|---|---|---|
| JP | 10-119309 | 5/1998 |
| JP | 10-264411 | 10/1998 |
| JP | 2003-326692 | 11/2003 |
| JP | 3552790 | 5/2004 |
| JP | 2004-155182 | 6/2004 |
| JP | 2004-177262 | 6/2004 |
| JP | 2005-59534 | 3/2005 |

* cited by examiner

*Primary Examiner* — Julian D Huffman
*Assistant Examiner* — Jason S Uhlenhake
(74) *Attorney, Agent, or Firm* — Cooper & Dunham LLP

(57) ABSTRACT

A waste liquid tank that holds waste recording liquid is disclosed. In the waste liquid tank, a waste liquid wetting liquid that forms a liquid layer on the surface of the waste recording liquid is placed in the form of a liquid.

19 Claims, 35 Drawing Sheets

WASTE LIQUID TANK, LIQUID EJECTION DEVICE, AND IMAGE FORMING APPARATUS

BACKGROUND OF THE INVENTION

1. Field of the Invention

The present invention relates to a waste liquid tank, a liquid ejection device, and an image forming apparatus.

2. Description of the Related Art

Some of printers, fax machines, copiers, plotters, and image forming apparatuses, which have some functions of these machines, form (record, or print) images by transferring liquid (hereinafter also referred to as "recording liquid" or "ink") to a medium (the term "medium" as used herein is synonymous with the terms such as "medium to be recorded", "recording medium", "transfer material", and "recording paper", and is hereinafter referred to as "sheet" without limiting the material to paper) with use of, e.g., a liquid ejection device that comprises a recording head including a liquid ejection head for ejecting droplets of the liquid (recording liquid) while transporting the sheet.

The term "image forming apparatus" as used herein indicates a device that forms images by ejecting liquid onto media such as paper, strings, fibers, cloth, leather, metal, plastic, glass, wood, and ceramics. The term "forming images" as used herein indicates not only forming images that have meanings, such as characters and figures, on a medium, but also forming images that do not have meanings, such as patterns, on a medium. The term "liquid" as used herein is not limited to recording liquid and ink, but includes any material that is in the form of a fluid when ejected. The term "liquid ejection device" as used herein indicates a device that ejects liquid from a liquid ejection head and is not limited to that for forming images.

These types of liquid ejection devices and image forming apparatuses require mechanisms for maintaining and restoring performance of the liquid ejection heads for ejecting recording liquid. Primary functions of such a maintenance recovery mechanism for the head include a capping function for tightly sealing with a cap member so as to prevent recording ink near a nozzle head from being viscous and sticky due to natural evaporation of the ink, an ejection recovery function for discharging the recording ink so as to recover from ejection failures due to bubbles generated in a nozzle hole and for suctioning and discharging the recording liquid from the nozzle utilizing the capping function, and a wiping function for wiping off residual recording ink adhering to a nozzle face so as to prevent a variation of dispersion of droplets.

When head performance maintenance recovery operations are performed, recording liquid that has not been used for recording (image formation) is discharged as waste recording ink. Some apparatuses therefore include waste liquid tanks for holding such waste recording ink (called also as waste container, waste container unit, etc.) and fill-up sensors for detecting whether the waste liquid tanks are full.

For example, Patent Document 1 discloses provision of an absorbent material in a waste liquid tank. The absorption of waste recording liquid discharged into the waste liquid tank is increased by wetting the absorbent material with a waste liquid wetting liquid that is a substantially non-reactive liquid having a vapor pressure lower than about 20 mm of Hg at room temperature and comprising a hydrocarbon compound, thereby preventing formation of a mountain-like buildup of waste recording liquid. Especially when a hydrocarbon compound comprising a paraffin oil is used, the absorption of the waste recording liquid by the absorbent material is increased, formation of a mountain-like buildup of the waste recording liquid is more efficiently prevented.

<Patent Document 1> Japanese Registered Patent No. 3552790

Referring to Patent Document 2, a porous absorber impregnated with an ink coagulant of metallic salt is provided in a waste recording liquid tank. This coagulant is a metallic salt solution dissolved in an aqueous solvent.

<Patent Document 2> Japanese Patent Laid-Open Publication No. 10-119309

Patent Document 3 discloses reuse of waste recording liquid.

<Patent Document 3> Japanese Patent Laid-Open Publication No. 2003-326692

Patent Document 4 discloses a measuring device for measuring weight of functional liquid. The measuring device includes a receptacle filled with a functional liquid absorber for absorbing and holding the functional liquid ejected into the receptacle.

<Patent Document 4> Japanese Patent Laid-Open Publication No. 2004-177262

Patent Document 5 discloses a liquid ejection apparatus that comprises a receiving layer for receiving droplets and a diffusion layer for absorbing liquid in the receiving layer and diffusing the liquid, wherein the diffusion layer has a higher density than the receiving layer.

<Patent Document 5> Japanese Patent Laid-Open Publication No. 2004-155182

Referring to Patent Document 6, in order to recognize performance of droplets, a tank for collecting droplets is provided. Further, a liquid pump is provided for generating a suction force in the same direction as the ejection direction of the droplets and suctioning the droplets ejected from a head into the collection tank.

<Patent Document 6> Japanese Patent Laid-Open Publication No. 10-264411

Use of pigment inks including organic pigments, carbon black, etc., as colorant in current image forming apparatuses using inks is under study, or is being put into practice. Unlike dye, as the pigment is insoluble in water, the pigment is usually mixed with dispersant for dispersion treatment so as to be used as an aqueous ink containing the pigment stably dispersed in water.

Such a pigment ink generally has higher viscosity than dye inks, and has problems due to high viscosity. That is, waste of high-viscosity ink (waste recording liquid) tends to become more viscous, and if the viscous waste recording liquid is dropped on an absorbent member, the waste recording liquid is easily built up on the absorbent member without being absorbed therein.

As a result, waste recording liquid subsequently introduced into the waste liquid tank might slide on the buildup of the waste recording ink to flow out of the waste liquid tank. Moreover, the buildup might grow into a columnar shape to interfere with a liquid ejection head or a medium.

One solution may be, as disclosed in Patent Document 1, to wet the absorbent member with a waste liquid wetting liquid that is a substantially non-reactive liquid having a vapor pressure lower than about 20 mm of Hg at room temperature and comprising a hydrocarbon compound.

However, even with this configuration, if the waste recording liquid is frequently introduced into the waste liquid tank in high temperature and low humidity environments, or if the ink has high viscosity and quick drying properties, absorption of the waste recording liquid by the absorbent member does not keep up with introduction of the waste recording liquid, so that the amount of ink adhering to and built up on the surface of the absorbent member gradually increases and clogs pores of the absorbent member, resulting in forming a mountain-like buildup.

If, as disclosed in Patent Document 2, an aqueous solvent containing a wetting agent that has metallic salt reactive to ink dissolved therein is placed, the metallic salt aggregates through reaction with the ink, so that a mountain-like buildup of a waste recording liquid is more likely to be formed compared to the aqueous solvent not being placed in the waste liquid tank. Moreover, the waste recording liquid with aggregated color material has high viscosity and is not easily absorbed by a receptacle.

SUMMARY OF THE INVENTION

In view of the foregoing, the present invention aims to provide a waste liquid tank for holding a waste recording liquid that tends to form a buildup while preventing the recording liquid from forming a buildup, a liquid ejection device provided with the waste liquid tank, and an image forming apparatus provided with the waste liquid tank.

According to an aspect of the present invention, there is provided a waste liquid tank wherein a waste liquid wetting liquid that forms a liquid layer on the surface of the waste recording liquid is placed in the form of a liquid. The term "waste recording liquid" as used herein indicates a recording liquid to be disposed of. The term "waste liquid" indicates a mixture of the waste recording liquid and the waste liquid wetting liquid.

In the following description, "receive the waste recording liquid" includes a case where the waste recording liquid is introduced, a case where the waste recording liquid is transported through a tube of the like, and a case where the waste recording liquid is discharged into the waste liquid tank.

The term "communication passage" includes a simple opening.

In the above-described waste liquid tank, since the waste liquid wetting liquid that forms a liquid layer on the surface of the waste recording liquid is placed in the form of a liquid, the surface of the waste recording liquid is covered with the layer of the waste liquid wetting liquid to be out of contact with air. This prevents volatilization or evaporation of the vehicle (dispersion liquid) of the waste recording liquid, thereby preventing formation of buildup of the waste recording liquid.

It is preferable that the waste liquid tank further comprise: a first unit forming the first chamber; a second unit forming the second chamber; and a communication passage section forming a communication passage for communication between the first chamber and the second chamber, the communication passage section being formed independently from the first unit and the second unit or being formed integrally with either the first unit or the second unit; wherein the first unit and the second unit are detachably connected to each other through the communication passage section.

It is also preferable that the waste liquid tank further comprise: a first chamber that receives the waste recording liquid; a second chamber that accommodates a receptacle member capable of absorbing a waste liquid; and a member that is insoluble in oil and soluble in the waste recording liquid, the member separating the first chamber and the second chamber at least at an inner bottom surface of the waste liquid tank; wherein the waste liquid wetting liquid is held in the first chamber due to presence of the member that is insoluble in oil and soluble in the waste recording liquid.

According to another aspect of the present invention, there is provided a waste liquid tank wherein a waste liquid wetting liquid that has compatibility with a waste recording liquid and disperses or dissolves color materials contained in the waste recording liquid is placed, wherein the waste recording liquid is introduced onto the surface of the waste liquid wetting liquid. The waste liquid tank with this configuration can prevent volatilization or evaporation of the vehicle of the waste recording liquid, and therefore can prevent formation of buildup of the waste recording liquid.

According to still another aspect of the present invention, there is provided a waste liquid tank that holds waste recording liquid, wherein a waste liquid wetting liquid that has compatibility with the waste recording liquid and disperses or dissolves color materials contained in the waste recording liquid is placed in the form of a liquid.

It is preferable that the organic solvent have a lower vapor pressure than water in an environment of 25° C. and 1 atm.

It is also preferable that the organic solvent be refractory enough to disperse or dissolve the color materials contained in the waste recording liquid during a period until the waste liquid tank becomes full.

It is also preferable that the organic solvent include glycols.

It is also preferable that the quantity of the waste liquid wetting liquid held in the waste liquid tank be large enough to disperse or dissolve the color materials contained in the waste recording liquid during a period until the waste liquid tank becomes full.

It is also preferable that the organic solvent contain an antifoamer.

It is also preferable that the organic solvent contain an antiseptic and fungicidal agent.

It is also preferable that the waste recording liquid be discharged onto a surface of the waste liquid wetting liquid or directly into the waste liquid wetting liquid.

According to still another aspect of the present invention, there are provided a liquid ejection device and an image forming apparatus. The liquid ejection device and the image forming apparatus each comprise a waste liquid tank of an embodiment of the present invention, and therefore can prevent formation of buildup of waste recording liquid which might interfere with a liquid ejection head or a recording medium.

It is preferable that the waste liquid tank be removably attached to the image forming apparatus.

DETAILED DESCRIPTION OF THE PREFERRED EMBODIMENT

Figure 1:
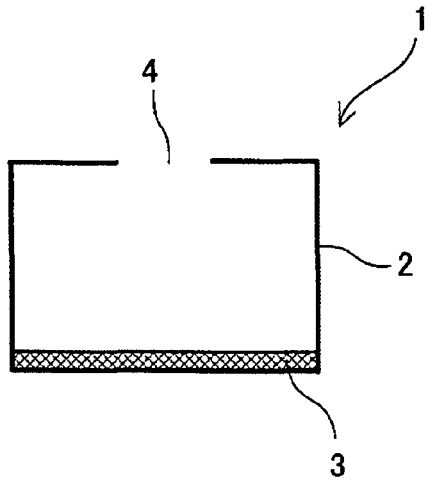
FIG. 1 is a schematic diagram showing a waste liquid tank according to a first embodiment of the present invention.

Preferred embodiments of the present invention are described hereinafter with reference to the accompanying drawings.

The following is an overview of the present invention.

When a waste recording liquid is exposed to air, viscosity of the waste recording liquid increases due to evaporation of a vehicle or a dispersion liquid. Especially in high temperature and low humidity environments, the viscosity of the waste recording liquid is likely to increase. To make an absorbent material efficiently absorb the waste recording liquid, it is necessary to prevent the waste recording liquid from being dried and losing fluidity as far as possible.

The inventors of the present invention have developed a waste liquid tank as an embodiment of the present invention. In this waste liquid tank, before the waste recording liquid is discharged into the waste liquid tank, all or a part of a liquid that receives the waste recording liquid is placed therein without being contained in a receptacle member to have the liquid surface exposed to air. In this document, the liquid that receives the waste recording liquid is referred to as "a waste liquid wetting liquid".

In this waste liquid tank, the waste recording liquid is discharged onto the surface of a layer of the waste liquid wetting liquid or is discharged into the waste liquid wetting liquid. As the waste liquid wetting liquid that receives the waste recording liquid has fluidity, contact time of the waste recording liquid with air is reduced. Thus, the waste recording liquid is prevented from being dried and becoming more viscous. As long as increase of the viscosity of the waste recording liquid is prevented, the waste recording liquid maintains its fluidity and becomes flat by the weight thereof, so that problems associated with formation of a mountain-like buildup (hereinafter also referred to as simply "a buildup") of the waste recording liquid are eliminated.

In this document, the recording liquid discharged from a liquid ejection head for non-recording purposes is referred to as waste recording liquid. The liquid for receiving the waste recording liquid in the waste liquid tank is referred to as waste liquid wetting liquid. A mixture of the waste liquid wetting liquid and the waste recording liquid after discharge of the waste recording liquid into the waste liquid tank, and a liquid that results from discharge of the waste recording liquid into the waste liquid wetting liquid and contains an organic solvent and color materials in a dispersed manner or comprising two or more layers of liquid in which organic solvent and the color materials are dissolved are collectively referred to as waste liquid. If not otherwise specified, the organic solvent is that contained in the waste liquid wetting liquid. In some cases, the organic solvent may consist of all the waste liquid wetting liquid.

If the waste liquid wetting liquid has high volatility, the waste liquid wetting liquid evaporates and is lost, so that the waste recording liquid cannot maintain the property of becoming flat by the weigh thereof for a long time. Accordingly, it is preferable that the waste liquid wetting liquid contain an organic solvent having lower volatility than a vehicle of the waste recording liquid. Furthermore, in order to have the waste liquid wetting liquid receive the waste recording liquid without losing fluidity at least until the waste liquid tank becomes full of the waste recording liquid and the waste liquid wetting liquid to reach the end of the service life, the organic solvent contained in the waste liquid wetting liquid needs to be prevented from being lost through evaporation. Accordingly, in the case of using an inexpensive aqueous recording liquid that forms high quality images, the organic solvent contained in the waste liquid wetting liquid preferably has low volatility and has lower vapor pressure than water at least at normal temperatures and normal pressures.

For preventing increase of viscosity of the waste recording liquid, it is necessary to prevent volatilization of the vehicle of the waste recording liquid. One way of preventing volatilization of the vehicle of the waste recording liquid according to one embodiment of the present invention is to disperse the waste recording liquid into and mix it with waste liquid wetting liquid containing a high-refractory organic solvent of high wetting capacity.

Another way of preventing volatilization of the vehicle of the waste recording liquid according to one embodiment of the present invention is to use a waste liquid wetting liquid containing an organic solvent that has lower specific gravity than the waste recording liquid and forms a separate layer from the waste recording liquid due to low compatibility with the waste recording liquid. The organic solvent covers the interface with air when the waste recording liquid is discharged into the waste liquid wetting liquid, thereby prevent the waste recording liquid from coming into contact with air.

Although it is preferable to prevent volatilization of the vehicle of the waste recording liquid until the waste liquid tank becomes full to reach the end of its service life, an object of the present invention is accomplished if the volatilization of the vehicle of the waste recording liquid is prevented until the waste recording liquid becomes flat due to the weight thereof without losing fluidity.

A method of discharging the waste recording liquid into the waste liquid tank of the present invention may include, but without being limited to, a method of discharging (dropping) the waste recording liquid onto the liquid surface of the waste liquid wetting liquid and a method of guiding the waste recording liquid by a tube or the like to transport the waste recording liquid into the waste liquid wetting liquid. The method of discharging (dropping) the waste recording liquid onto the liquid surface of the waste liquid wetting liquid can be realized with a simple configuration and fewer component parts at low cost. On the other hand, the method of transporting the waste recording liquid directly into the waste liquid wetting liquid with use of a tube or the like prevents scattering the waste recording liquid, and therefore it is possible to maintain the waste recording liquid while efficiently preventing an increase of viscosity of the waste recording liquid.

(Composition of Waste Liquid Wetting Liquid)

A preferred waste liquid wetting liquid in the present invention is that containing an organic solvent having the following characteristics.

<In the Case of Dispersing the Waste Recording Liquid in an Organic Solvent with High Wetting Capacity>

In the case of preventing vehicle volatilization of the waste recording liquid by dispersing or dissolving the waste recording liquid into an organic solvent having high wetting capacity, glycols and glycerin are preferable choices as the organic solvent because of their high wetting capacities. Especially, glycols are more preferable if the recording liquid is aqueous, because glycols are hydrophilic and have high molecular weight and significantly low volatility.

The volume of the waste liquid wetting liquid to be placed in the waste liquid tank is preferably large enough to maintain dispersion of color materials in the waste liquid even when the waste liquid tank becomes full of the waste liquid. The volume of the waste liquid wetting liquid that is large enough to maintain dispersion of the color materials is dependent on dispersibility of the color materials with respect to the waste liquid wetting liquid, the capacity of the waste liquid tank, and volatility of the waste liquid wetting liquid.

<In the Case of Preventing Vehicle Evaporation of the Waste Recording Liquid by Covering the Interface with a Non-Volatile Oil>

In the case of preventing vehicle evaporation of the waste recording liquid by using a waste liquid wetting liquid containing an organic solvent having lower specific gravity than the waste recording liquid and compatibility with the waste recording liquid low enough to form a separate layer from the waste recording liquid so as to cover the interface with air with the organic solvent upon discharging the waste recording liquid into the waste liquid wetting liquid and thus prevent the waste recording liquid from coming into contact with air, oils are preferable choices as the organic solvent.

If a waste liquid wetting liquid containing an oil with high volatility is used, one purpose of the present invention of reducing volatilization of the waste recording liquid so as to make the waste recording liquid flat by its weight is accomplished. However, as the volume of the waste liquid wetting liquid decreases due to volatilization, regular replenishment of the waste liquid wetting liquid is required. Moreover, volatile components often emit unpleasant odors.

Also, in the case of preventing vehicle evaporation of the waste recording liquid by using a waste liquid wetting liquid containing an organic solvent having lower specific gravity than the waste recording liquid and compatibility with the waste recording liquid low enough to form a separate layer from the waste recording liquid so as to cover the interface with air with the organic solvent upon discharging the waste recording liquid into the waste liquid wetting liquid and thus prevent the waste recording liquid from coming into contact with air, because viscosity increase of the waste recording liquid is preventable as long as the surface is covered with the organic solvent so as to be out of contact with air, the volume of the waste liquid wetting liquid used for preventing formation of a mountain-like buildup of the waste recording liquid is reduced compared with a method of preventing vehicle volatilization of the waste recording liquid by dispersing or dissolving the waste recording liquid into an organic solvent having high wetting capacity.

The waste liquid wetting liquid may contain antifoamer, antiseptic and fungicidal agent, viscosity modifier, pH adjuster, oxidizer, reducing agent, anticorrosive, antioxidant, etc.

(Configuration of the Waste Liquid Tank)

A waste liquid tank according to an embodiment of the present invention may be provided with an area accommodating a receptacle member that absorbs the waste recording liquid, separately from an area for receiving the waste recording liquid into the waste liquid wetting liquid. With this configuration, if an image forming apparatus is tilted, it is possible to prevent large quantities of a waste liquid from flowing out of the waste liquid tank, and therefore it is possible to prevent contamination of the installation site of the image forming apparatus by color materials of the waste recording liquid, electrical leakage to ground, and apparatus failures due to short circuits of distribution boards.

<In the Case of Preventing Vehicle Evaporation of the Waste Recording Liquid by Covering the Interface with a Non-Volatile Oil>

In the case of preventing vehicle evaporation of the waste recording liquid by using a waste liquid wetting liquid containing an organic solvent having lower specific gravity than the waste recording liquid and compatibility with the waste recording liquid low enough to form a separate layer from the waste recording liquid so as to cover the interface with air with the organic solvent upon discharging the waste recording liquid into the waste liquid wetting liquid and thus prevent the waste recording liquid from coming into contact with air, a waste liquid tank may be used that is divided into an area for receiving the waste recording liquid into the waste liquid wetting liquid and an area accommodating a receptacle member that absorbs the waste recording liquid. The area for receiving the waste recording liquid into the waste liquid wetting liquid communicates with the area accommodating a receptacle member that absorbs the waste recording liquid through a communication passage. The waste liquid tank is kept divided in these two areas, i.e., the area for receiving the waste recording liquid into the waste liquid wetting liquid and the area accommodating a receptacle member that absorbs the waste recording liquid until when the waste recording liquid is accumulated to a predetermined volume to exceed the upper end of the communication passage.

In this case, it is preferable that the organic solvent continuously moisturize the waste recording liquid in the area for receiving the waste recording liquid, and the receptacle member absorb the waste liquid only after the organic solvent is completely separated.

In the waste liquid tank, it is preferable that a portion of the receptacle member that first touches the organic solvent be located at a position higher than the upper end of the communication passage. The height difference between the portion of the receptacle member that first touches the organic solvent and the upper end of the communication passage and the absorbing ability of the receptacle member are preferably adjusted so that, even if the level of the waste liquid lowers after absorption of the organic solvent by the receptacle member, the level of the waste liquid does not fall under the upper end of the communication passage. This is to avoid an inconvenience such as the organic solvent flowing into a area for receiving the waste recording liquid, so that the organic solvent is absorbed by the receptacle member and gradually removed from the area for receiving the waste recording liquid.

A portion that surrounds the area for receiving the waste recording liquid preferably surrounds at least a portion of the area higher than the portion of the receptacle member that first touches the organic solvent. More preferably, the portion that surrounds the area may be a wall that surrounds the area including a portion higher than the upper end of the receptacle member. The area accommodating the receptacle member preferably communicates outside so as to allow ventilation of air. If not, after the communication passage is covered with the waste liquid, the receptacle member cannot sufficiently absorb the waste liquid due to air pressure. Moreover, if the water liquid wetting liquid is not held in the area for receiving the waste recording liquid from the initial state, it is difficult to hold the waste recording liquid while preventing the viscosity increase.

If the waste liquid tank is divided into a unit for receiving the waste recording liquid into the waste liquid wetting liquid, and a unit accommodating the receptacle member that absorbs the waste recording liquid, the freedom of layout of the waste liquid tank is increased.

The receptacle member that absorbs the waste recording liquid may absorb the waste recording liquid together with the organic solvent. However, since the components of the organic solvent have low compatibility with the vehicle of the waste recording liquid, the organic solvent components contained in the receptacle member are not mixed with the waste recording liquid, which might result in lowering the efficiency of absorption of the waste recording liquid. To avoid this problem, it is preferable to divide the receptacle member into a portion for absorbing the organic solvent and a portion for absorbing the waste recording liquid.

For example, the receptacle member may be provided with a projection so that the projection of the receptacle member first absorbs the organic solvent and then the rest of the portion (the recess) of the receptacle member, in which the organic solvent is not absorbed, absorbs the waste recording liquid. With this configuration, since the portion of the receptacle member that absorbs the organic solvent is divided from the portion that absorbs the waste recording liquid, liquid containing the color material is absorbed into the receptacle member without interference by the organic solvent.

It is more preferable that a diffusion limitation plate be provided between the projection and the recess of the receptacle member so as to limit the diffusion of the absorbed organic solvent to a small area, i.e., to the projection, thereby increasing absorption efficiency of the waste recording liquid by the receptacle member. A diffusion limitation unit that limits diffusion of the organic solvent may be any unit. For example, in place of providing the diffusion limitation plate, a wide cut may be formed in the receptacle member for preventing the organic solvent from being diffused. Alternatively, the receptacle member may comprise two receptacle members: one for absorbing the organic solvent and the other for absorbing not the organic solvent but only the liquid containing the color materials.

In an embodiment of the present invention, a waste liquid tank comprises a unit for receiving a waste recording liquid, a unit accommodating a receptacle member, and a narrow communication passage for communication between the unit that receives the waste recording liquid and the unit that accommodates the receptacle member. A joint point between the communication passage and the unit for receiving the waste recording liquid is located at a position lower than the highest point of the communication passage. This configuration increases freedom of layout of the waste liquid tank. That is, the unit for receiving the waste recording liquid can be disposed spaced apart from the unit accommodating the receptacle member.

Only the organic solvent, which has low compatibility with the waste recording liquid to be absorbed by the receptacle member and has a lower specific gravity than the waste recording liquid, that has flowed into the communication passage is absorbed by the receptacle member, so that the volume of the organic solvent absorbed by the receptacle member is small.

If the communication passage is configured such that the joint section with the unit for receiving the waste recording liquid defines the lowest point thereof and the joint section with the unit accommodating the receptacle member defines the highest point, a configuration that is simple but has required functions is realized.

If the components of the organic solvent have low compatibility with the vehicle of the waste recording liquid, the organic solvent components contained in the receptacle member repel the waste recording liquid, resulting in lowering absorption efficiency of the waste recording liquid by the receptacle member. Therefore, it is preferable that the receptacle member first absorb the organic solvent and then absorb the waste recording liquid into a portion of the receptacle member that has not absorbed the organic solvent. It is also preferable that a diffusion limitation unit that limits diffusion of the organic solvent to a limited area be provided for enhancement of absorption efficiency of the waste recording liquid by the receptacle member.

As mentioned above, if the receptacle member absorbs the organic solvent having low compatibility with the vehicle of the waste recording liquid, the portion that has absorbed the organic solvent has difficulty in absorbing the waste recording liquid, which prevents efficient absorption of the waste liquid. Accordingly, it is preferable that the volume of the receptacle member that absorbs the organic solvent be small, and that the portion of the receptacle member that absorbs the organic solvent be limited to a small region.

In an embodiment of the present invention, a waste liquid tank is provided with a valve separating an area (or a unit) for receiving the waste recording liquid and an area (or a unit) accommodating the receptacle member. This configuration increases absorption efficiency of the waste liquid and allows downsizing of the waste liquid tank.

The valve needs to be opened and closed depending on the volume of the waste recording liquid accumulated in the area for receiving the waste recording liquid. The liquid volume may be detected by a float floating on the waste liquid or a sensor that electrically detects the liquid volume by applying a current.

<In the Case of Dispersing the Waste Recording Liquid into an Organic Solvent with High Wetting Capacity>

In the case of dispersing the waste recording liquid into an organic solvent with high wetting capacity, if the waste liquid in which the waste recording liquid is dispersed is simply absorbed into the receptacle member, the volume of the waste liquid wetting liquid is gradually reduced, resulting in losing the wetting function. To avoid this problem, the volume of the waste liquid wetting liquid to be placed in the waste liquid tank needs to be large enough to prevent the waste liquid wetting liquid from becoming unable to disperse the waste recording liquid due to reduction of the volume of the waste liquid wetting liquid.

In an embodiment of present invention, a waste liquid tank is provided in the form of a cartridge in order to extend the life of an image forming apparatus.

In the image forming apparatus equipped with the waste liquid tank, the waste recording liquid is ejected toward or discharged into the surface of the waste liquid wetting liquid, so that contact between the waste recording liquid and air is reduced, thereby preventing a viscosity increase of the waste recording liquid. As long as the increase of the viscosity of the waste recording liquid is prevented, the waste recording liquid maintains its fluidity and becomes flat by the weight thereof. Thus, problems associated with buildup of the waste recording liquid are eliminated, resulting in increasing the reliability of the waste liquid tank.

However, if the waste liquid tank of the present embodiment in which the waste liquid wetting liquid is placed has the same volume as a related-art waste liquid tank in which the waste liquid wetting liquid is not placed, the waste liquid tank of the present embodiment has a smaller capacity for holding the waste recording liquid and therefore becomes full sooner. As the waste liquid tank is provided in the form of a cartridge that is easily replaceable, the waste liquid tank can be replaced with a new waste liquid tank when it becomes full. Thus, the image forming apparatus can be used continuously without having failures.

Since the image forming apparatus as an embodiment of the present invention is equipped with the waste liquid tank as an embodiment of the present invention can prevent formation of buildup of waste liquid, it is possible to prevent ejection failures due to contamination of heads and contamination of recording media by buildup, and thus to extend the service life of the image forming apparatus. If the image forming apparatus is equipped with a waste liquid tank accommodating a receptacle member in addition to the waste liquid wetting liquid, the volume of the waste liquid that spills over the waste liquid tank in the case where the image forming apparatus is tilted is very small. This prevents the power source of the image forming apparatus from being short circuited and the installation site of the image forming apparatus from being contaminated due to spill over of the waste liquid. The waste liquid tank of an embodiment of the present invention in which the waste liquid wetting liquid is placed is disadvantageous in that the capacity for storing the waste recording liquid is smaller than that of the related-art waste liquid tank in which the waste liquid wetting liquid is not placed. However, if the waste liquid tank to be mounted is in the form of a replaceable cartridge, such a disadvantage is eliminated. That is, the service life of the image forming apparatus becomes independent of the waste liquid tank becoming full, so that the service life of the image forming apparatus is prolonged.

(Effectiveness on Ink)

Problems such as ejection failures due to contact between heads and a mountain-like buildup of components of waste liquid wetting liquid and contamination of recording media by the buildup in apparatuses using line-type heads are more likely to occur as the growth rate of the buildup increases. The growth rate of the buildup depends on the drying rate and the viscosity increasing rate of the recording liquid, the initial viscosity of the recording liquid, and the height of color materials aggregated due to viscosity increase. That is, if the recording liquid has quick drying properties, originally has high viscosity, or contains pigment as a color material, components of the waste recording liquid quickly form a large mountain-like buildup, so that problems associated with formation of the buildup are likely to occur. Accordingly, an image forming apparatus using the recording liquid having quick drying properties, originally having high viscosity (e.g., 4 cp or greater), and containing pigment as a color material has low maintenance reliability. However, the image forming apparatus that performs printing operations by ejecting a recording liquid having these characteristics can provide high quality printing because ejected liquid droplets do not easily smudge due to the quick drying properties and high viscosity of the recording liquid. Moreover, since the color material of the recording liquid includes pigment, printing with high water resistance and light resistance is obtained.

With an image forming apparatus including the waste liquid tank of an embodiment of the present invention can prevent viscosity increase of the waste recording liquid even if the recording liquid to be ejected has quick-drying properties or originally has a high viscosity, or even if the color material includes pigment, problems associated with formation of a buildup of the waste recording liquid do not occur. Accordingly, the image forming apparatus as an embodiment of the present invention is able to record high quality and durable images even if the recording liquid to be ejected has quick-drying properties or originally has a high viscosity, or even if the color material includes pigment. Moreover, problems such as recording failures due to clogged heads and contamination of recording media by the buildup are preventable, so that images with high reliability and high quality can be formed.

Although the waste liquid wetting liquid may be placed in the waste liquid tank of the image forming apparatus before shipment, the waste liquid wetting liquid may be supplied into the waste liquid tank after installation of the image forming apparatus so as to avoid risk of spill over of the waste liquid wetting liquid from the waste liquid tank. The waste liquid tank may be configured to allow adding new waste liquid wetting liquid when the volume of the waste liquid wetting liquid is reduced due to evaporation.

In order to facilitate refilling with the waste liquid wetting liquid, the waste liquid wetting liquid may preferably be divided into small portions. Alternatively, a line that indicates the optimum amount of the waste liquid wetting liquid may be marked on the waste liquid tank. If a line is marked on the waste liquid tank, the waste liquid tank is preferably made of a translucent member so that the amount of the waste liquid wetting liquid in the waste liquid tank can be determined from outside the waste liquid tank.

If the waste liquid wetting liquid has compatibility with the recording liquid, the waste liquid wetting liquid may be held in a sub tank. Alternatively, the waste liquid wetting liquid may be provided in a cartridge having compatibility with ink cartridges. If a maintenance and supply mechanism is activated at the initial filling before filling with the recording liquid, the waste liquid wetting liquid can be easily transported into the waste liquid tank from the cartridge or the sub tank.

The full state of the waste liquid tank may be detected by using a method of measuring the amount of the discharged waste recording liquid, a method of detecting whether an electric circuit is energized, a method of detecting with use of an optical sensor whether a light is shielded, a method of detecting with use of an optical sensor light propagation utilizing refraction of light on an interface between the recording liquid and the waste liquid recording liquid having low compatibility with the recording liquid, etc. If the waste liquid tank is a cartridge type, it is more economical to have a full-state sensor in the main body of the image forming apparatus than to have a sensor integral with the waste liquid tank. This is because if the sensor is integral with the waste liquid tank, the sensor is thrown away together with the waste liquid tank.

Now, a waste liquid tank 1 according to a first embodiment of the present invention is described below with reference to FIG. 1. FIG. 1 is a schematic diagram showing the waste liquid tank 1.

In the waste liquid tank 1, a waste liquid wetting liquid 3 that forms a liquid layer 3*a* on the surface of a waste recording liquid 5 is held in a tank case 2 in the form of a liquid. The waste liquid wetting liquid 3 contains an organic solvent having lower specific gravity than the waste recording liquid 5 and low compatibility with the waste recording liquid 5.

Figure 2:
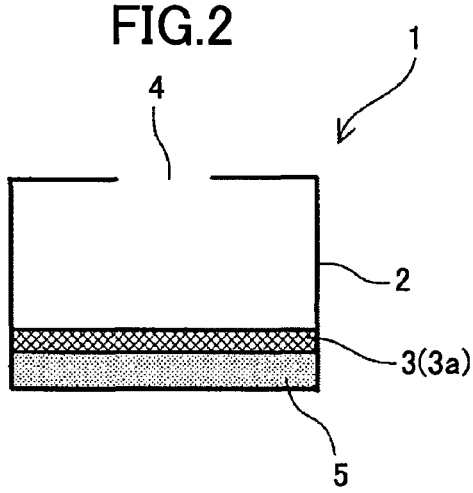
FIG. 2 is a schematic diagram for explaining operations of the waste liquid tank of FIG. 1.

With this configuration, as shown in FIG. 2, when the waste recording liquid 5 is discharged or transported into the waste liquid wetting liquid 3, two separate layers, i.e., the liquid layer 3*a* of the organic solvent of the waste liquid wetting liquid 3 and a layer of the waste recording liquid 5, are formed. As the liquid layer 3*a* of the organic solvent of the waste liquid wetting liquid 3 is formed on the surface of the waste recording liquid 5, the waste recording liquid 5 is out of contact with air, thereby preventing viscosity increase of the waste recording liquid 5 while maintaining fluidity thereof. Thus, the waste recording liquid 5 is held while preventing formation and growth of a buildup of the waste recording liquid 5. It is to be noted that the liquid, excluding the liquid layer 3*a* of the organic solvent, resulting from receiving the waste recording liquid 5 into the waste liquid wetting liquid 3 in the waste liquid tank 1 contains color materials dispersed therein. This liquid is hereinafter also referred to as "the waste recording liquid 5".

The waste recording liquid 5 may be introduced into the waste liquid tank 1 by discharging the waste recording liquid 5 from an air outlet 4 at the upper side of the waste liquid tank 1 toward the liquid surface of the waste liquid wetting liquid 3 or by forcibly transporting the waste recording liquid 5 into the waste liquid wetting liquid 3 with use of a tube and a pump or the like. The former requires less component parts and makes the configuration simple. The latter can introduce the waste recording liquid 5 without scattering the waste recording liquid 5, and therefore can relatively reduce viscosity increase of the waste recording liquid 5.

As can be seen, since the waste liquid wetting liquid 3 contains the organic solvent having lower specific gravity than the waste recording liquid 5 and low compatibility with the waste recording liquid 5, the liquid layer 3*a* is formed on the surface of the waste recording liquid 5, thereby preventing vehicle volatilization due to contact between the waste recording liquid 5 and air. Thus, the waste recording liquid 5 is held while preventing formation of a buildup of the waste recording liquid 5.

Also, in the above-described case where vehicle evaporation of the waste recording liquid 5 is prevented by preventing the waste recording liquid 5 from coming into contact with air by, upon discharging the waste recording liquid 5 into the waste liquid wetting liquid 3 containing the organic solvent having lower specific gravity than the waste recording liquid and compatibility with the waste recording liquid 5 low enough of sufficiently low volatility to form a separate layer from the waste recording liquid 5, covering the interface with air with the organic solvent, because viscosity increase of the waste recording liquid 5 is preventable as long as the surface of the waste liquid is covered with the organic solvent so as to be out of contact with air, the volume of the waste liquid wetting liquid 3 used for preventing formation of a mountain-like buildup of the waste recording liquid 5 is less compared with the case (described later) where vehicle volatilization of the waste recording liquid 5 is prevented by dispersing or dissolving the waste recording liquid 5 into an organic solvent having high wetting capacity.

In this embodiment, the organic solvent contained in the waste liquid wetting liquid 3 is preferably refractory enough to maintain the liquid layer 3*a* of the waste liquid wetting liquid 3 until the waste liquid tank 1 becomes full. This is because, if the waste liquid wetting liquid 3 has high volatility, the waste liquid wetting liquid 3 evaporates and escapes, so that the property of the waste recording liquid 5 becoming flat by the weigh thereof cannot be maintained for a long time. Therefore, it is preferable that the organic solvent have lower volatility than the vehicle of the waste recording liquid 5.

The organic solvent contained in the waste liquid wetting liquid 3 needs to be prevented from being lost through evaporation so that the liquid that receives the waste recording liquid 5 maintains fluidity at least until the waste liquid tank 1 becomes full of the waste recording liquid 5 and the waste liquid wetting liquid 3 to reach the end of the service life. Accordingly, in the case where an inexpensive aqueous recording liquid that forms high quality images is used, the organic solvent contained in the waste liquid wetting liquid 3 preferably has low volatility and has lower vapor pressure than water at least under the conditions of 25° C. and 1 atm (normal temperatures and normal pressures).

By "the waste liquid tank 1 is full" is not meant that the waste liquid tank 1 cannot physically hold the waste liquid any more, but is meant that the waste liquid held in the waste liquid tank 1 reaches a level which is arbitrarily predetermined to avoid possible problems that may occur if the waste liquid held in the waste liquid tank 1 exceeds that level.

As the organic solvent contained in the waste liquid wetting liquid 3, oils are preferable choices. If the waste liquid wetting liquid 3 contains an oil with high volatility, the waste recording liquid 5 is made flat by its weight while reducing volatilization of the waste recording liquid 5. However, as the volume of the waste liquid wetting liquid 3 decreases through volatilization, regular replenishment of the waste liquid wetting liquid 3 is required. Furthermore, volatile components often emit unpleasant odors. In view of this, non-volatile or refractory oils are preferable.

For example, non-volatile animal or plant-derived oils, non-volatile mineral oils, and silicone oils are preferable choices as the organic solvent contained in the waste liquid wetting liquid 3. Among these oils, those capable of retaining fluidity under a condition where the image forming apparatus is used are applicable in the form of being contained in the waste liquid wetting liquid 3. Especially, paraffin oils and silicon oils that are chemically stable and hardly become altered are preferable.

The waste liquid wetting liquid 3 preferably contains antifoamer. Foams generated upon discharge of the waste recording liquid 5 into the waste liquid wetting liquid 3 are dried and become viscous if they remain in the form of foams. However, containing antifoamer can prevent generation or survival of foams and thus can prevent viscosity increase. The antifoamer needs to be dispersive with respect to the vehicle of the waste recording liquid 5. Preferably, the antifoamer is insoluble in the vehicle of the waste recording liquid 5 and includes dispersing elements. The dispersing elements may be inorganic particulates, organic particulates, or organic and inorganic composite particulates. The antifoamer preferably has the same polarity as the color materials contained in the recording liquid or is nonionic.

Silicon antifoamers are preferable choices as the antifoamer employed in embodiments of the present invention. In general, silicon series antifoamers include oil type, compound type, self-emulsification type, and emulsion type. Among these, in view of use in aqueous systems, a self-emulsification type or emulsion type antifoamer is preferable from the standpoint of improving reliability. Modified silicon series antifoamers such as amino modifier, carbinol modifier, methacryl modifier, polyethel modifier, alkyl modifier, high fatty acid ester modifier, alkylene oxide modifier may also be applicable.

Examples of commercially available silicon series antifoamers include silicone antifoamers from Shin-Etsu Chemical Co., Ltd. (KS508, KS531, KM72, KM85, etc.), silicone antifoamers from Dow Corning Toray Co., Ltd. (Q2-3183A, SH5510, etc.), silicone antifoamers from Nippon Unicar Co., Ltd. (SAG30, etc.), and antifoamers from ADEKA Corporation (Adekanol series).

The volume of the antifoamer to be added to the waste liquid wetting liquid 3 may be the minimum amount required for being effective.

The waste liquid wetting liquid 3 may contain an antiseptic and fungicidal agent. An antiseptic and fungicidal agent can prevent propagation of fungus and therefore improve preservation stability and image stability. An antiseptic and fungicidal agent can also prevent viscosity increase of the waste recording liquid 5.

Especially, it is preferable that the waste liquid wetting liquid 3 contain an antiseptic and fungicide agent because, if the organic solvent contained in the waste liquid wetting liquid 3 is decomposed by bacteria or fungus, the organic solvent is modified and loses its wetting effect on the waste recording liquid 5. It is preferable that the waste liquid wetting liquid 3 contain an antiseptic and fungicide agent also because components such as methane that are generated from decomposed organic solvent cause odor.

Examples of antiseptic and fungicide agent include sodium dehydroacetate, sodium sorbate, 2-pyridinethiol-1-sodium oxide, isothiazoline-base compound, sodium benzoate, sodium pentachlorophenol, etc.

Commercially available antiseptic and fungicide agents include PROXELLV (S) (from Avecia Limited; (principal components: 1,2-benthiazolin-3-one/sodium hydroxide)).

To impart additional effects, the waste liquid wetting liquid 3 may optionally include viscosity modifier, pH adjuster, oxidizer, reducing agent, anticorrosive, antioxidant, etc.

Figure 3:
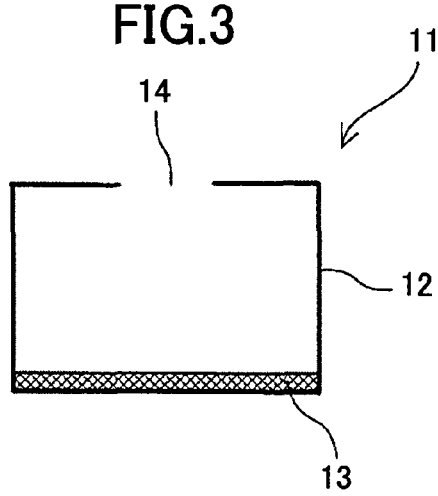
FIG. 3 is a schematic diagram showing a waste liquid tank according to a second embodiment of the present invention.

A waste liquid tank 11 according to a second embodiment of the present invention is described below with reference to FIG. 3. FIG. 3 is a schematic diagram showing the waste liquid tank 11.

In the waste liquid tank 11, a waste liquid wetting liquid 13 that is compatible with a waste recording liquid and disperses or dissolves color materials contained in the waste recording liquid is held in a tank case 12 in the form of a liquid. The waste liquid wetting liquid 13 contains an organic solvent that is compatible with the waste recording liquid and disperses or dissolves the color materials contained in the waste recording liquid.

Figure 4:
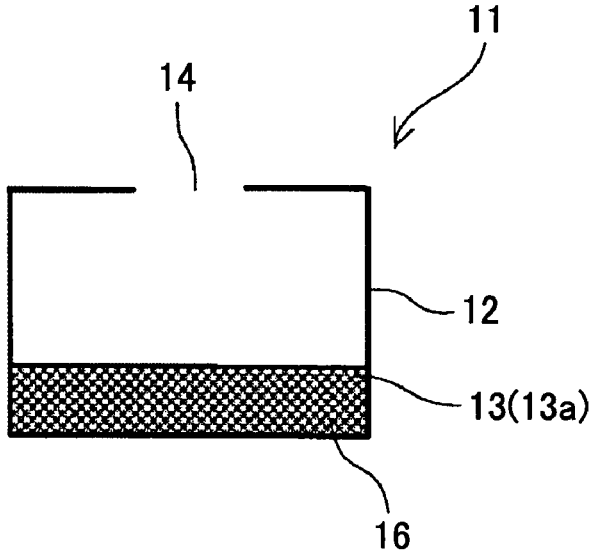
FIG. 4 is a schematic diagram for explaining operations of the waste liquid tank of FIG. 3.

With this configuration, as shown in FIG. 4, when the waste recording liquid is discharged or transported into the waste liquid wetting liquid 3, the waste recording liquid is dispersed or dissolved in the organic solvent of the waste liquid wetting liquid 13 and becomes a waste liquid 16 having fluidity. Thus, the waste recording liquid is held while preventing formation and growth of a buildup of the waste recording liquid.

The waste recording liquid may be introduced into the waste liquid tank 11 by discharging the waste recording liquid from an air outlet 14 at the upper side of the waste liquid tank 11 toward the liquid surface of the waste liquid wetting liquid 13 or by forcibly transporting the waste recording liquid into the waste liquid wetting liquid 13 with use of a tube and a pump or the like.

Since the waste liquid wetting liquid 13 contains the organic solvent that is compatible with the waste recording liquid and disperses or dissolves color materials contained in the waste recording liquid, the waste recording liquid is mixed with the organic solvent, thereby preventing vehicle volatilization. Thus, the waste recording liquid maintains fluidity, so that buildup of the waste recording liquid is prevented.

The organic solvent contained in the waste liquid wetting liquid 13 is preferably refractory enough to maintain a layer of the waste liquid wetting liquid 3 until the waste liquid tank 11 becomes full. If the waste liquid wetting liquid 13 has high volatility, the waste liquid wetting liquid 13 evaporates and escapes, so that the waste recording liquid cannot maintain the property of becoming flat by the weigh thereof for a long time. Therefore, it is preferable that the organic solvent contained in the waste liquid wetting liquid 13 have lower volatility than the vehicle of the waste recording liquid.

In order to have the waste liquid recording liquid 13 receive the waste recording liquid without losing fluidity at least until the waste liquid tank 11 becomes full of the waste recording liquid and the waste liquid wetting liquid 13 reaches the end of the service life, the organic solvent contained in the waste liquid wetting liquid 13 needs to be prevented from being lost through evaporation. Accordingly, in the case of using an inexpensive aqueous recording liquid that forms high quality images, the organic solvent contained in the waste liquid wetting liquid 13 preferably has low volatility and has lower vapor pressure than water at least under the conditions of 25° C. and 1 atm (normal temperatures and normal pressures).

Glycols and glycerin are preferable choices as the organic solvent contained in the waste liquid wetting liquid 13 because of their high wetting capacities. Especially, glycols are more preferable if the recording liquid is aqueous, because glycols are hydrophilic and have high molecular weight and significantly low volatility. Examples of glycol include, but not limited thereto, ethylene glycol, diethylene glycol, triethylene glycol, 1,3-butadiene glycol, and 1,4-butadiene glycol. Triethylene glycol is especially preferable because triethylene glycol has moderately high molecular weight.

The volume of the waste liquid wetting liquid 13 to be held in the waste liquid tank 11 is preferably large enough to maintain dispersion of color materials in the waste liquid even when the waste liquid tank 11 becomes full of the waste liquid. The volume of the waste liquid wetting liquid 13 that is large enough to maintain dispersion of the color materials is dependent on dispersibility of the color materials with respect to the waste liquid wetting liquid 13, the capacity of the waste liquid tank 11, and volatility of the waste liquid wetting liquid 13.

Similar to the waste liquid wetting liquid 3, the waste liquid wetting liquid 13 preferably contains antifoamer, antiseptic and fungicidal agent, and may optionally contain viscosity modifier, pH adjuster, oxidizer, reducing agent, anticorrosive, antioxidant, etc.

The following describes specific experiments.

<Experiment 1>

Figure 5:
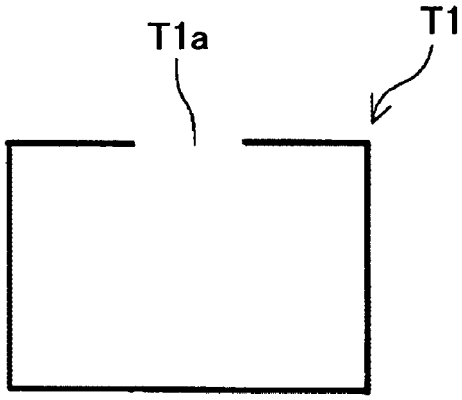
FIG. 5 is a schematic diagram showing an example of a waste liquid tank used in experiments and comparative experiments.

With reference to FIG. 5, a waste liquid wetting liquid A (100 ml) was placed in a waste liquid tank T1 having no receptacle member (absorbent member) therein. The composition of the waste liquid wetting liquid A is as follows:

[Waste Liquid Wetting Liquid A]

water . . . 100 parts

With use of a printer (hereinafter referred to as "an evaluation printer"), which is a modified IPSIO G707 (Ricoh Co., Ltd.), under conditions of temperature 30° C. and humidity 30%, (hereinafter referred to as an HL environment), pure recording liquid (cyan, magenta, yellow, and black recording liquids are mixed at a rate of 1:1:1:1; hereinafter referred to as "evaluation recording liquid" or "waste recording liquid") was introduced (discharged) from an opening T1*a* onto the liquid surface of the waste liquid wetting liquid A in the waste liquid tank T1 every minute for 2000 times, and then the state of waste recording liquid in the waste liquid tank T1 was observed. The amount of the evaluation recording liquid discharged each time was 0.2 ml.

<Experiment 2>

With reference to FIG. 5, a waste liquid wetting liquid B (100 ml) was placed in the waste liquid tank T1 having no receptacle member (absorbent member) therein. The composition of the waste liquid wetting liquid B is as follows:

[Waste Liquid Wetting Liquid B]

glycerin (hydrocarbon wetting agent) . . . 95 parts water . . . 5 parts

As in the case of Experiment 1, with use of the evaluation printer, in the HL environment, evaluation recording liquid was introduced (discharged) from the opening T1*a* onto the liquid surface of the waste liquid wetting liquid B in the waste liquid tank T1 every minute for 2000 times, and then the state of waste recording liquid in the waste liquid tank T1 was observed. The amount of the evaluation recording liquid discharged each time was 0.2 ml.

<Experiment 3>

With reference to FIG. 5, a waste liquid wetting liquid C (100 ml) was placed in the waste liquid tank T1 having no receptacle member (absorbent member) therein. The composition of the waste liquid wetting liquid C is as follows:

[Waste Liquid Wetting Liquid C]

glycerin (hydrocarbon wetting agent) . . . 100 parts

As in the case of Experiment 1, with use of the evaluation printer, in the HL environment, evaluation recording liquid was introduced (discharged) from the opening T1*a* onto the liquid surface of the waste liquid wetting liquid C in the waste liquid tank T1 every minute for 2000 times, and then the state of waste recording liquid in the waste liquid tank T1 was observed. The amount of the evaluation recording liquid discharged each time was 0.2 ml.

<Experiment 4>

With reference to FIG. 5, a waste liquid wetting liquid D (200 ml) was placed in the waste liquid tank T1 having no receptacle member (absorbent member) therein. The composition of the waste liquid wetting liquid D is as follows:

[Waste Liquid Wetting Liquid D]

triethylene glycol (hydrocarbon wetting agent) . . . 100 parts

As in the case of Experiment 1, with use of the evaluation printer, in the HL environment, evaluation recording liquid was introduced (discharged) from the opening T1*a* onto the liquid surface of the waste liquid wetting liquid D in the waste liquid tank T1 every minute for 2000 times, and then the state of waste recording liquid in the waste liquid tank T1 was observed. The amount of the evaluation recording liquid discharged each time was 0.2 ml.

<Experiment 5>

With reference to FIG. 5, a waste liquid wetting liquid E (20 ml) was placed in the waste liquid tank T1 having no receptacle member (absorbent member) therein. The composition of the waste liquid wetting liquid E is as follows:

[Waste Liquid Wetting Liquid E]

paraffin oil (hydrocarbon oil) . . . 100 parts

As in the case of Experiment 1, with use of the evaluation printer, in the HL environment, evaluation recording liquid was introduced (discharged) from the opening T1*a* onto the liquid surface of the waste liquid wetting liquid E in the waste liquid tank T1 every minute for 2000 times, and then the state of waste recording liquid in the waste liquid tank T1 was observed. The amount of the evaluation recording liquid discharged each time was 0.2 ml.

<Experiment 6>

With reference to FIG. 5, a waste liquid wetting liquid F (20 ml) was placed in the waste liquid tank T1 having no receptacle member (absorbent member) therein. The composition of the waste liquid wetting liquid F is as follows:

[Waste Liquid Wetting Liquid F]

silicone oil . . . 100 parts

As in the case of Experiment 1, with use of the evaluation printer, in the HL environment, evaluation recording liquid was introduced (discharged) from the opening T1*a* onto the liquid surface of the waste liquid wetting liquid F in the waste liquid tank T1 every minute for 2000 times, and then the state of waste recording liquid in the waste liquid tank T1 was observed. The amount of the evaluation recording liquid discharged each time was 0.2 ml.

<Comparative Experiment 1>

With reference to FIG. 5, as in the case of Experiment 1, with use of the evaluation printer, in the HL environment, evaluation recording liquid was introduced (discharged) from the opening T1*a* onto the bottom surface of the waste liquid tank T1, which does not have a receptacle member (absorbent member) therein, every minute for 2000 times, and then the state of waste recording liquid in the waste liquid tank T1 was observed. The amount of the evaluation recording liquid discharged each time was 0.2 ml.

<Comparative Experiment 2>

Figure 6:
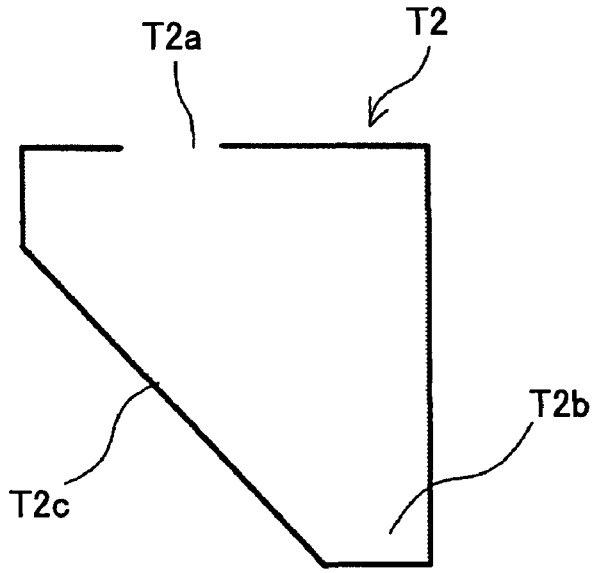
FIG. 6 is a schematic diagram showing another example of a waste liquid tank.

With reference to FIG. 6, a waste liquid wetting liquid C (100 ml) was placed in a bottom part T2*b* of a waste liquid tank T2 that does not have a receptacle member (absorbent member) therein and has a tilted bottom surface T2*c*. The composition of the waste liquid wetting liquid C is as follows (the same as that in Experiment 3):

[Waste Liquid Wetting Liquid C]

glycerin (hydrocarbon wetting agent) . . . 100 parts

As in the case of Experiment 1, with use of the evaluation printer, in the HL environment, evaluation recording liquid was introduced (discharged) from an opening T2*a* into the waste liquid tank T2 every minute for 2000 times, and then the state of waste recording liquid in the waste liquid tank T2 was observed. The amount of the evaluation recording liquid discharged each time was 0.2 ml. At the early stage of the experiment, the introduced evaluation recording liquid was dropped on the tilting surface T2*c*, and then flowed into the bottom part T2*b*, in which the waste liquid wetting liquid C is held, in some seconds.

<Comparative Experiment 3>

Figure 7:
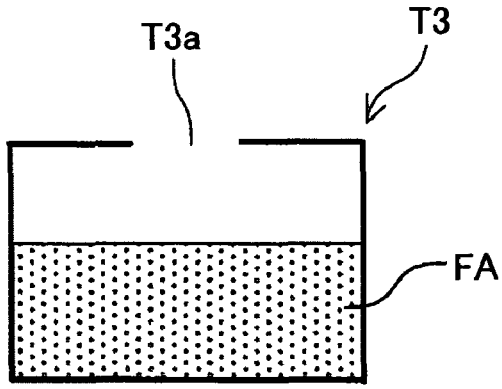
FIG. 7 is a schematic diagram showing still another example of a waste liquid tank.

With reference to FIG. 7, a waste liquid wetting liquid E (20 ml) was held in a receptacle member (absorbent member) FA in a waste liquid tank T3. The composition of the waste liquid wetting liquid E is as follows (the same as that in Experiment 5):

[Waste Liquid Wetting Liquid E]

paraffin oil (hydrocarbon oil) . . . 100 parts

As in the case of Experiment 1, with use of the evaluation printer, in the HL environment, evaluation recording liquid was introduced (discharged) from an opening T3*a* onto the surface of the receptacle member FA, in which the waste recording liquid E is held, in the waste liquid tank T3 every minute for 2000 times, and then the state of waste recording liquid in the waste liquid tank T3 was observed. The amount of the evaluation recording liquid discharged each time was 0.2 ml.

Evaluation results of the states of the waste recording liquids in Experiments 1 through 6 and Comparative Experiments 1 through 3 are shown in Table 1. In Table 1, the symbol "x" indicates that the viscosity of the waste recording liquid was increased, so that a mountain-like buildup of the waste recording liquid was formed; the symbol "Δ" indicates that although the viscosity of the waste recording liquid was increased, the waste recording liquid was dispersed in the waste liquid wetting liquid and held flat in the waste liquid tank; and the symbol "○" indicates that there was no increase in the viscosity of the waste recording liquid, and the waste recording liquid formed a separate layer from the layer of the waste liquid wetting liquid and was held flat in the waste liquid tank.

TABLE 1

| | EVALUATION RESULT |
|---|---|
| EXPERIMENT 1 | Δ |
| EXPERIMENT 2 | Δ |
| EXPERIMENT 3 | Δ |
| EXPERIMENT 4 | Δ |
| EXPERIMENT 5 | ○ |
| EXPERIMENT 6 | ○ |
| COMPARATIVE EXPERIMENT 1 | X |

TABLE 1-continued

| | EVALUATION RESULT |
|---|---|
| COMPARATIVE EXPERIMENT 2 | X |
| COMPARATIVE EXPERIMENT 3 | X |

Figure 8A:
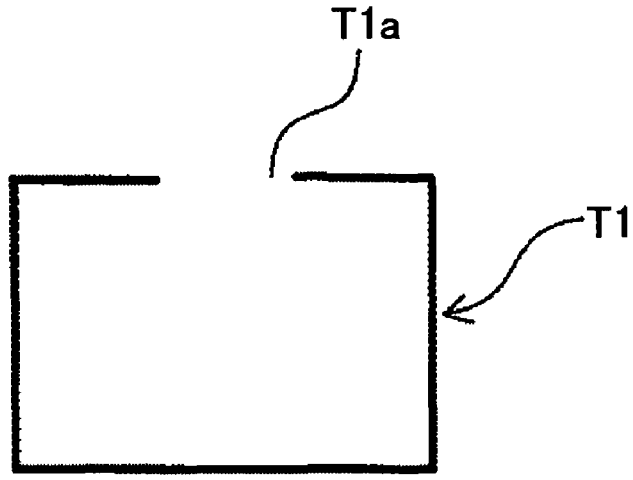
FIGS. 8A and 8B are schematic diagrams for explaining formation of a mountain-like buildup in the waste liquid tank of FIG. 5 in a comparative experiment.
Figure 8B:
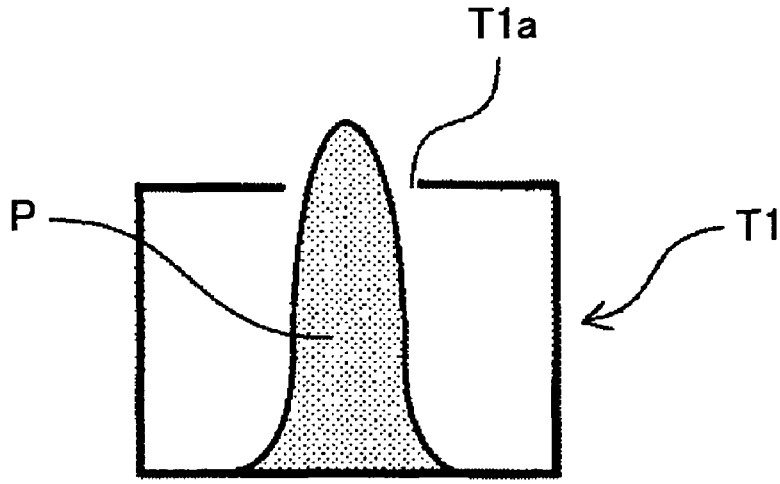

In Comparative Experiment 1, in the waste liquid tank T1 with no waste liquid wetting liquid therein, as shown in FIGS. 8A and 8B, along with introduction of the waste recording liquid into the waste liquid tank T1, the viscosity of the waste recording liquid was increased, resulting in forming a mountain-like buildup P.

Figure 9A:
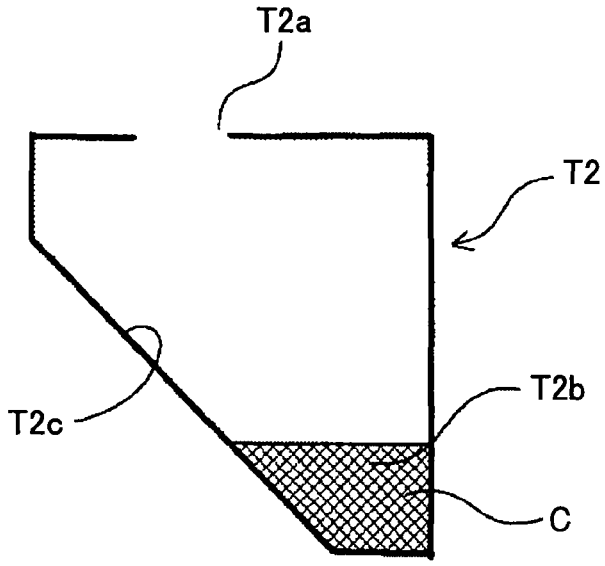
FIGS. 9A and 9B are schematic diagrams for explaining formation of a mountain-like buildup in the waste liquid tank of FIG. 6 in a comparative experiment.
Figure 9B:
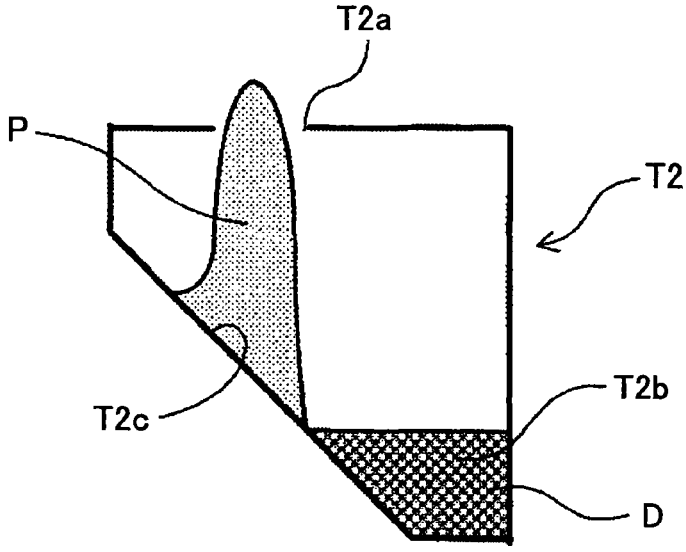

In Comparative Experiment 2, in the waste liquid tank T2, which has the waste liquid wetting liquid C therein but the waste recording liquid is not directly discharged into the waste liquid wetting liquid C, as shown in FIGS. 9A and 9B, a part of the waste recording liquid flowed into and was mixed with the waste liquid wetting liquid C to become a waste liquid 16. However, because it takes time for the waste recording liquid to flow into the waste liquid wetting liquid C, the viscosity of the waste recording liquid adhered to the tilted bottom surface T2*c* was increased, so that a mountain-like buildup P of the waste recording liquid was formed.

Figure 10A:
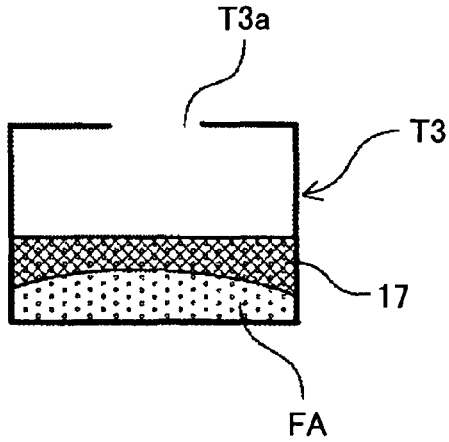
FIGS. 10A and 10B are schematic diagrams for explaining formation of a mountain-like buildup in the waste liquid tank of FIG. 7 in a comparative experiment.
Figure 10B:
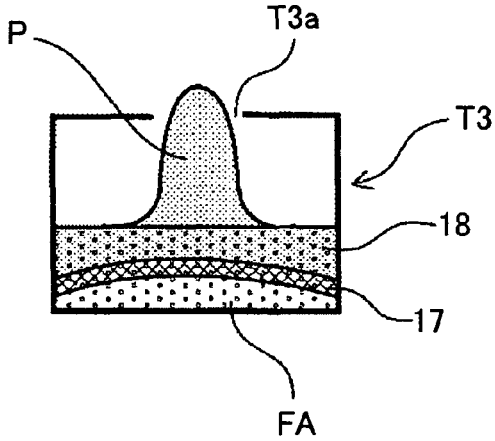

In Comparative Experiment 3, in the waste liquid tank T3 having the receptacle member FA containing the waste liquid wetting liquid E, as shown in FIGS. 10A and 10B, although the waste recording liquid was dispersed into a portion 17 at the surface of the receptacle member FA containing the waste liquid wetting liquid E, dispersion or separation of the introduced waste recording liquid by the waste liquid wetting liquid E in the receptacle member FA was slow relative to the introduction of the waste recording liquid at the HL condition. Thus, subsequently introduced waste recording liquid was absorbed in the receptacle member FA without being dispersed or separated (a portion 18 at the surface). Then, further subsequently introduced waste recording liquid was accumulated on the surface of the receptacle member FA, resulting in forming a mountain-like buildup P.

On the other hand, in Experiments 1 through 6, the waste recording liquid was discharged into the waste liquid wetting liquid, and no mountain-like buildup of the waste recording liquid was formed.

That is, as in Experiments 1 through 4, in the case where the waste liquid wetting liquid is compatible with the waste recording liquid (the second embodiment), the waste recording liquid was mixed with the waste liquid wetting liquid. Although the viscosity of a mixture of the waste recording liquid and the waste liquid wetting liquid (waste liquid; the term "waste liquid" indicates a liquid containing the waste recording liquid and the waste liquid wetting liquid regardless whether recording liquid and the waste liquid wetting liquid are mixed together) was slightly increased, the color materials were dispersed and the waste liquid showed fluidity.

As in Experiments 5 through 6, in the case where the waste liquid wetting liquid has low compatibility with the waste recording liquid and lower specific gravity than the waste recording liquid (the first embodiment), when the waste recording liquid is discharged into the waste liquid tank, an organic solvent of the waste liquid wetting liquid having lower specific gravity moves onto the surface of the waste recording liquid. Thus, in the waste liquid tank, the waste recording liquid and the waste liquid form separate layers, and the waste recording liquid is held flat.

As can be understood from the above results, the waste liquid wetting liquid may include components that disperse or dissolve the waste recording liquid as those in Experiments 1 through 4, the waste liquid wetting liquid containing the organic solvent that has lower specific gravity than the vehicle of the waste recording liquid and low compatibility with the recording liquid as those in Experiments 5 and 6 has higher wetting efficiency because the organic solvent floats on the waste recording liquid to prevent the waste recording liquid from coming into contact with air and thus prevents viscosity increase of the waste recording liquid. In the case of Experiments 5 and 6, since the waste liquid wetting liquid with the volume large enough to cover the interface can impart sufficient wetting effect, viscosity increase of the waste recording liquid can be prevented with the small volume of the waste liquid wetting liquid.

The following describes long term experiments, i.e., experiments conducted to examine whether the waste liquid wetting liquid is able to maintain the wetting effect on the waste recording liquid for a long time.

<Experiment 7>

With reference to FIG. 5, a waste liquid wetting liquid C (100 ml) was placed in the waste liquid tank T1 having no receptacle member (absorbent member) therein. The composition of the waste liquid wetting liquid C is as follows:

[Waste Liquid Wetting Liquid C]

glycerin (hydrocarbon wetting agent) . . . 100 parts

With use of the evaluation printer, in the HL environments, evaluation recording liquid of 0.2 ml was discharged directly into the waste liquid wetting liquid C in the waste liquid tank T1 by applying pressure by a pump and guiding by a tube. The discharge was performed at one hour intervals 5 times a day and 5 days a week for 10 months, and then the state of waste recording liquid in the waste liquid tank T1 was observed.

<Experiment 8>

With reference to FIG. 5, a waste liquid wetting liquid D (100 ml) was placed in the waste liquid tank T1 having no receptacle member (absorbent member) therein. The composition of the waste liquid wetting liquid D is as follows:

[Waste Liquid Wetting Liquid D]

triethylene glycol (hydrocarbon wetting agent) . . . 100 parts

With use of the evaluation printer, in the HL environments, evaluation recording liquid of 0.2 ml was discharged directly into the waste liquid wetting liquid D in the waste liquid tank T1 by applying pressure by a pump and guiding by a tube. The discharge was performed at one hour intervals 5 times a day and 5 days a week for 10 months, and then the state of waste recording liquid in the waste liquid tank T1 was observed.

<Experiment 9>

With reference to FIG. 5, a waste liquid wetting liquid E (20 ml) was placed in the waste liquid tank T1 having no receptacle member (absorbent member) therein. The composition of the waste liquid wetting liquid E is as follows:

[Waste Liquid Wetting Liquid E]

paraffin oil (hydrocarbon oil) . . . 100 parts

With use of the evaluation printer, in the HL environments, evaluation recording liquid of 0.2 ml was discharged directly into the waste liquid wetting liquid E in the waste liquid tank T1 by applying pressure by a pump and guiding by a tube. The discharge was performed at one hour intervals 5 times a day and 5 days a week for 10 months, and then the state of waste recording liquid in the waste liquid tank T1 was observed.

<Experiment 10>

With reference to FIG. 5, a waste liquid wetting liquid F (20 ml) was placed in the waste liquid tank T1 having no receptacle member (absorbent member) therein. The composition of the waste liquid wetting liquid F is as follows:

[Waste Liquid Wetting Liquid F]

silicone oil . . . 100 parts

With use of the evaluation printer, in the HL environments, evaluation recording liquid of 0.2 ml was discharged directly into the waste liquid wetting liquid F placed in the waste liquid tank T1 by applying pressure by a pump and guiding by a tube. The discharge was performed at one hour intervals 5 times a day and 5 days a week for 10 months, and then the state of waste recording liquid in the waste liquid tank T1 was observed.

Evaluation results of the states of the waste recording liquids in Experiments 7 through 10 are shown in Table 2. In Table 2, the symbol "x" indicates that the viscosity of the waste recording liquid was increased, so that a mountain-like buildup of the waste recording liquid was formed; the symbol "Δ" indicates that although the viscosity of the waste recording liquid was increased, the waste recording liquid was dispersed in the waste liquid wetting liquid and held flat in the waste liquid tank; and the symbol "○" indicates that there was no increase in the viscosity of the waste recording liquid, and the waste recording liquid formed a separate layer from the layer of the waste liquid wetting liquid and was held flat in the waste liquid tank.

TABLE 2

| | EVALUATION RESULT |
|---|---|
| EXPERIMENT 7 | X |
| EXPERIMENT 8 | Δ |
| EXPERIMENT 9 | ○ |
| EXPERIMENT 10 | ○ |

It was found from these results that, in Experiment 7, long-term reliability is insufficient due to evaporation of organic solvent. In Experiment 8, although there was a slight increase in the viscosity of the waste recording liquid, the waste recording liquid was dispersed into the waste liquid wetting liquid D and held flat in the waste liquid tank T1. In Experiments 9 and 10, because organic solvents are non-volatile, wetting effects lasted for a long time even though the volume of the organic solvents were small.

Figure 11:
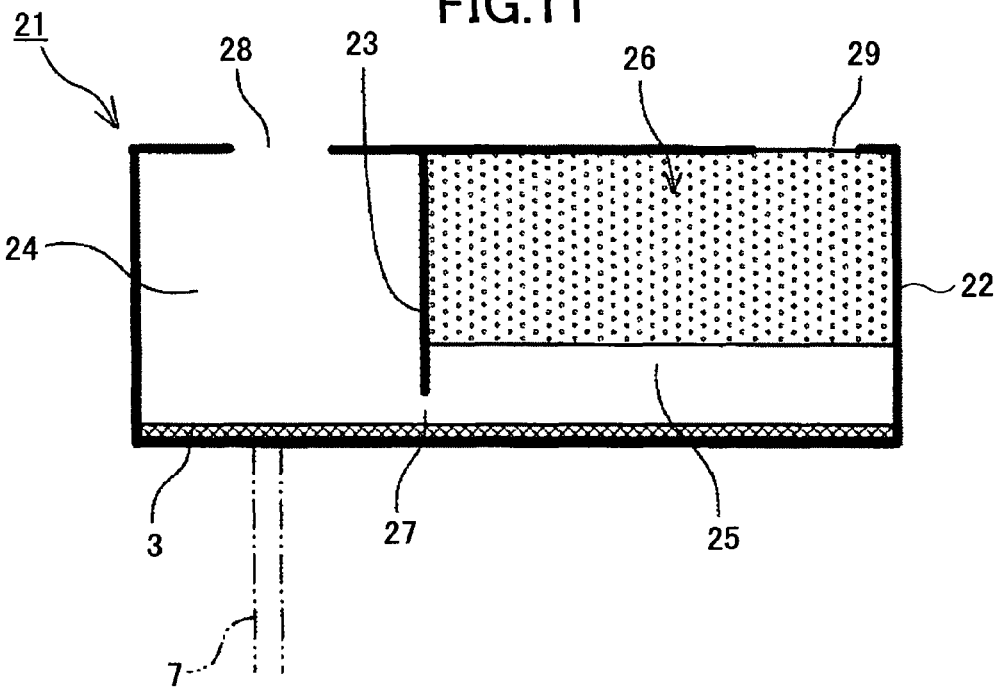
FIG. 11 is a schematic diagram showing a waste liquid tank according to a third embodiment of the present invention.

A waste liquid tank 21 according to a third embodiment of the present invention is described below with reference to FIG. 11. FIG. 11 is a schematic diagram showing the waste liquid tank 21 of this embodiment.

The waste liquid tank 21 includes a tank case 22 divided by a partition plate 23 into a first chamber 24 that receives the waste recording liquid and a second chamber 25 that accommodates a receptacle member 26 made of an absorbent body that absorbs the waste liquid. The partition plate 23 is provided with a communication passage 27 (an opening in this embodiment) for communication between the first chamber 24 and the second chamber 25 at the bottom of the tank case 22.

At the bottom of the tank case 22, a waste liquid wetting liquid 3 fills the tank case 22 up to a level lower than the height of the communication passage 27. Thus, when the liquid level of the waste liquid wetting liquid 3 rises above the height of the communication passage 27 of the partition plate 23 along with introduction of the waste recording liquid, the waste liquid wetting liquid 3 is separated into the first chamber 24 side and the second chamber 25 side.

A lowermost end face 26*a* of the receptacle member 26 in the second chamber 25 is located at a position higher than the communication passage 27.

The tank case 22 has air outlets 28 and 29 at the upper side of the first chamber 24 and the second chamber 25, respectively. The air outlet 28 of the first chamber 24 serves also as an inlet for introducing the waste recording liquid.

It is to be noted that the waste recording liquid may be introduced into the waste liquid tank 21 from the air outlet 28 or forcibly introduced into the waste liquid wetting liquid 3 through a waste recording liquid introduction tube 7 connected to the bottom part of the first chamber 24 (although the waste recording liquid introduction tube 7 is not shown in the drawings other than FIG. 11, the waste recording liquid introduction tube 7 is provided in the manner as described above in the case of forcibly introducing the waste recording liquid into the waste liquid wetting liquid 3).

Figure 12A:
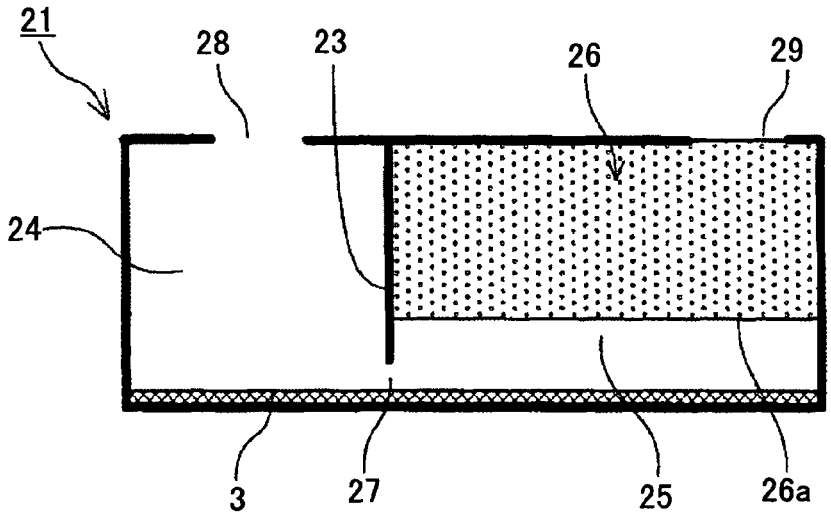
FIGS. 12A through 12C are schematic diagrams for explaining operations of the waste liquid tank of FIG. 11.
Figure 12B:
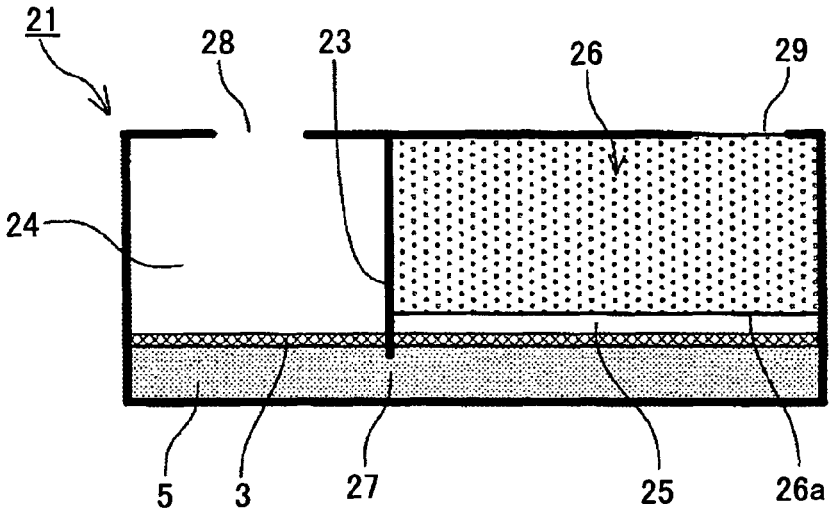
Figure 12C:
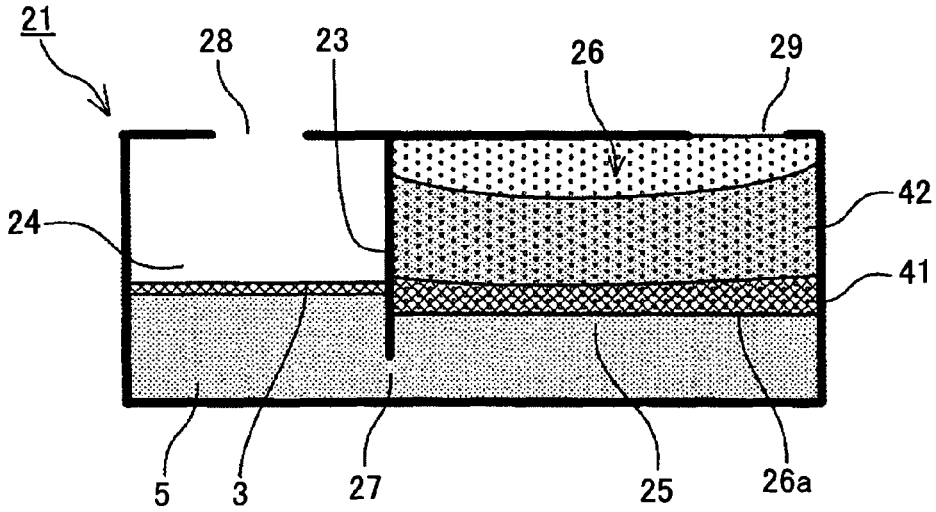

The following provides an example wherein the waste recording liquid is introduced into the waste liquid tank 21 of this embodiment with reference to FIGS. 12A through 12C.

In this example, as shown in FIG. 12A, the waste liquid wetting liquid F (20 ml: silicone oil . . . 100 parts) as the waste liquid wetting liquid 3 was placed in the bottom of the tank case 22 of the waste liquid tank 21. In this case, since the waste liquid wetting liquid 3 is composed only of organic solvent, a layer of the organic solvent of the waste liquid wetting liquid 3 is hereinafter referred to as "a layer of the waste liquid wetting liquid 3".

With use of the evaluation printer, evaluation recording liquid (waste recording liquid 5) of 0.2 ml was introduced into the waste liquid wetting liquid F in the waste liquid tank 21 at one minute intervals in the HL environment until the waste liquid tank 21 became full. (In this example, the waste recording liquid was forcibly introduced into the waste liquid wetting liquid 3 through the waste recording liquid introduction tube 7. The same applies in the following examples if not otherwise specified.) Thus, the process of accumulation of waste liquid was observed.

When the waste recording liquid 5 was introduced into the waste liquid tank 21, as shown in FIG. 12B, the waste liquid was separated into two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. When the layer of the waste liquid wetting liquid 3 rose above the communication passage 27 due to rise of the liquid level, the layer of the waste liquid wetting liquid 3 was separated by the partition plate 23 (the upper end of the communication passage 27) into the first chamber 24 and the second chamber 25. In this step, since the lowermost end face 26*a* of the receptacle member 26 in the second chamber 25 is located above the communication passage 27, the waste liquid wetting liquid 3 was out of contact with the receptacle member 26 and therefore was not absorbed by the receptacle member 26.

As shown in FIG. 12C, the liquid level of the waste liquid wetting liquid 3 forming the surface layer further rose by subsequent introduction of the waste recording liquid 5, so that the waste liquid wetting liquid 3 was absorbed by the receptacle member 26 in the second chamber 25. With still further introduction of the waste recording liquid 5, the waste recording liquid 5 was also absorbed by the receptacle member 26. It is to be noted that, in FIG. 12C, the receptacle member 26 is shown divided into a portion 41 in which the waste liquid wetting liquid (organic solvent) 3 was absorbed, a portion 42 in which the waste recording liquid (liquid with color materials dispersed therein) 5 was absorbed, and a portion in which nothing was absorbed.

As described above, since the receptacle member 26 is provided in the waste liquid tank 21, the receptacle member 26 can hold the waste recording liquid 5, thereby reducing the volume of the waste liquid that flows out in case the waste liquid tank 21 is tilted.

The waste liquid tank 21 includes the first chamber 24 that receives the waste recording liquid 5 and the second chamber 25 that accommodates the receptacle member 26 capable of absorbing the waste liquid. The waste liquid wetting liquid 3 is separated into the first chamber 24 side and the second chamber 25 side when the liquid level rises by the introduction of the waste recording liquid 5. With this configuration, the volume of the waste recording liquid 3 absorbed by the receptacle member 26 is reduced, thereby retaining the waste liquid wetting liquid 3 in the form of a liquid.

With the provision of the communication passage 27 for communication between the first chamber 24 and the second chamber 25 in the partition plate 23 separating the first chamber 24 and the second chamber 25, the waste liquid wetting liquid 3 is easily divided by the first chamber 24 and the second chamber 25 when the liquid level rises above the communication passage 27 by the introduction of the waste recording liquids.

Since the lowermost end face 26*a* of the receptacle member 26 is located above the communication passage 27, the waste liquid wetting liquid 3 is absorbed by the receptacle member 26 only after the waste liquid wetting liquid 3 is divided into the first chamber 24 and the second chamber 25. Therefore, the receptacle member 26 does not absorb all the part of the waste liquid wetting liquid 3. That is, the waste liquid wetting liquid 3 in the first chamber 24 remains in the form of a liquid.

Figure 13:
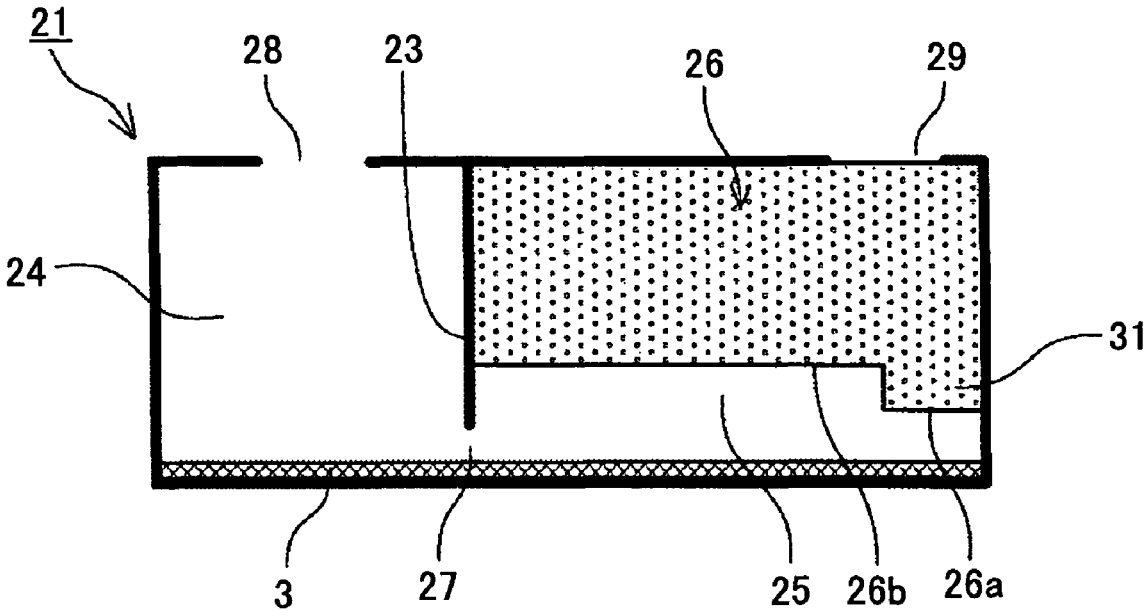
FIG. 13 is a schematic diagram showing a waste liquid tank according to a fourth embodiment of the present invention.

A waste liquid tank 21 according to a fourth embodiment of the present invention is described below with reference to FIG. 13. FIG. 13 is a schematic diagram showing the waste liquid tank 21 of this embodiment.

The waste liquid tank 21 of this embodiment is different from the liquid tank 21 of the third embodiment in that the lowermost end face 26*a* of the receptacle member 26 is defined by a lower face of a projection 31 projecting from a lower end face 26*b* of the receptacle member 26. The projection 31 is a step formed in the receptacle member 26.

The following provides an example wherein the waste recording liquid is introduced into the waste liquid tank 21 of this embodiment with reference to FIGS. 14A through 14D.

Figure 14A:
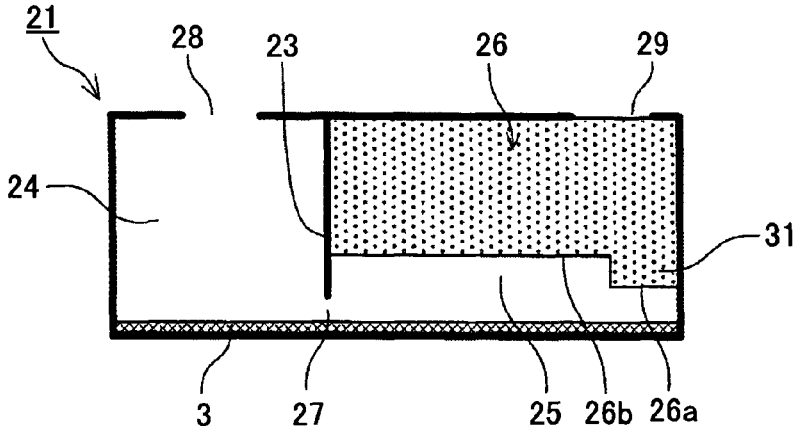
FIGS. 14A through 14D are schematic diagrams for explaining operations of the waste liquid tank of FIG. 13.

In this example, as shown in FIG. 14A, the waste liquid wetting liquid F (20 ml: silicone oil . . . 100 parts) as the waste liquid wetting liquid 3 was placed in the bottom of the tank case 22 of the waste liquid tank 21. With use of the evaluation printer, evaluation recording liquid (waste recording liquid 5) of 0.2 ml was introduced into the waste liquid wetting liquid F in the waste liquid tank 21 at one minute intervals in the HL environment until the waste liquid tank 21 became full. Thus, the process of accumulation of waste liquid was observed.

Figure 14B:
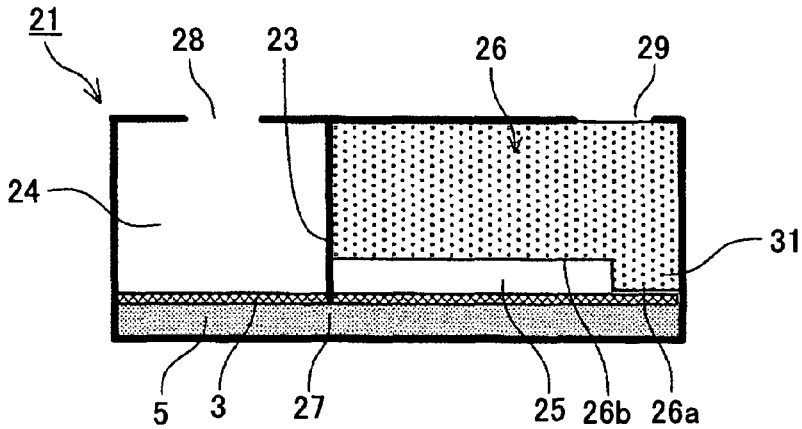

Along with the introduction of the waste recording liquid 5 into the waste liquid tank 21, the liquid level of the waste liquid gradually rose while forming, as shown in FIG. 14B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. With the rise of the liquid level, the waste liquid wetting liquid 3 was separated (divided) by the partition plate 23 (the upper end of the communication passage 27) into the first chamber 24 and the second chamber 25. In this step, since the lowermost end face 26*a* of the projection 31 of the receptacle member 26 in the second chamber 25 is located above the communication passage 27, the waste liquid wetting liquid 3 was out of contact with the receptacle member 26 and therefore was not absorbed by the receptacle member 26.

Figure 14C:
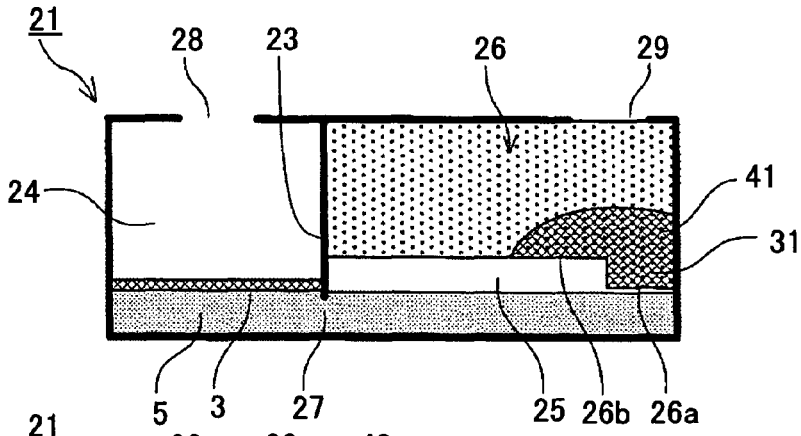

As shown in FIG. 14C, the liquid level of the layer of the waste liquid wetting liquid 3 further rose by subsequent introduction of the waste recording liquid 5, so that the waste liquid wetting liquid 3 in the second chamber 25 came into contact with the lowermost end face 26*a* of the projection 31 of the receptacle member 26 so as to be absorbed by the receptacle member 26. In this step, since the waste liquid wetting liquid 3 was present at the surface, most of the waste liquid wetting liquid 3 in the second chamber 25 was absorbed locally into the projection 31 of the receptacle member 26 and the vicinity thereof (a portion indicated by the reference numeral 41).

Figure 14D:
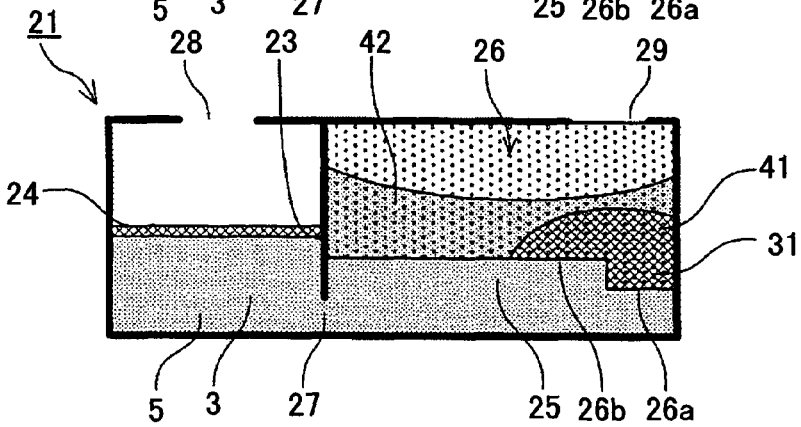

With still further introduction of the waste recording liquid 5, as shown in FIG. 14D, the waste recording liquid 5 came into contact with the lower end face 26*b* of the receptacle member 26 so as to be absorbed by the receptacle member 26. In this step, since the layer of the waste liquid wetting liquid 3 was no longer present at the surface, the waste recording liquid 5 was quickly absorbed into a portion (indicated by the reference numeral 42) excluding the portion 41 in which the waste liquid wetting liquid 3 had been absorbed.

As can be seen, since the lowermost end face 26*a* of the receptacle member 26 is defined by the lower face of the projection 31 projecting from the lower end face 26*b* of the receptacle member 26, the waste liquid wetting liquid 3 forming the surface layer in the second chamber 25 is removed by being absorbed into the receptacle member 26. Therefore, the waste recording liquid 5 can be quickly absorbed into the receptacle member 26.

Figure 15:
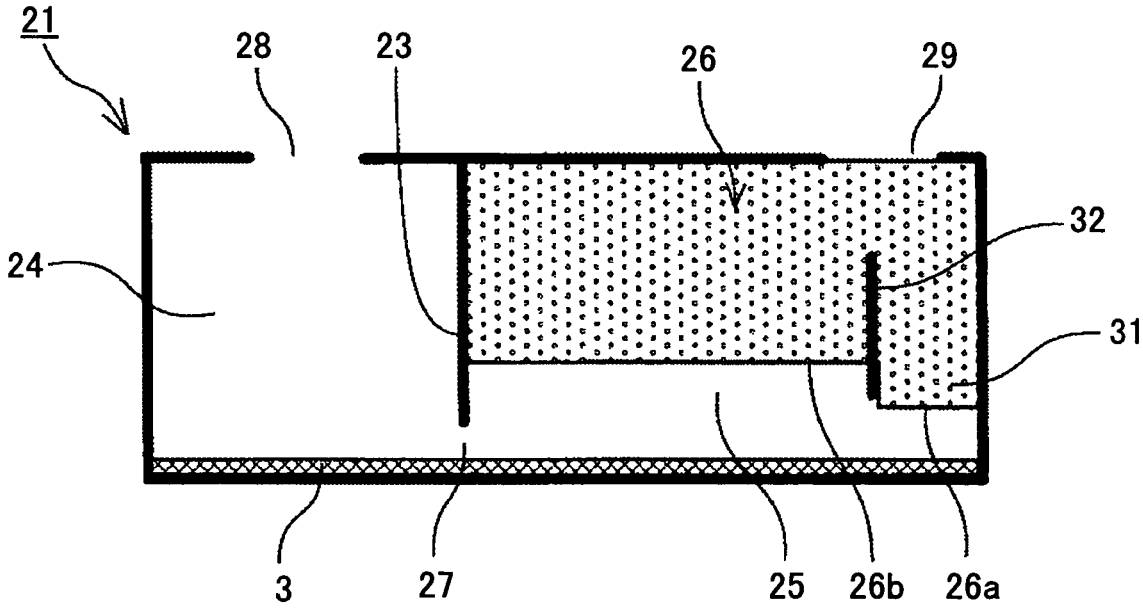
FIG. 15 is a schematic diagram showing a waste liquid tank according to a fifth embodiment of the present invention.

A waste liquid tank 21 according to a fifth embodiment of the present invention is described below with reference to FIG. 15. FIG. 15 is a schematic diagram showing the waste liquid tank 21 of this embodiment.

The waste liquid tank 21 of this embodiment is different from the waste liquid tank 21 of the fourth embodiment in that the projection 31 defining the lowermost end face 26*a* of the receptacle member 26 is separated from the rest of the part of the receptacle member 26 by a partition wall member 32 as a diffusion limitation unit for limiting diffusion of the waste liquid wetting liquid 3 into the receptacle member 26.

The following provides an example wherein the waste recording liquid is introduced into the waste liquid tank 21 of this embodiment with reference to FIGS. 16A through 16D.

Figure 16A:
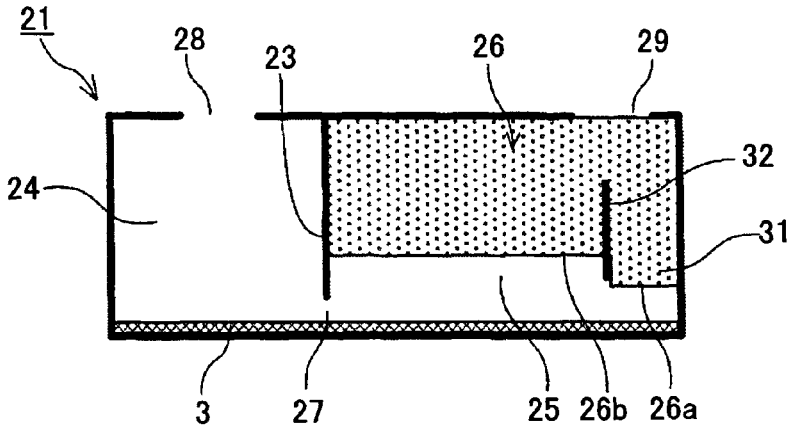
FIGS. 16A through 16D are schematic diagrams for explaining operations of the waste liquid tank of FIG. 15.

In this example, as shown in FIG. 16A, the waste liquid wetting liquid F (20 ml: silicone oil . . . 100 parts) as the waste liquid wetting liquid 3 was placed in the bottom of the tank case 22 of the waste liquid tank 21. With use of the evaluation printer, evaluation recording liquid (waste recording liquid 5) of 0.2 ml was introduced into the waste liquid wetting liquid F in the waste liquid tank 21 at one minute intervals in the HL environment until the waste liquid tank 21 became full. Thus, the process of accumulation of waste liquid was observed.

Figure 16B:
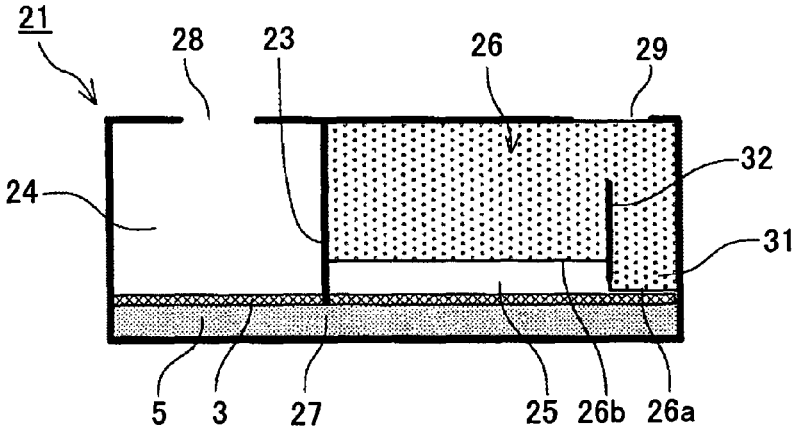

Along with the introduction of the waste recording liquid 5 into the waste liquid tank 21, the liquid level of the waste liquid gradually rose while forming, as shown in FIG. 16B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. With the rise of the liquid level, the waste liquid wetting liquid 3 was separated (divided) by the partition plate 23 into the first chamber 24 and the second chamber 25. In this step, since the lowermost end face 26*a* of the projection 31 of the receptacle member 26 accommodated in the second chamber 25 is located above the communication passage 27, the waste liquid wetting liquid 3 was out of contact with the receptacle member 26 and therefore was not absorbed by the receptacle member 26.

Figure 16C:
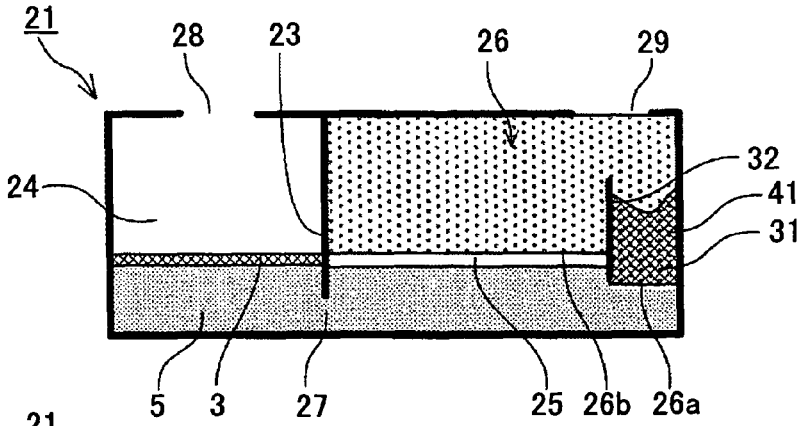

As shown in FIG. 16C, the liquid level of the waste liquid wetting liquid 3 forming the surface layer further rose by subsequent introduction of the waste recording liquid 5, so that the waste liquid wetting liquid 3 in the second chamber 25 came into contact with the lowermost end face 26*a* of the projection 31 of the receptacle member 26 so as to be absorbed by the receptacle member 26. In this step, since the waste liquid wetting liquid 3 was present at the surface, most of the waste liquid wetting liquid 3 in the second chamber 25 was absorbed locally into the projection 31 of the receptacle member 26. Further, since the diffusion limitation unit (partition wall member) 32 is provided around the projection 31, diffusion of the absorbed waste liquid wetting liquid 3 is limited to the projection 31 (a portion indicated by the reference numeral 41).

Figure 16D:
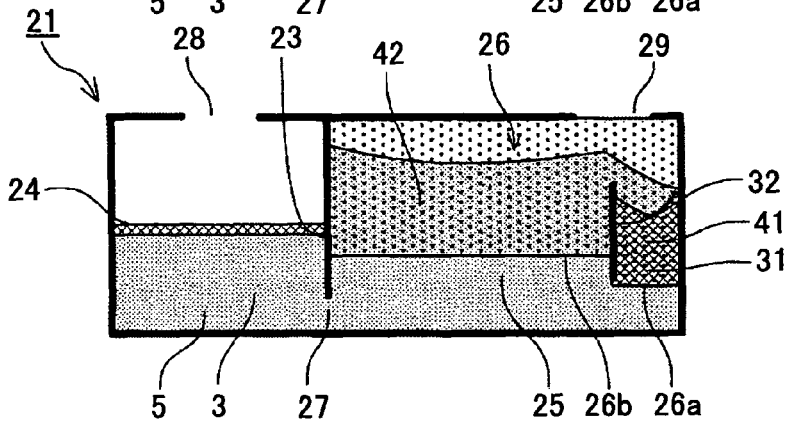

With still further introduction of the waste recording liquid 5, as shown in FIG. 16D, the waste recording liquid 5 came into contact with the lower end face 26*b* of the receptacle member 26 so as to be absorbed by the receptacle member 26. In this step, since the layer of the waste liquid wetting liquid 3 was no longer present at the surface, the waste recording liquid 5 was quickly absorbed into a portion (indicated by the reference numeral 41) excluding the portion 41 in which the waste recording liquid 5 had been absorbed.

As described above, the lowermost end face 26*a* of the receptacle member 26 is defined by the lower face of the projection 31 formed on the lower end face 26*b* of the receptacle member 26. Further, the diffusion limitation unit 32 for limiting the diffusion of the waste liquid wetting liquid 3 contained in the waste liquid is provided at least partly around the projection 31. With this configuration, the area of the lower end face 26*b* of the receptacle member 26 that is out of contact with the organic solvent is greater compared with the fourth embodiment, so that the waste recording liquid 5 quickly penetrates and is absorbed into the receptacle member 26.

Figure 17:
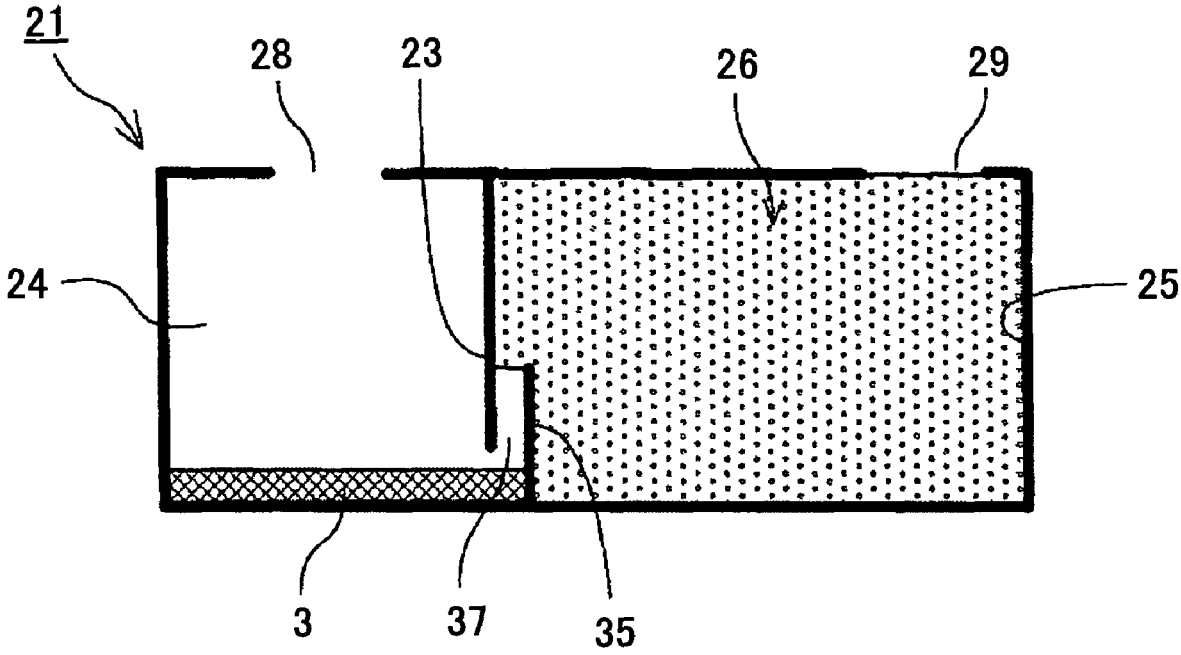
FIG. 17 is a schematic diagram showing a waste liquid tank according to a sixth embodiment of the present invention.

A waste liquid tank 21 according to a sixth embodiment of the present invention is described below with reference to FIG. 17. FIG. 17 is a schematic diagram showing the waste liquid tank 21 of this embodiment.

The waste liquid tank 21 includes a tank case 22 divided by a partition plate 23 into a first chamber 24 that receives the waste recording liquid and a second chamber 25 that accommodates a receptacle member 26 that absorbs the waste liquid.

An opening in the partition plate 23 at the bottom side of the tank case 22 and an upright member 35 extending upward from the bottom surface of the tank case 22 at the second chamber 25 side are provided so as to form a communication passage 37, which establishes communication between the first chamber 24 communicates with the second chamber 25 and has an opening at the second chamber 25 side at a position higher than its opening at the first chamber 24 side. The receptacle member 26 fills in the second chamber 25 excluding the communication passage 37.

The waste liquid wetting liquid 3 is placed in the bottom of the first chamber 24 and the communication passage 37 in the tank case 22, the level of the waste liquid wetting liquid 3 is lower than the height of the communication passage 37 defined by the partition plate 23. Thus, when the level of the waste liquid wetting liquid 3 rises above the upper opening of the communication passage 37 due to introduction of the waste recording liquid, the waste liquid wetting liquid 3 is separated into the first chamber 24 side and the second chamber 25 side (the communication passage 37 side).

The tank case 22 has air outlets 28 and 29 at the upper side of the first chamber 24 and the second chamber 25, respectively. The air outlet 28 of the first chamber 24 serves also as an inlet for introducing the waste recording liquid.

Figure 18A:
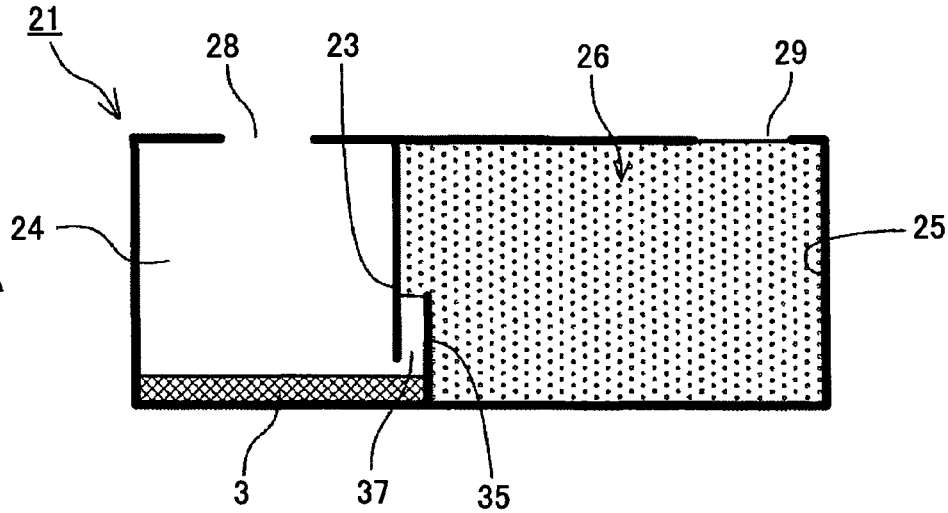
FIGS. 18A through 18C are schematic diagrams for explaining operations of the waste liquid tank of FIG. 17.
Figure 18B:
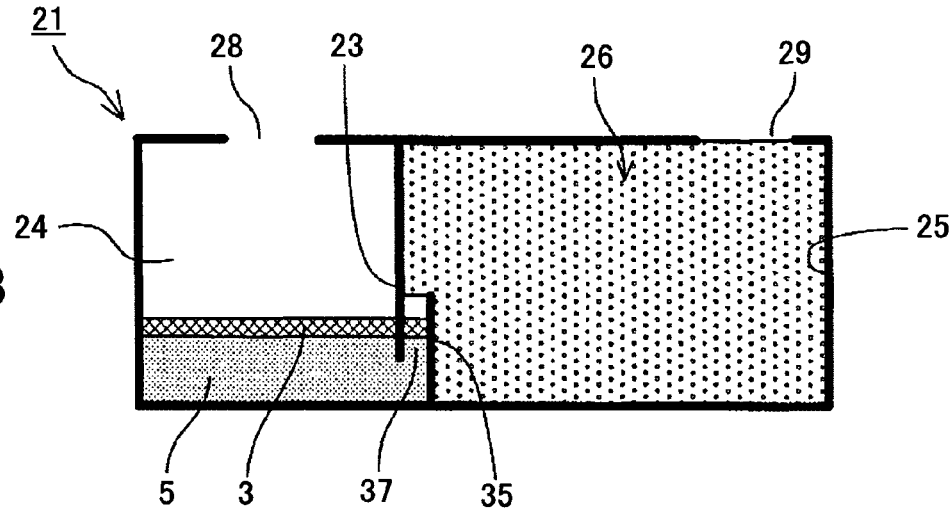
Figure 18C:
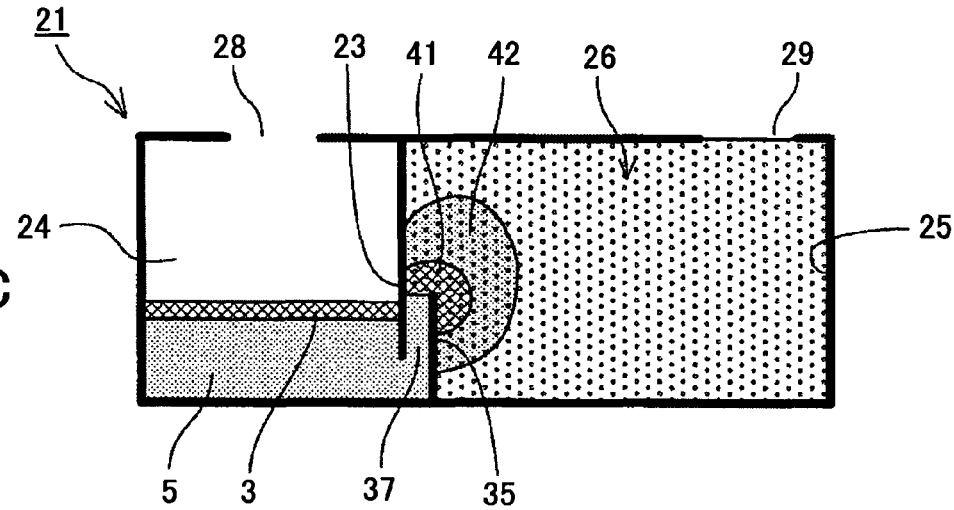

The following provides an example wherein the waste recording liquid is introduced into the waste liquid tank 21 of this embodiment with reference to FIGS. 18A through 18C.

In this example, as shown in FIG. 18A, the waste liquid wetting liquid F (20 ml: silicone oil . . . 100 parts) as the waste liquid wetting liquid 3 was placed at the first chamber 24 side of the upright member 35 in the bottom of the tank case 22 of the waste liquid tank 21. With use of the evaluation printer, evaluation recording liquid (waste recording liquid 5) of 0.2 ml was introduced into the waste liquid wetting liquid F in the waste liquid tank 21 at one minute intervals in the HL environment until the waste liquid tank 21 became full. Thus, the process of accumulation of waste liquid was observed.

Along with the introduction of the waste recording liquid 5 into the waste liquid tank 21, the liquid level of the waste liquid gradually rose while forming, as shown in FIG. 18B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. With the rise of the liquid level, the waste liquid wetting liquid 3 was separated (divided) by the partition plate 23 into the first chamber 24 side and the second chamber 25 side (the communication passage 37 side). In this step, since the opening of the communication passage 37 at the second chamber 25 side was at a relatively higher position, the waste liquid wetting liquid 3 was out of contact with the receptacle member 26 and therefore was not absorbed by the receptacle member 26. Further, since the openings of the communication passage 37 are narrow, the volume of the waste liquid wetting liquid 3 in the communication passage 37 is relatively less compared with the above embodiments in which the waste liquid wetting liquid 3 flows into the entire bottom part of the second chamber 25.

As shown in FIG. 18C, when the liquid level of the waste liquid wetting liquid 3 forming the surface layer rose to the opening of the communication passage 37 at the second chamber 25 side by further introduction of the waste recording liquid 5, the waste liquid wetting liquid 3 was absorbed by the receptacle member 26 facing the opening. With still further introduction of the waste recording liquid 5, the waste recording liquid 5 was also absorbed by the receptacle member 26.

Since the communication passage 37 for communication between the first chamber 24 and the second chamber 25 has the opening at the second chamber 25 side at a higher position than the opening at the first chamber 24 side, the volume of the waste liquid wetting liquid 3 flowing into the second chamber 25 side can be reduced. Therefore, the volume of the waste liquid wetting liquid 3 remaining in the first chamber 24 side can be relatively increased.

Figure 19:
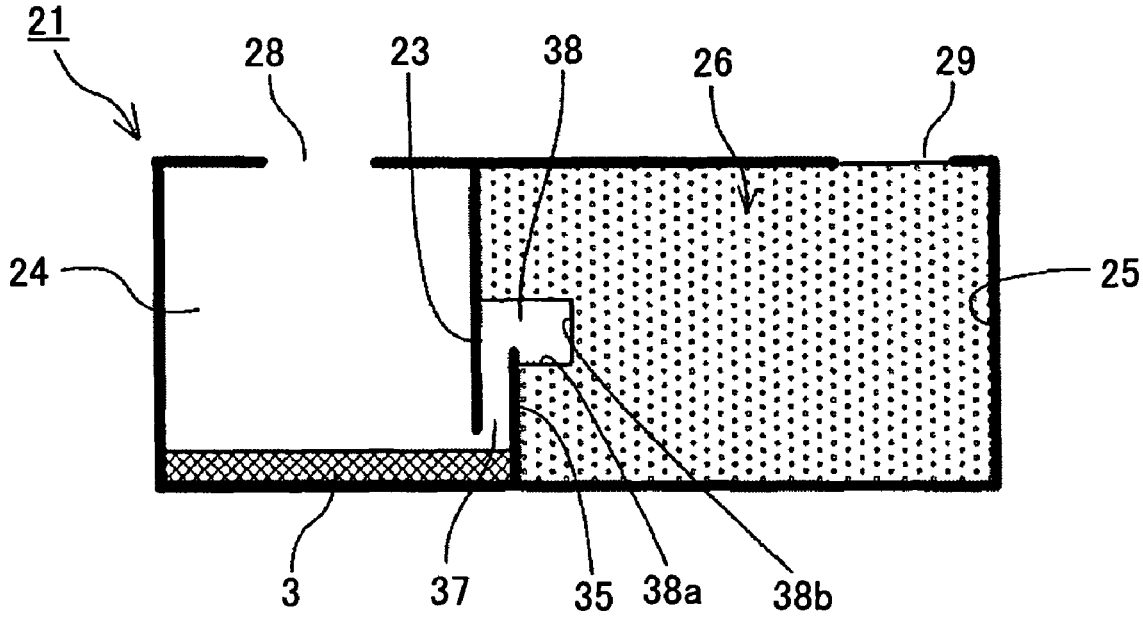
FIG. 19 is a schematic diagram showing a waste liquid tank according to a seventh embodiment of the present invention.

A waste liquid tank 21 according to a seventh embodiment of the present invention is described below with reference to FIG. 19. FIG. 19 is a schematic diagram showing the waste liquid tank 21 of this embodiment.

The waste liquid tank 21 of this embodiment is different from the waste liquid tank 21 of the sixth embodiment of the present invention in that a clearance 38 is formed in place of providing the receptacle member 26 in a region facing the opening of the communication passage 37 at the second chamber 25 side.

Figure 20A:
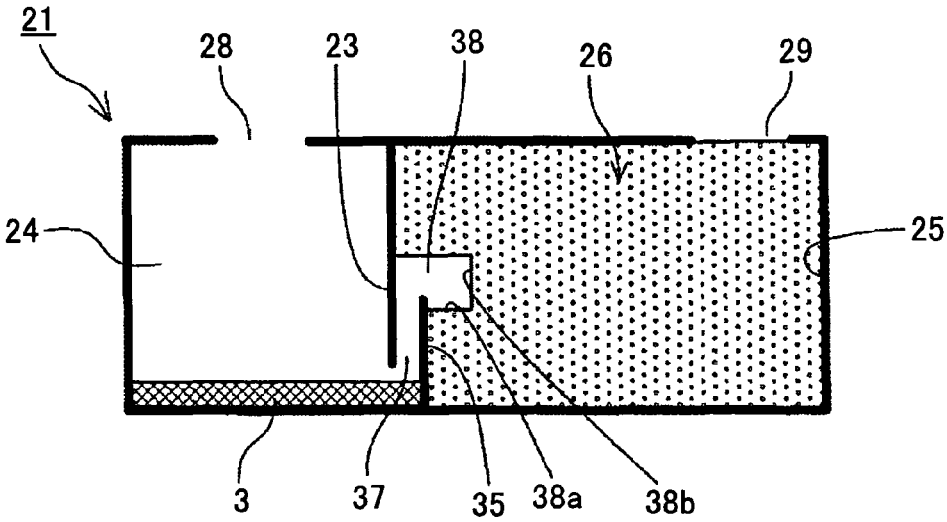
FIGS. 20A through 20C are schematic diagrams for explaining operations of the waste liquid tank of FIG. 19.
Figure 20B:
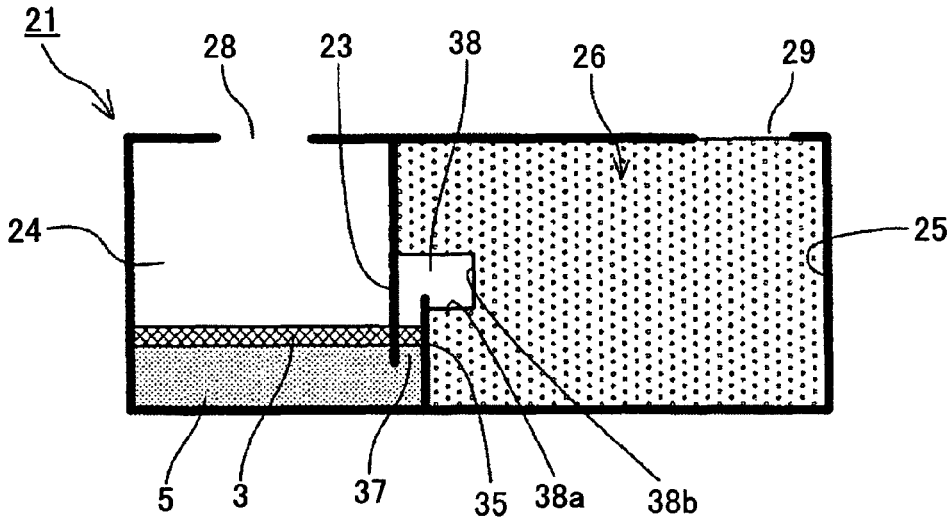
Figure 20C:
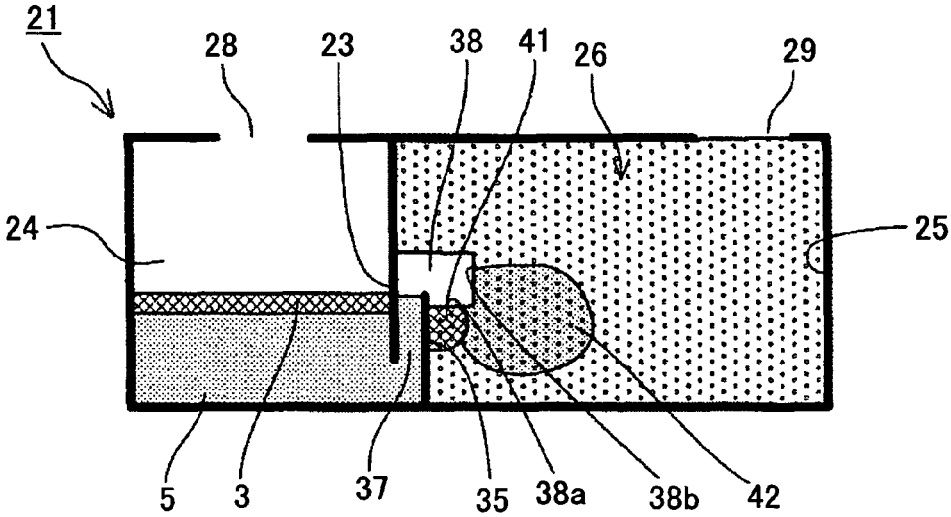

The following provides an example wherein the waste recording liquid is introduced into the waste liquid tank 21 of this embodiment with reference to FIGS. 20A through 20C.

In this example, as shown in FIG. 20A, the waste liquid wetting liquid F (20 ml: silicone oil . . . 100 parts) as the waste liquid wetting liquid 3 was placed at the first chamber 24 side of the upright member 35 in the bottom of the tank case 22 of the waste liquid tank 21. With use of the evaluation printer, evaluation recording liquid (waste recording liquid 5) of 0.2 ml was introduced into the waste liquid wetting liquid F in the waste liquid tank 21 at one minute intervals in the HL environment until the waste liquid tank 21 became full. Thus, the process of accumulation of waste liquid was observed.

Along with the introduction of the waste recording liquid 5 into the waste liquid tank 21, the liquid level of the waste liquid gradually rose while forming, as shown in FIG. 20B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. With the rise of the liquid level, the waste liquid wetting liquid 3 was separated (divided) by the partition plate 23 into the first chamber 24 side and the second chamber 25 side (the communication passage 37 side). In this step, since the opening of the communication passage 37 at the second chamber 25 side was at a relatively higher position, the waste liquid wetting liquid 3 was out of contact with the receptacle member 26 and therefore was not absorbed by the receptacle member 26. Further, since the openings of the communication passage 37 are narrow, the volume of the waste liquid wetting liquid 3 in the communication passage 37 is relatively less than in the embodiments in which the waste liquid wetting liquid 3 flows into the bottom of the second chamber 25.

As shown in FIG. 20C, when the liquid level of the waste liquid wetting liquid 3 forming the surface layer rose to the opening of the communication passage 37 at the second chamber 25 side and then above the upper end of the upright member 35 by further introduction of the waste recording liquid 5, most of the waste liquid wetting liquid 3 was absorbed by a portion of the receptacle member 26 defining a bottom surface 38*a* of the clearance 38 facing the opening of the communication passage 37 at the second chamber 25 side (i.e., a portion of the receptacle member 26 around the opening).

With still further introduction of the waste recording liquid 5, the waste recording liquid 5 was also absorbed by the receptacle member 26. In this step, since the layer of the waste liquid wetting liquid 3 was no longer present at the surface in the opening of the communication passage 37 at the second chamber 25 side, the waste recording liquid 5 was quickly absorbed through a portion (mainly a wall portion 38*b* of the clearance 38) excluding the portion 41 in which the waste liquid wetting liquid 3 had been absorbed.

Since the communication passage 37 for communication between the first chamber 24 and the second chamber 25 has the opening at the second chamber 25 side at a higher position than the opening at the first chamber 24 side, the volume of the waste liquid wetting liquid 3 flowing into the second chamber 25 side can be reduced. Therefore, the volume of the waste liquid wetting liquid 3 remaining in the first chamber 24 side can be relatively increased. Also, since the waste liquid wetting liquid 3 is first absorbed while preventing the opening of the communication passage 37 at the second chamber 25 side from being clogged with the waste liquid wetting liquid 3, absorption of the waste recording liquid 5 is quicker compared with the sixth embodiment.

Figure 21:
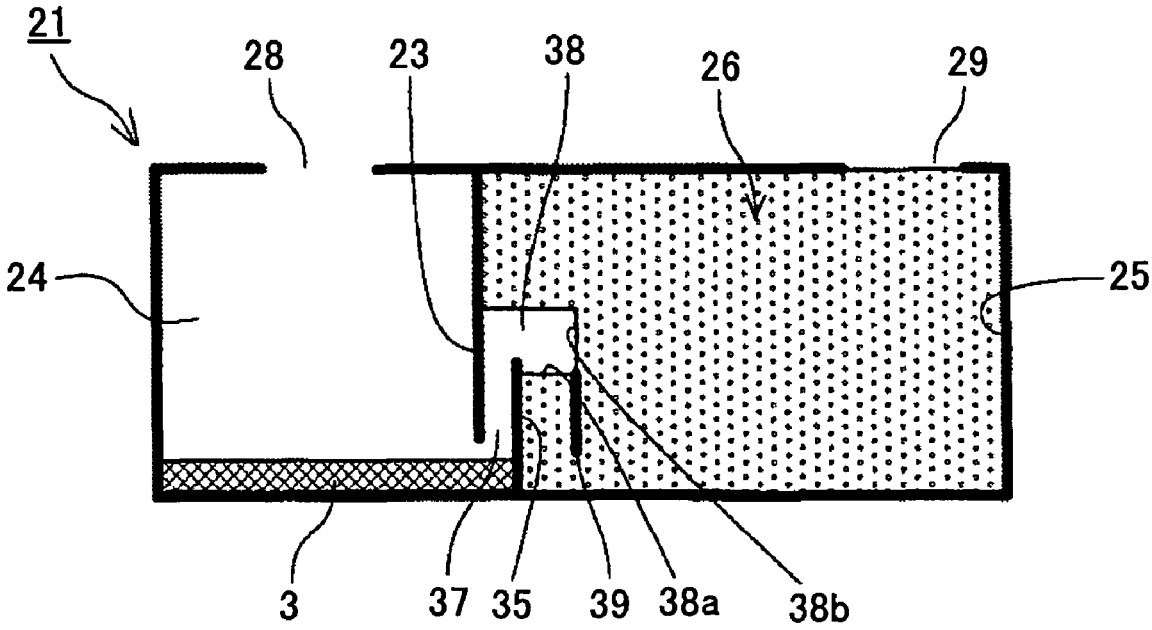
FIG. 21 is a schematic diagram showing a waste liquid tank according to an eighth embodiment of the present invention.

A waste liquid tank 21 according to an eighth embodiment of the present invention is described below with reference to FIG. 21. FIG. 21 is a schematic diagram showing the waste liquid tank 21 of this embodiment.

The waste liquid tank 21 of this embodiment is different from the waste liquid tank 21 of the seventh embodiment in that the portion under the bottom surface 38*a* of the clearance 38 defined by the receptacle member 26 is separated from the rest of the part of the receptacle member 26 by a partition wall member 39 as a diffusion limitation unit for limiting diffusion of the waste liquid wetting liquid 3.

Figure 22A:
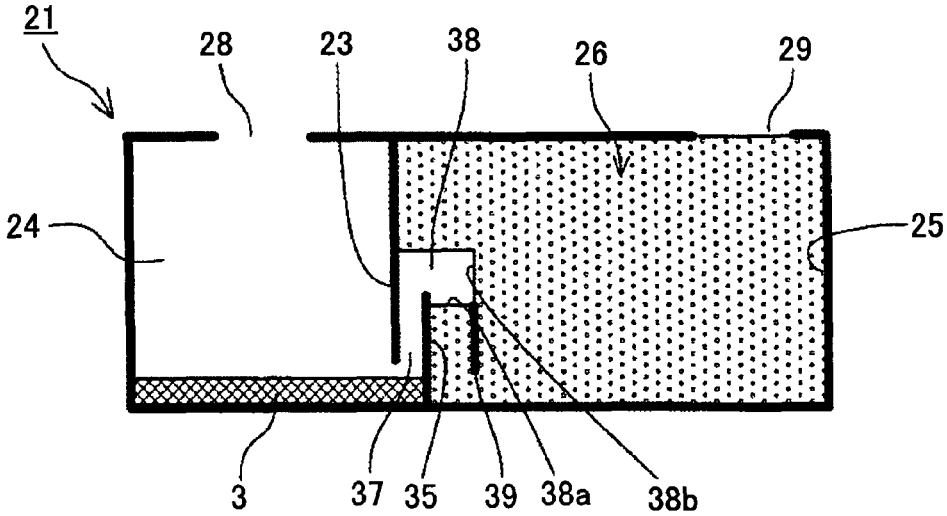
FIGS. 22A through 22C are schematic diagrams for explaining operations of the waste liquid tank of FIG. 21.
Figure 22B:
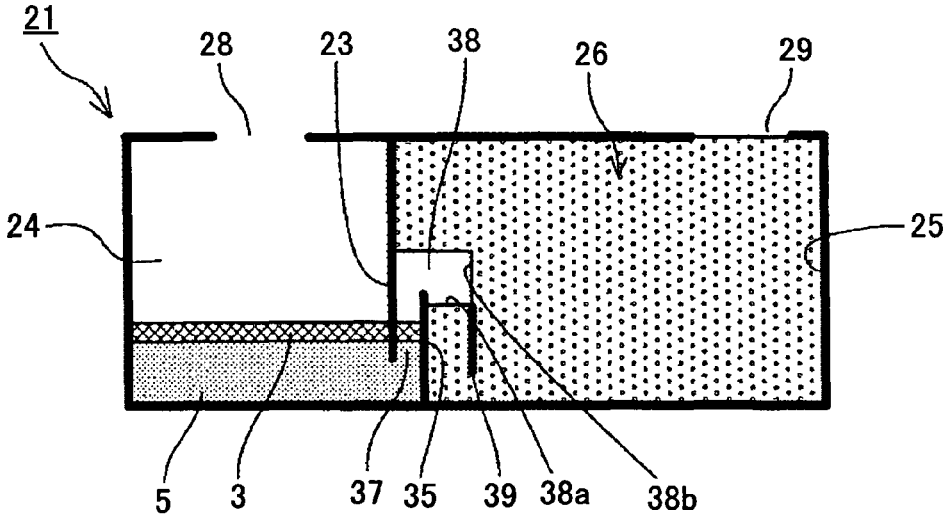
Figure 22C:
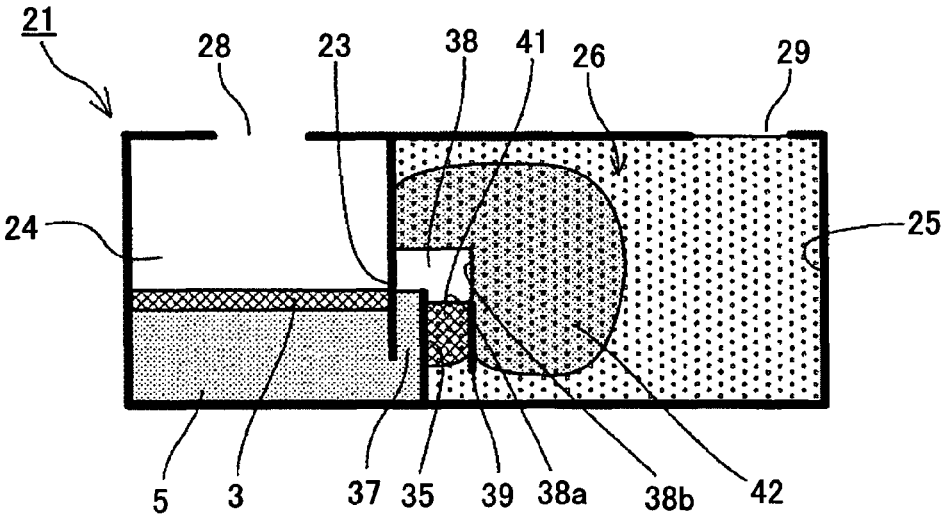

The following provides an example wherein the waste recording liquid is introduced into the waste liquid tank 21 of this embodiment with reference to FIGS. 22A through 22C.

In this example, as shown in FIG. 22A, the waste liquid wetting liquid F (20 ml: silicone oil . . . 100 parts) as the waste liquid wetting liquid 3 was placed at the first chamber 24 side of the upright member 35 in the bottom of the tank case 22 of the waste liquid tank 21. With use of the evaluation printer, evaluation recording liquid (waste recording liquid 5) of 0.2 ml was introduced into the waste liquid wetting liquid F in the waste liquid tank 21 at one minute intervals in the HL environment until the waste liquid tank 21 became full. Thus, the process of accumulation of waste liquid was observed.

Along with the introduction of the waste recording liquid 5 into the waste liquid tank 21, the liquid level of the waste liquid gradually rose while forming, as shown in FIG. 22B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. With the rise of the liquid level, the waste liquid wetting liquid 3 was separated (divided) by the partition plate 23 into the first chamber 24 side and the second chamber 25 side (the communication passage 37 side). In this step, since the opening of the communication passage 37 at the second chamber 25 side was at a relatively higher position, the waste liquid wetting liquid 3 was out of contact with the receptacle member 26 and therefore was not absorbed by the receptacle member 26. Further, since the openings of the communication passage 37 are narrow, the volume of the waste liquid wetting liquid 3 in the communication passage 37 is relatively less than in the embodiments in which the waste liquid wetting liquid 3 flows into the bottom of the second chamber 25.

As shown in FIG. 22C, when the liquid level of the waste liquid wetting liquid 3 forming the surface layer rose to the opening of the communication passage 37 at the second chamber 25 side and then above the upper end of the upright member 35 by further introduction of the waste recording liquid 5, most of the waste liquid wetting liquid 3 was absorbed by a portion of the receptacle member 26 defining the bottom surface 38*a* of the clearance 38 facing the opening of the communication passage 37 at the second chamber 25 side (i.e., a portion of the receptacle member 26 around the opening). Since the partition wall member 39 as the diffusion limitation unit that separates the portion of the receptacle member 26 under the bottom surface 38*a* of the clearance 38 from the rest of the part of the receptacle member 26, the waste liquid wetting liquid 3 was absorbed into the portion under the bottom surface 38*a* of the clearance 38 without being diffused into the rest of the part of the receptacle member 26.

With still further introduction of the waste recording liquid 5, the waste recording liquid 5 was also absorbed by the receptacle member 26. In this step, since the layer of the waste liquid wetting liquid 3 was no longer present at the surface in the opening of the communication passage 37 at the second chamber 25 side, the waste recording liquid 5 was quickly absorbed through a portion (mainly the wall portion 38*b* of the clearance 38) excluding the portion 41 in which the waste liquid wetting liquid 3 had been absorbed. Moreover, since the waste liquid wetting liquid 3 is enclosed in the portion under the bottom surface 38*a* of the clearance 38 by the partition wall member 39, the area of the receptacle member 26 capable of absorbing the waste recording liquid 5 is increased. Therefore, the waste recording liquid 5 more quickly penetrated and was absorbed into the receptacle member 26 through the wall portion 38*b* of the clearance 38.

As can be seen, the speed of absorption of the waste recording liquid 5 can be increased by providing the clearance 38 in place of providing the receptacle member 26 in the portion facing the second chamber 25 side opening of the communication passage 37 for communication between the first chamber 24 and the second chamber 25.

Figure 23:
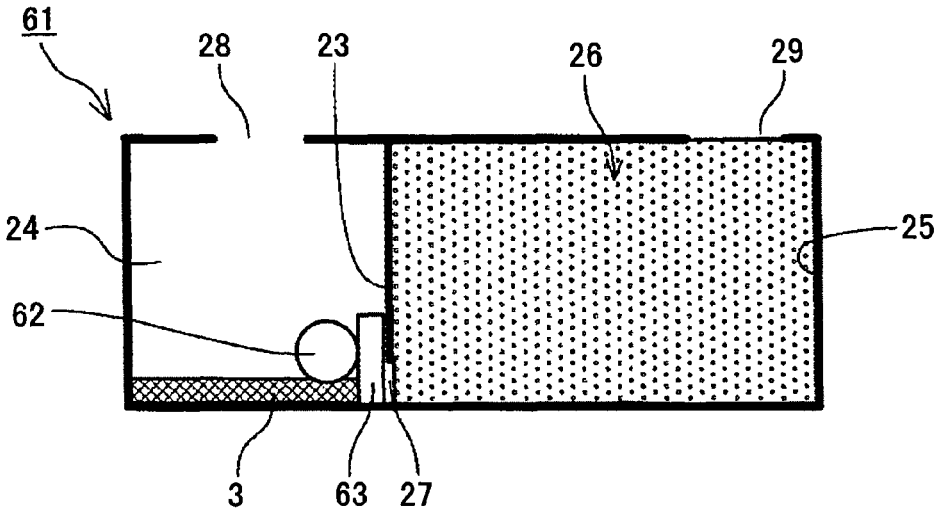
FIG. 23 is a schematic diagram showing a waste liquid tank according to a ninth embodiment of the present invention.

A waste liquid tank 61 according to a ninth embodiment of the present invention is described below with reference to FIG. 23. FIG. 23 is a schematic diagram showing the waste liquid tank 61 of this embodiment.

The waste liquid tank 61 includes a tank case 22 divided by a partition plate 23 into a first chamber 24 that receives the waste recording liquid and a second chamber 25 that accommodates a receptacle member 26 for absorbing the waste liquid. Although the receptacle member 26 of this embodiment fills in the second chamber 25 including the bottom part of the second chamber 25, the receptacle member 26 used herein may be that in the third embodiment.

The partition plate 23 is provided with a communication passage 27 (an opening in this embodiment) for communication between the first chamber 24 and the second chamber 25 at the bottom of the tank case 22. Further, as a valve unit for opening and closing the communication passage 27 depending on the height of the liquid surface, a float 62 and a valve element 63 attached to the float 62 are provided in the first chamber 24.

The waste liquid wetting liquid 3 is held in the first chamber 24. The waste liquid wetting liquid 3 has a height that maintains the float 62 such that the communication passage 27 is closed by the valve element 63 in an initial stage.

The tank case 22 has air outlets 28 and 29 at the upper side of the first chamber 24 and the second chamber 25, respectively. The air outlet 28 of the first chamber 24 serves also as an inlet for introducing the waste recording liquid.

Figure 24A:
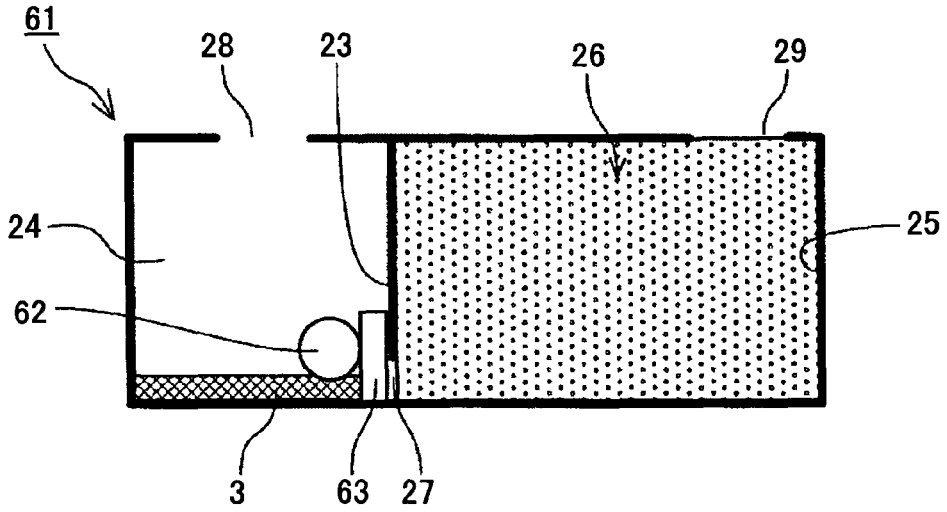
FIGS. 24A and 24B are schematic diagrams for explaining operations of the waste liquid tank of FIG. 23.
Figure 24B:
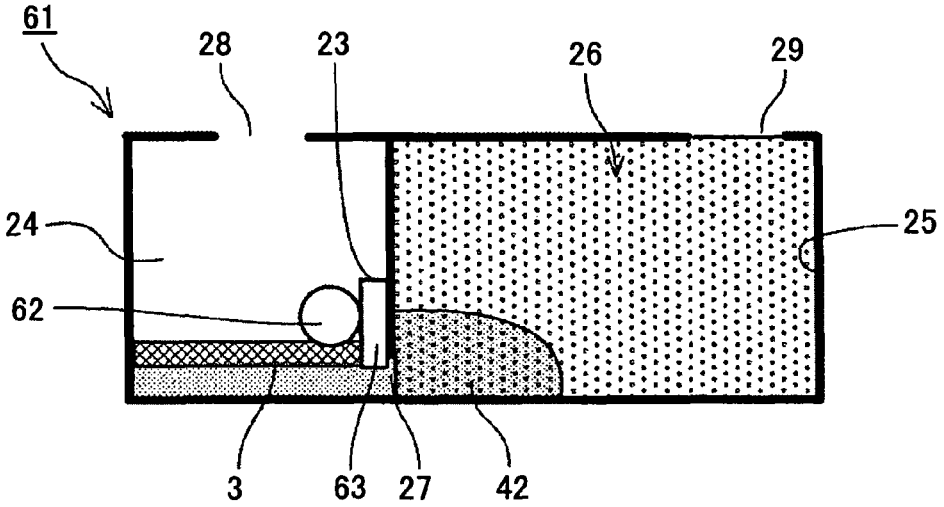

The following provides an example wherein the waste recording liquid is introduced into the waste liquid tank 61 of this embodiment with reference to FIGS. 24A and 24B.

In this example, as shown in FIG. 24A, the waste liquid wetting liquid F (20 ml: silicone oil . . . 100 parts) as the waste liquid wetting liquid 3 was placed in the bottom of the tank case 22 of the waste liquid tank 61. With use of the evaluation printer, evaluation recording liquid (waste recording liquid 5) of 0.2 ml was introduced into the waste liquid wetting liquid F in the waste liquid tank 61 at one minute intervals in the HL environment until the waste liquid tank 61 became full. Thus, the process of accumulation of waste liquid was observed.

In the initial state of the waste liquid tank 61, as shown in FIG. 24A, as the communication passage 27 was closed by the valve element 63, the waste liquid wetting liquid 3 was held only in the bottom of the first chamber 24.

Along with the introduction of the waste recording liquid 5 into the waste liquid tank 61, the liquid level of the waste liquid gradually rose. As shown in FIG. 24B, when the waste recording liquid 5 was accumulated to reach a predetermined volume, the float 62 floating on the waste liquid caused the valve element 63 to open the communication passage 27. Thus, the waste recording liquid 5 in the first chamber 24 flowed into the second chamber 25 through the communication passage 27, and was absorbed by the receptacle member 26.

Meanwhile, the waste liquid wetting liquid 3 in the first chamber 24 was held in the first chamber 24 enclosed by the valve element 63 and a wall of the first chamber 24 without flowing into the second chamber 25 through the communication passage 27. Therefore, the waste liquid wetting liquid 3 was not absorbed by the receptacle member 26.

As described above, the waste liquid tank 61 includes the first chamber 24 that receives the waste recording liquid 5, the second chamber 25 that accommodates the receptacle member 26 capable of absorbing the waste liquid, the communication passage 27 for communication between the first chamber 24 and the second chamber 25, and the valve unit for opening and closing the communication passage 27 depending on the height of the liquid level of the waste liquid wetting liquid 3 in the first chamber 24. The valve unit opens the communication passage 27 while maintaining the waste liquid wetting liquid 3 in the first chamber 24. With this configuration, since the waste liquid wetting liquid 3 is held in the first chamber 24, reduction of the waste liquid wetting liquid 3 due to absorption by the receptacle member 26 can be prevented.

Figure 25:
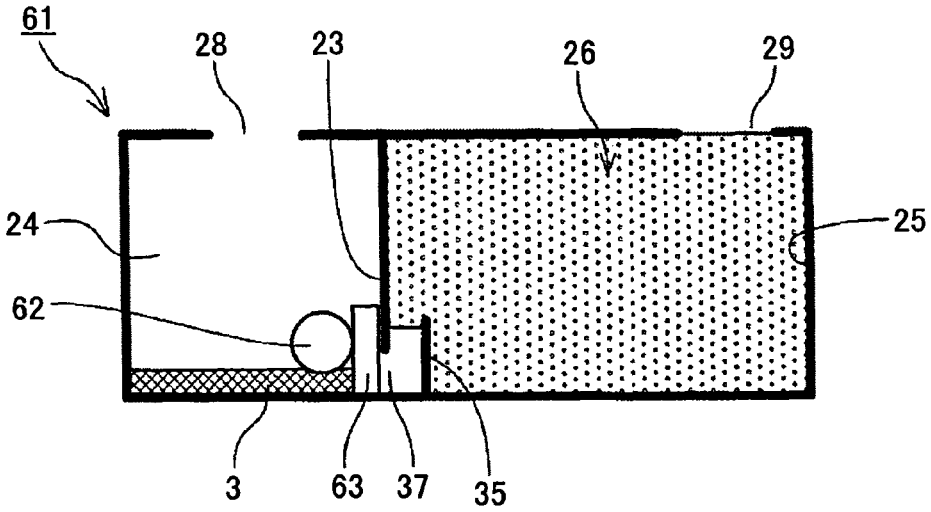
FIG. 25 is a schematic diagram showing a waste liquid tank according to a tenth embodiment of the present invention.

A waste liquid tank 61 according to a tenth embodiment of the present invention is described below with reference to FIG. 25. FIG. 25 is a schematic diagram showing the waste liquid tank 61 of this embodiment.

The waste liquid tank 61 of this embodiment is different from the waste liquid tank 61 of the ninth embodiment in that an opening in the partition plate 23 at the bottom side of the tank case 22 and an upright member 35 extending upward from the bottom surface of the tank case 22 at the second chamber 25 side are provided so as to form a communication passage 37, which establishes communication between the first chamber 24 communicates with the second chamber 25 and has an opening at the second chamber 25 side at a position higher than its opening at the first chamber 24 side.

Figure 26A:
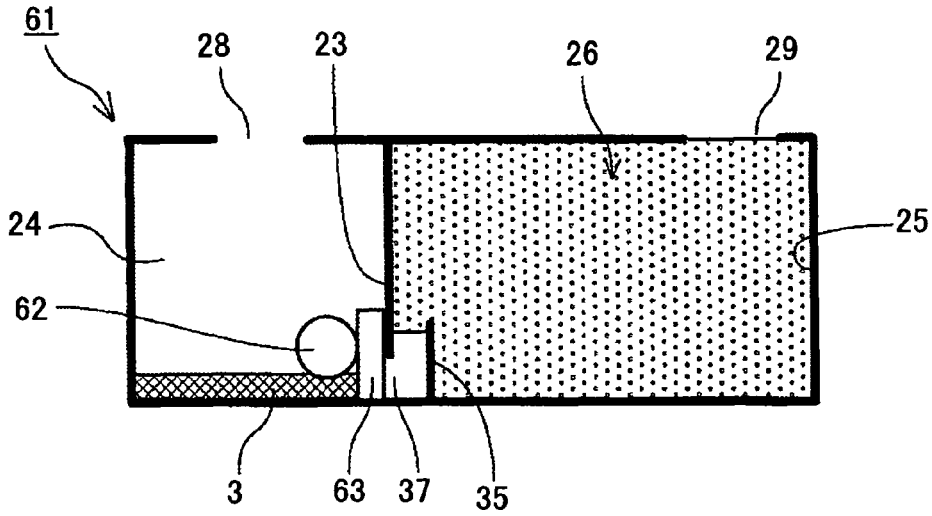
FIGS. 26A and 26B are schematic diagrams for explaining operations of the waste liquid tank of FIG. 25.
Figure 26B:
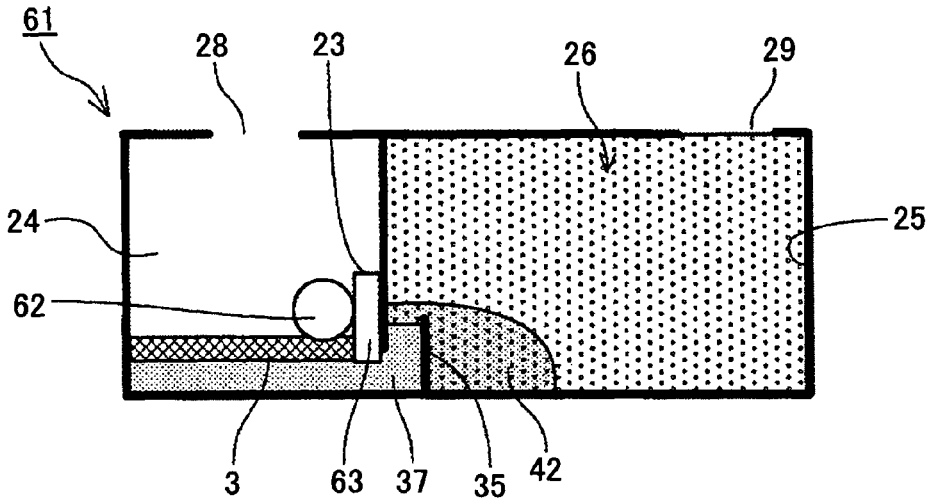

The following provides an example wherein the waste recording liquid is introduced into the waste liquid tank 61 of this embodiment with reference to FIGS. 26A and 26B.

In this example, as shown in FIG. 26A, the waste liquid wetting liquid F (20 ml: silicone oil . . . 100 parts) as the waste liquid wetting liquid 3 was placed in the bottom of the tank case 22 of the waste liquid tank 61. With use of the evaluation printer, evaluation recording liquid (waste recording liquid 5) of 0.2 ml was introduced into the waste liquid wetting liquid F in the waste liquid tank 61 at one minute intervals in the HL environment until the waste liquid tank 61 became full. Thus, the process of accumulation of waste liquid was observed.

In the initial state of the waste liquid tank 61, as shown in FIG. 26A, as the communication passage 37 was closed by the valve element 63, the waste liquid wetting liquid 3 was held only in the bottom of the first chamber 24.

Along with the introduction of the waste recording liquid 5 into the waste liquid tank 61, the liquid level of the waste liquid gradually rose. As shown in FIG. 26B, when the waste recording liquid 5 was accumulated to reach a predetermined volume, the float 62 floating on the waste liquid caused the valve element 63 to open the communication passage 37. Thus, the waste recording liquid 5 in the first chamber 24 flowed into the second chamber 25 through the communication passage 37 and was absorbed by the receptacle member 26.

Meanwhile, the waste liquid wetting liquid 3 in the first chamber 24 was held in the first chamber 24 enclosed by the valve element 63 and a wall of the first chamber 24 without flowing into the second chamber 25 through the communication passage 37. Therefore, the waste liquid wetting liquid 3 was not absorbed by the receptacle member 26. Even if the waste liquid wetting liquid 3 flowed into the communication passage 37, since the opening of the communication passage 37 at the second chamber 25 side is located in at a relatively high position, the waste liquid wetting liquid 3 is surely prevented from coming into contact with the receptacle member 26.

Figure 27:
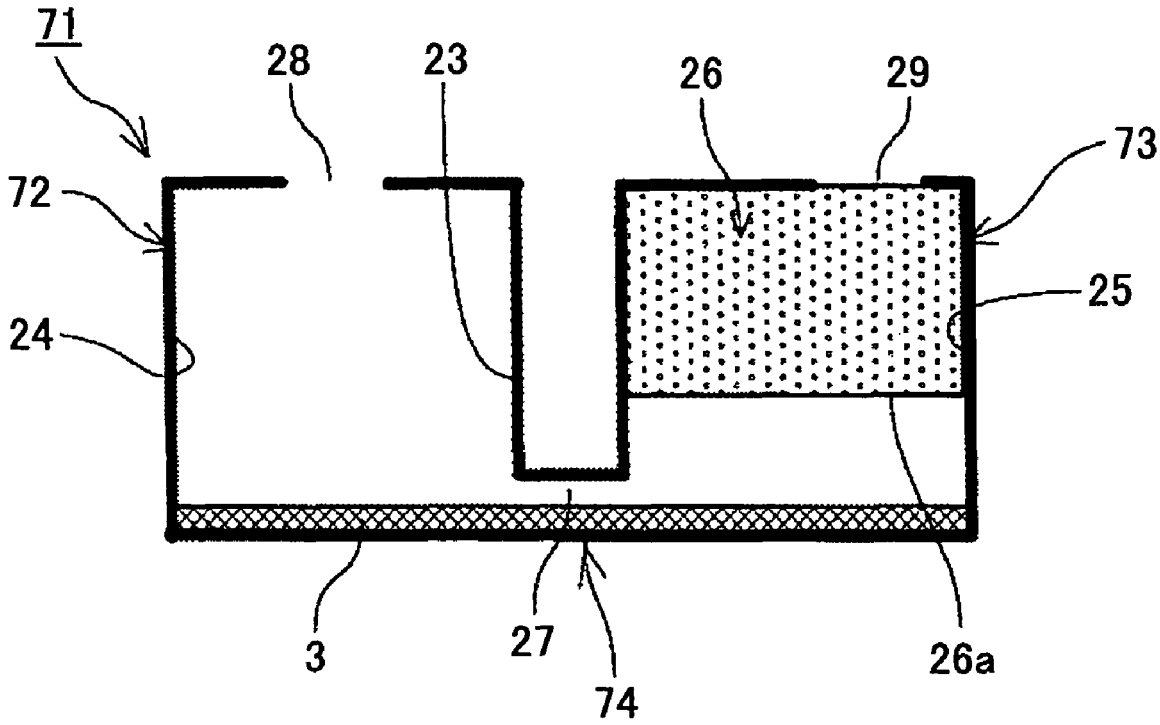
FIG. 27 is a schematic diagram showing a waste liquid tank according to an eleventh embodiment of the present invention.

A waste liquid tank 71 according to an eleventh embodiment of the present invention is described below with reference to FIG. 27. FIG. 27 is a schematic diagram showing the waste liquid tank 71 of this embodiment.

The waste liquid tank 71 includes a first unit 72 forming a first chamber 24 that receives waste recording liquid (that may be discharged or forcibly transported thereinto as mentioned above), a second unit 73 forming a second chamber 25 that accommodates a receptacle member 26 capable of absorbing waste liquid, and a communication passage section 74 forming a communication passage 27 that establishes communication between the first chamber 24 and the second chamber 25 and is formed independently from the first unit 72 and the second unit 73 or formed integrally with either the first unit 72 or the second unit 73. The first unit 72 and the second unit 73 are detachably connected to each other through the communication passage section 74.

The bottom parts of the first chamber 24 and the second chamber 25 communicate with each other through the communication passage 27. The waste liquid wetting liquid 3 is at a level lower than the height of the communication passage 27. Thus, when the liquid level of the waste liquid wetting liquid 3 rises above the communication passage 27 due to introduction of the waste recording liquid, the waste liquid wetting liquid 3 is separated into the first chamber 24 side and the second chamber 25 side. A lowermost end face 26*a* of the receptacle member 26 in the second chamber 25 of the second unit 73 is located at a position higher than the communication passage 27 of the communication passage section 74.

Air outlets 28 and 29 are formed at the upper side of the first chamber 24 and the second chamber 25, respectively. The air outlet 28 of the first chamber 24 serves also as an inlet for introducing the waste recording liquid.

The configuration of detachably connecting the first unit 72 and the second unit 73 through the communication passage section 74 is described below.

Since the waste liquid tank 71 comprises these separable components, freedom in layout of the waste liquid tank 71 is increased. Also, it is possible to replace only the second unit 73 when the receptacle member 26 in the second unit 73 becomes full.

Figure 28A:
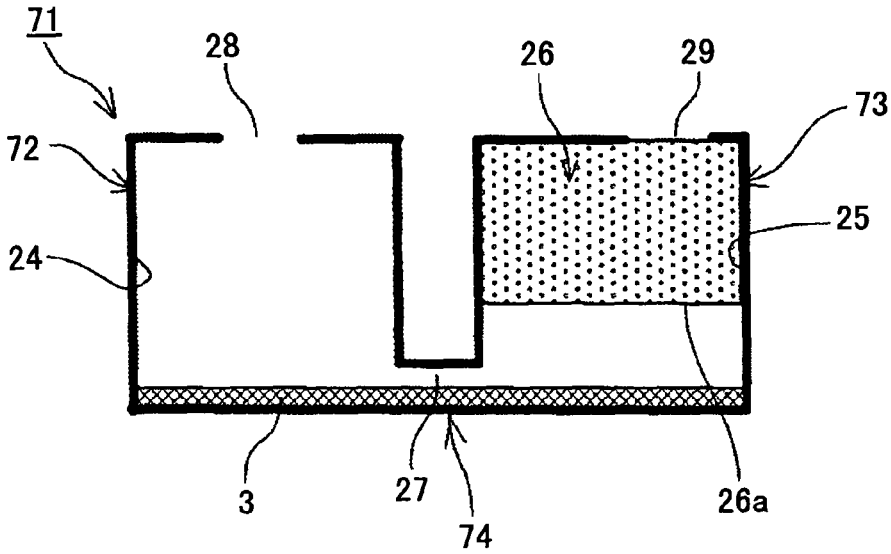
FIGS. 28A through 28C are schematic diagrams for explaining operations of the waste liquid tank of FIG. 27.
Figure 28B:
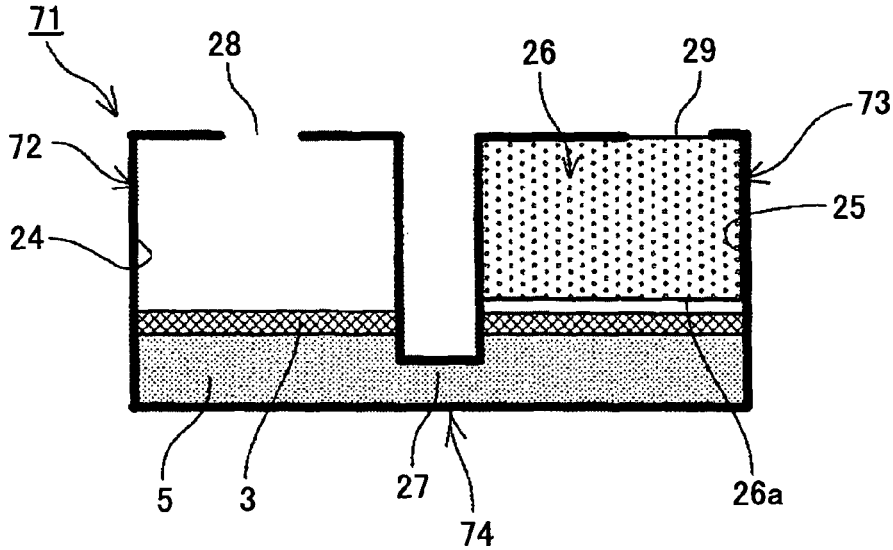
Figure 28C:
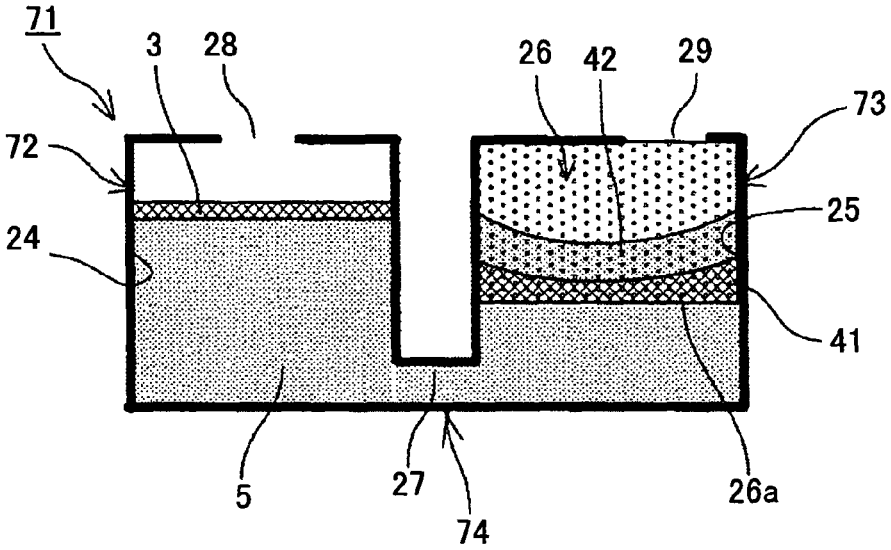

The following provides an example wherein the waste recording liquid is introduced into the waste liquid tank 71 of this embodiment with reference to FIGS. 28A through 28C.

In this example, as shown in FIG. 28A, the waste liquid wetting liquid F (20 ml: silicone oil . . . 100 parts) as the waste liquid wetting liquid 3 was placed in the bottom of the waste liquid tank 71. With use of the evaluation printer, evaluation recording liquid (waste recording liquid 5) of 0.2 ml was introduced into the waste liquid wetting liquid F in the waste liquid tank 71 at one minute intervals in the HL environment until the waste liquid tank 71 became full. Thus, the process of accumulation of waste liquid was observed.

Along with the introduction of the waste recording liquid 5 into the first chamber 24 of the waste liquid tank 71, the liquid level of the waste liquid gradually rose while forming, as shown in FIG. 28B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. When the communication passage 27 became full of the waste recording liquid 5, the waste liquid wetting liquid 3 was separated (divided) into the first chamber 24 side and the second chamber 25 side. In this step, since the lowermost end face 26*a* of the receptacle member 26 in the second chamber 25 is located above the communication passage 27, the waste liquid wetting liquid 3 was out of contact with the receptacle member 26 and therefore was not absorbed by the receptacle member 26.

As shown in FIG. 28C, the liquid level of the waste liquid wetting liquid 3 forming the surface layer further rose by subsequent introduction of the waste recording liquid 5, so that the waste liquid wetting liquid 3 was absorbed by the receptacle member 26 in the second chamber 25. With still further introduction of the waste recording liquid 5, the waste recording liquid 5 was also absorbed by the receptacle member 26.

As described above, the waste liquid tank 71 includes the first unit 72 forming the first chamber 24 that receives waste recording liquid, the second unit 73 forming the second chamber 25 that accommodates the receptacle member 26, and the communication passage section 74 forming the communication passage 27 that establishes communication between the first chamber 24 and the second chamber 25 and is formed independently from the first unit 72 and the second unit 73 or formed integrally with either the first unit 72 or the second unit 73. The first unit 72 and the second unit 73 are detachably connected to each other through the communication passage section 74. With this configuration, the freedom in the layout is increased while making it possible to store the waste recording liquid 5 without forming a buildup.

Figure 29:
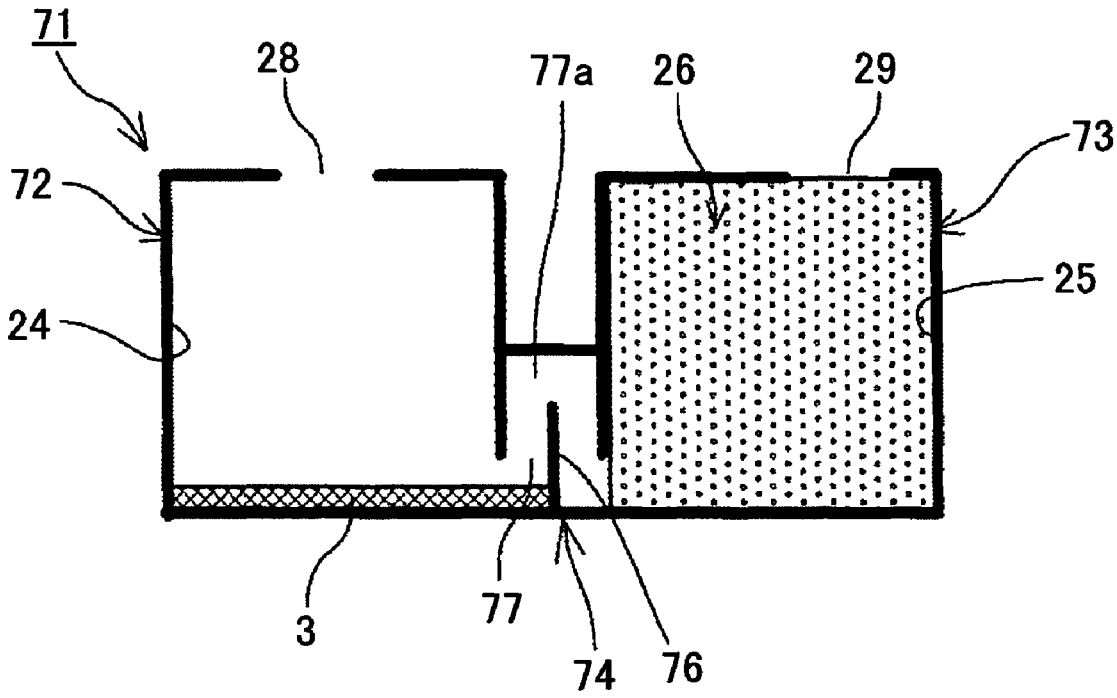
FIG. 29 is a schematic diagram showing a waste liquid tank according to a twelfth embodiment of the present invention.

A waste liquid tank 71 according to a twelfth embodiment of the present invention is described below with reference to FIG. 29. FIG. 29 is a schematic diagram showing the waste liquid tank 71 of this embodiment.

The waste liquid tank 71 of this embodiment is different from the waste liquid tank 71 of the eleventh embodiment in that a communication passage section 74 forming a communication passage 77 is provided. The communication passage 77 establishes communication between the first chamber 24 of the first unit 72 and the second chamber 25 of the second unit 73 and has a portion 77*a* in a relatively higher position than openings thereof at the first and second chamber sides. The portion 77*a* of the communication passage 77 of the communication passage section 74 is formed by providing an upright portion 76 extending upward from the bottom so as to bend the communication passage 77 in the height direction.

The waste liquid wetting liquid 3 is placed in the bottom of the first chamber 24 and in a portion of the communication passage 77 at the first chamber 24 side of the upright portion 76, and the height of the waste liquid wetting liquid 3 is lower than the height of the opening of the communication passage 77 at the first chamber 24 side.

Figure 30A:
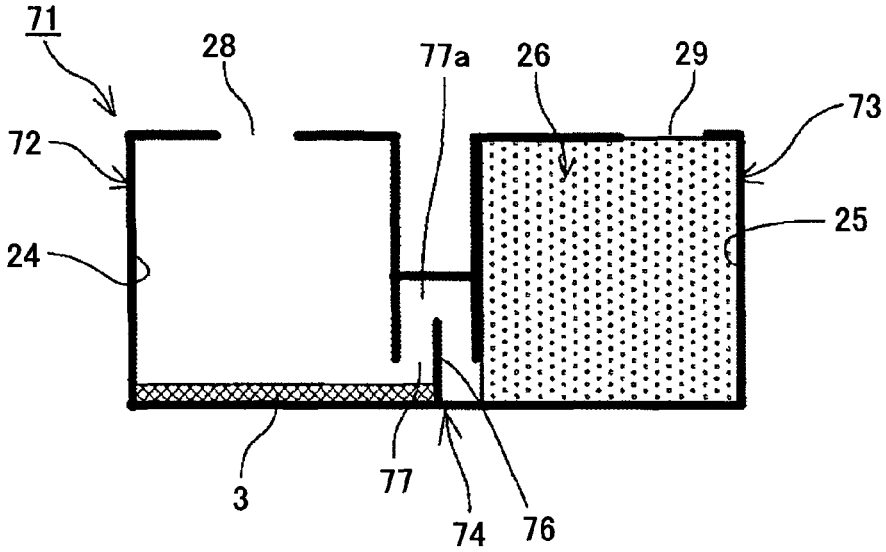
FIGS. 30A through 30C are schematic diagrams for explaining operations of the waste liquid tank of FIG. 29.
Figure 30B:
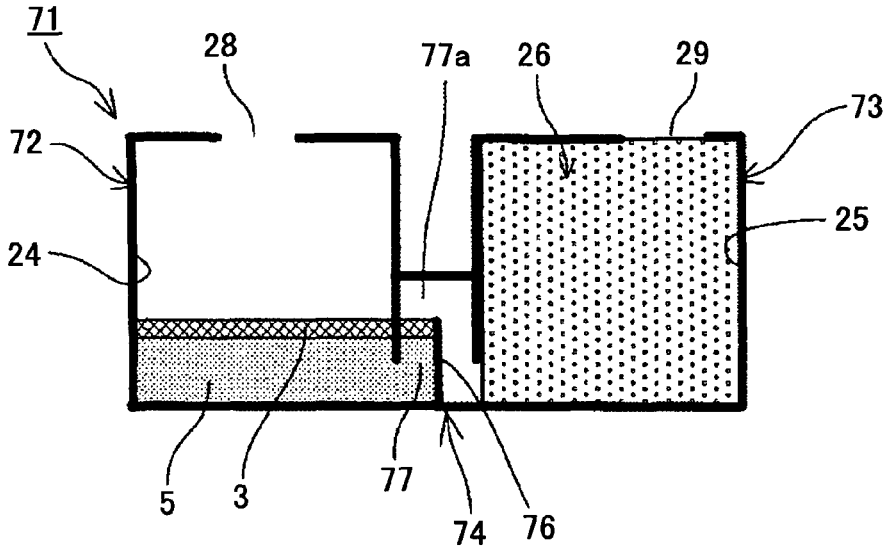
Figure 30C:
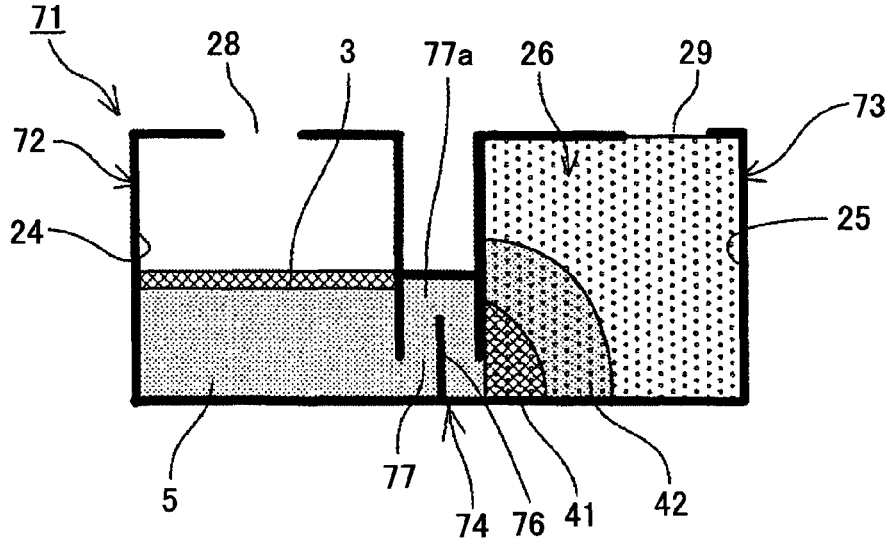

The following provides an example wherein the waste recording liquid is introduced into the waste liquid tank 71 of this embodiment with reference to FIGS. 30A through 30C.

In this example, as shown in FIG. 30A, the waste liquid wetting liquid F (20 ml: silicone oil . . . 100 parts) as the waste liquid wetting liquid 3 was placed in the first chamber 24 and in the portion of the communication passage 77 at the first chamber 24 side of the upright section 76 in the bottom of the waste liquid tank 71. With use of the evaluation printer, evaluation recording liquid (waste recording liquid 5) of 0.2 ml was introduced into the waste liquid wetting liquid F in the waste liquid tank 71 at one minute intervals in the HL environment until the waste liquid tank 71 became full. Thus, the process of accumulation of waste liquid was observed.

Along with the introduction of the waste recording liquid 5 into the first chamber 24 of the waste liquid tank 71, the liquid level of the waste liquid gradually rose while forming, as shown in FIG. 30B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. When the liquid level of the waste liquid wetting liquid 3 rose above the opening of the communication passage 77 at the first chamber 24 side, the waste liquid wetting liquid 3 was separated (divided) into the first chamber 24 side and the second chamber 25 side. It is to be noted that the communication passage 77 is narrow, and therefore the volume of the waste liquid wetting liquid 3 flowing into the communication passage 77 is very low. Accordingly, the waste liquid wetting liquid 3 is efficiently used.

As shown in FIG. 30C, the liquid level of the waste liquid further rose by subsequent introduction of the waste recording liquid 5, so that the waste liquid flowed through the portion 77*a* of the communication passage 77 into the second chamber 25, in which the waste liquid wetting liquid 3 was absorbed by the receptacle member 26. With still further introduction of the waste recording liquid 5, the waste recording liquid 5 was also absorbed by the receptacle member 26.

Figure 31:
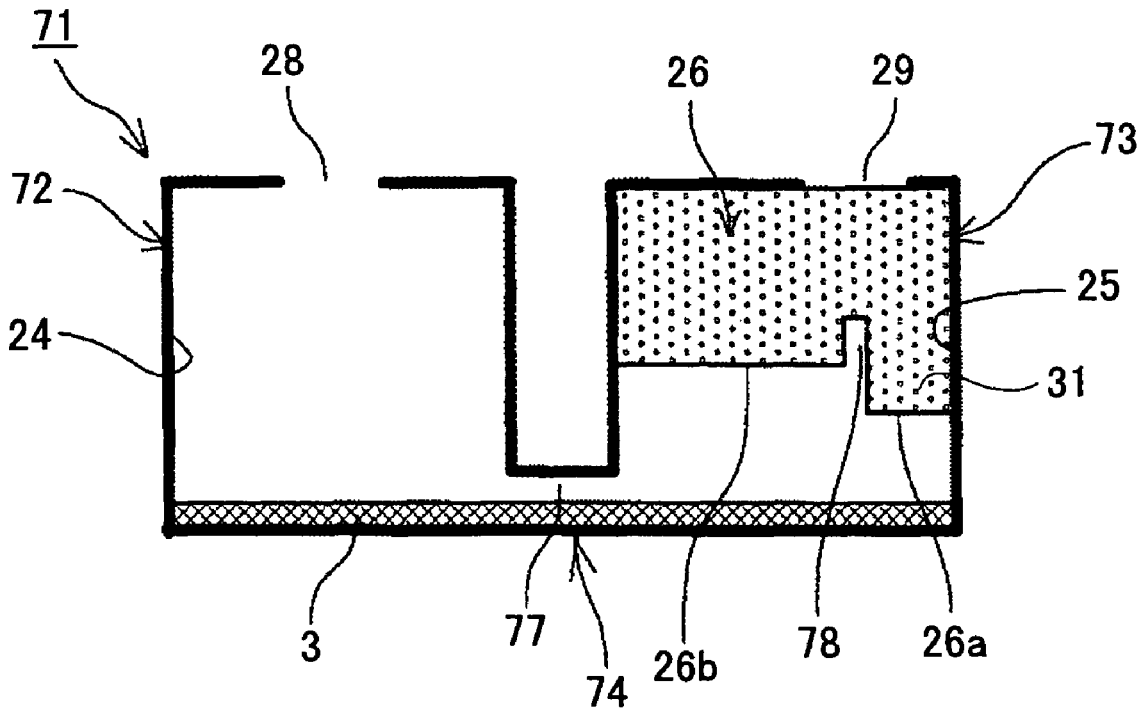
FIG. 31 is a schematic diagram showing a waste liquid tank according to a thirteenth embodiment of the present invention.

A waste liquid tank 71 according to a thirteenth embodiment of the present invention is described below with reference to FIG. 31. FIG. 31 is a schematic diagram showing the waste liquid tank 71 of this embodiment.

The waste liquid tank 71 is different from the waste liquid tank 71 of the twelfth embodiment in that the lowermost end face 26*a* of the receptacle member 26 is defined by a lower face of a projection 31 projecting from a lower end face 26*b* of the receptacle member 26. Further, a cut 78 as a diffusion limitation unit for limiting diffusion of the absorbed waste liquid wetting liquid 3 is provided at least partly around the projection 31.

Figure 32A:
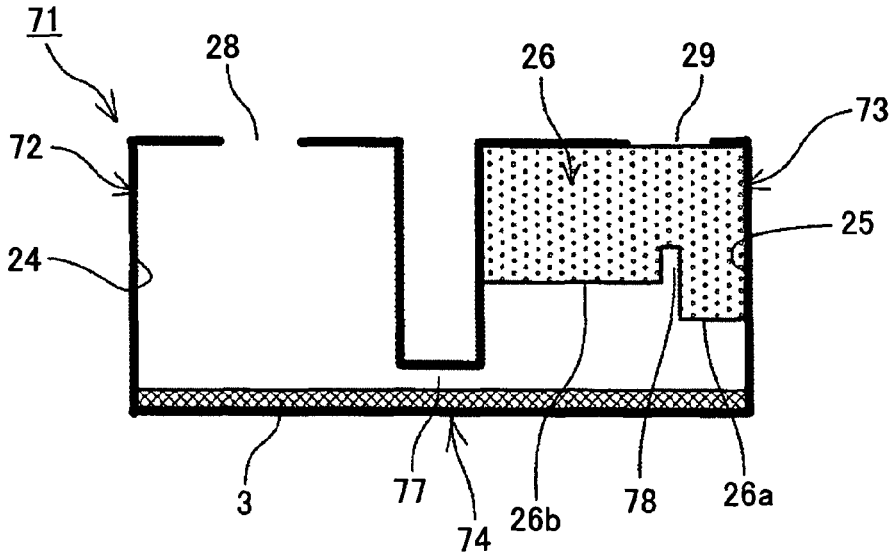
FIGS. 32A through 32C are schematic diagrams for explaining operations of the waste liquid tank of FIG. 31.
Figure 32B:
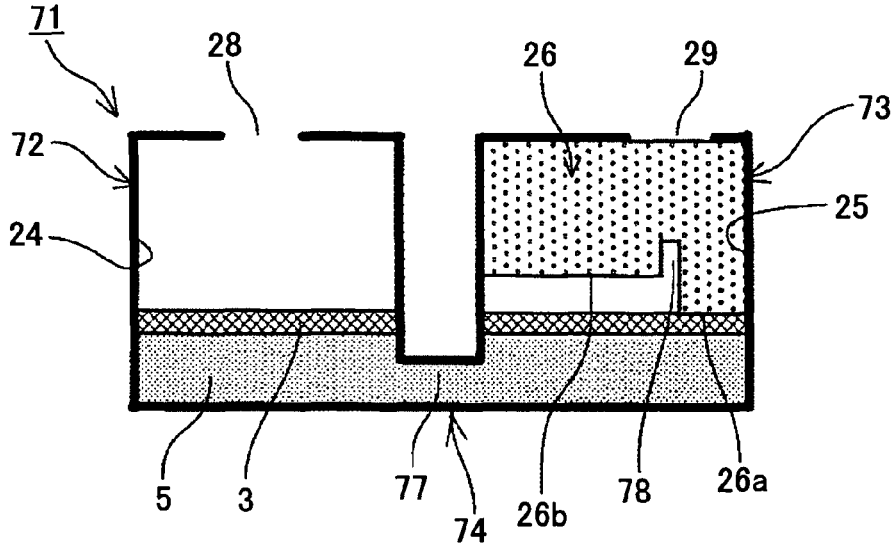
Figure 32C:
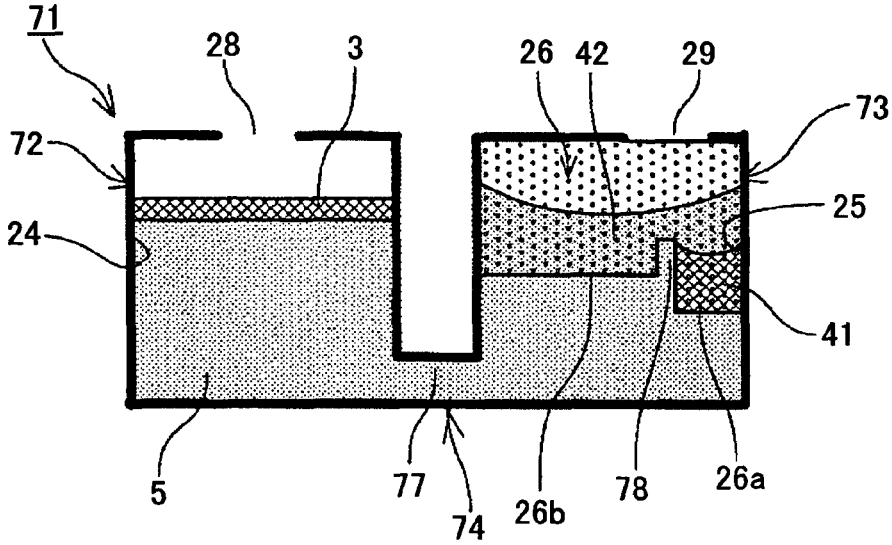

The following provides an example wherein the waste recording liquid is introduced into the waste liquid tank 71 of this embodiment with reference to FIGS. 32A through 32C.

In this example, as shown in FIG. 32A, the waste liquid wetting liquid F (20 ml: silicone oil . . . 100 parts) as the waste liquid wetting liquid 3 was placed in the bottom of the waste liquid tank 71. With use of the evaluation printer, evaluation recording liquid (waste recording liquid 5) of 0.2 ml was introduced into the waste liquid wetting liquid F in the waste liquid tank 71 at one minute intervals in the HL environment until the waste liquid tank 71 became full. Thus, the process of accumulation of waste liquid was observed.

Along with the introduction of the waste recording liquid 5 into the first chamber 24 of the waste liquid tank 71, the liquid level of the waste liquid gradually rose while forming, as shown in FIG. 32B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. When the communication passage 77 became full of the waste recording liquid 5 due to rise of the liquid level, the waste liquid wetting liquid 3 was separated (divided) into the first chamber 24 side and the second chamber 25 side by the communication passage 77. In this step, since the lowermost end face 26*a*, which is defined by the projection 31, of the receptacle member 26 in the second chamber 25 is located above the communication passage 77, the waste liquid wetting liquid 3 was out of contact with the receptacle member 26 and therefore was not absorbed by the receptacle member 26.

When the liquid level of the waste liquid wetting liquid 3 forming the surface layer further rose by subsequent introduction of the waste recording liquid 5, the waste liquid wetting liquid 3 in the second chamber 25 came into contact with the lowermost end face 26*a* of the receptacle member 26 defined by the projection 31 so as to be absorbed by the receptacle member 26. In this step, since the waste liquid wetting liquid 3 was present at the surface, most of the waste liquid wetting liquid 3 in the second chamber 25 was absorbed locally into the projection 31 of the receptacle member 26 and the vicinity thereof (a portion indicated by the reference numeral 41). Since the cut 78 as the diffusion limitation unit is provided around the projection 31 of the receptacle member 26, diffusion of the absorbed waste liquid is limited to the projection 31 (the portion 41).

With still further introduction of the waste recording liquid 5, as shown in FIG. 32C, the waste recording liquid 5 was also absorbed by the receptacle member 26. In this step, since the layer of the waste liquid wetting liquid 3 was no longer present at the surface, the waste recording liquid 5 was quickly absorbed into a portion excluding the portion 41 in which the waste recording liquid 5 had been absorbed.

As described above, the lowermost end face 26*a* of the receptacle member 26 is defined by the lower face of the projection 31 projecting from the lower end face 26*b* of the receptacle member 26. Further, the cut 78 (or a clearance) as the diffusion limitation unit for limiting the diffusion of the waste liquid wetting liquid 3 contained in the waste liquid is provided at least partly around the projection 31. With this configuration, the area of the lower end face 26*b* of the receptacle member 26 that is out of contact with organic solvent is increased, so that the waste recording liquid 5 quickly penetrates and is absorbed into the receptacle member 26.

Figure 33:
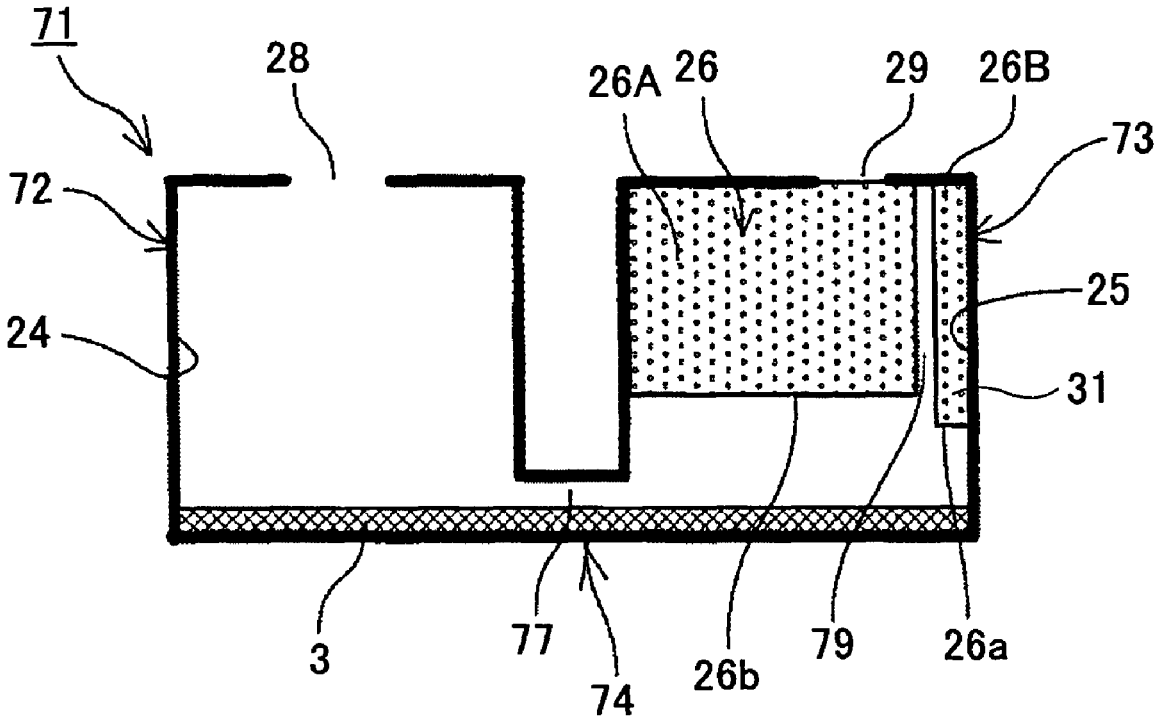
FIG. 33 is a schematic diagram showing a waste liquid tank according to a fourteenth embodiment of the present invention.

A waste liquid tank 71 according to a fourteenth embodiment of the present invention is described below with reference to FIG. 33. FIG. 33 is a schematic diagram showing the waste liquid tank 71 of this embodiment.

The waste liquid tank 71 of this embodiment is different from the waste liquid tank 71 of the thirteenth embodiment in that a cut 79 is formed for dividing the receptacle member 26 into a second portion 26B forming a projection 31 and a first portion 26A forming the rest of the part of the receptacle member 26. The cut 79 serves as a diffusion limitation unit for preventing the waste liquid wetting liquid 3 from diffusing out of the second portion 26B. A lower end face 26*a* of the second portion 26B is located at a position lower than a lower end face 26*b* of the first portion 26A. That is, the lower end face 26*a* defines the lowermost end face of the receptacle member 26.

Figure 34A:
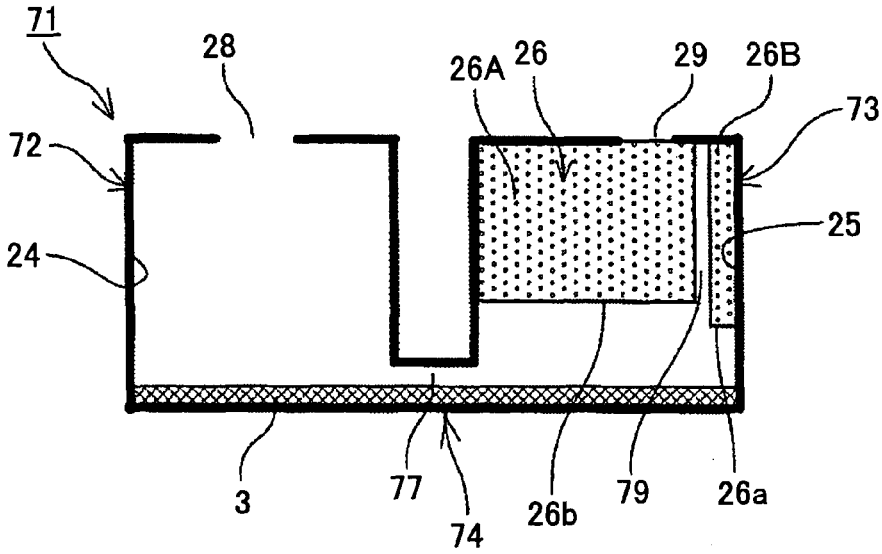
FIGS. 34A through 34C are schematic diagrams for explaining operations of the waste liquid tank of FIG. 33.
Figure 34B:
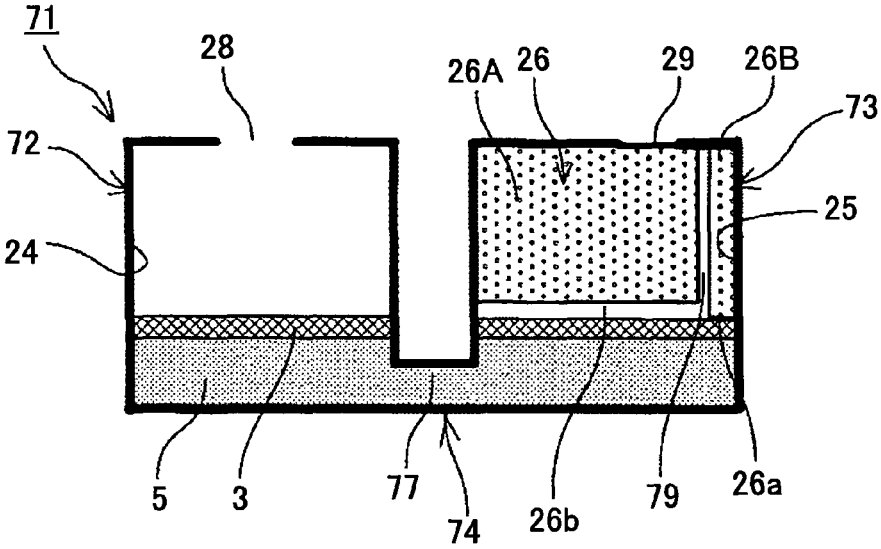
Figure 34C:
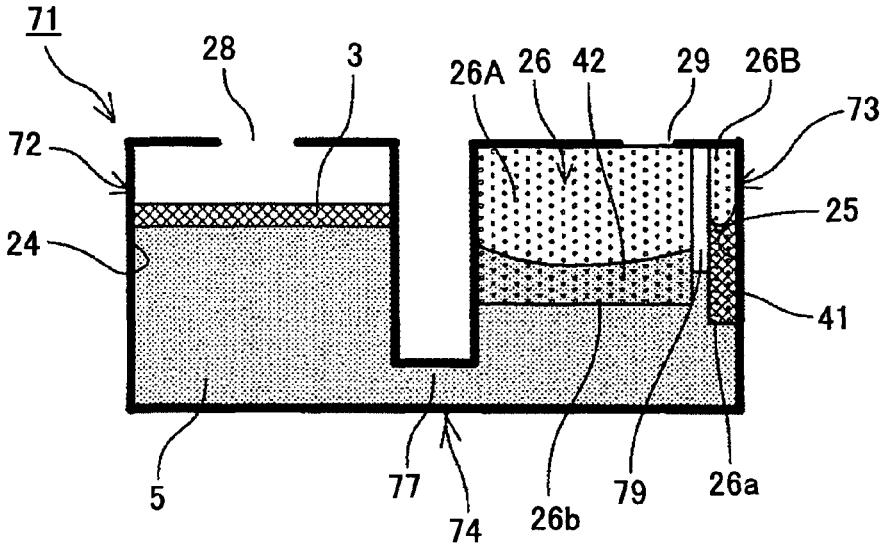

The following provides an example wherein the waste recording liquid is introduced into the waste liquid tank 71 of this embodiment with reference to FIGS. 34A through 34C.

In this example, as shown in FIG. 34A, the waste liquid wetting liquid F (20 ml: silicone oil . . . 100 parts) as the waste liquid wetting liquid 3 was placed in the bottom of the waste liquid tank 71. With use of the evaluation printer, evaluation recording liquid (waste recording liquid 5) of 0.2 ml was introduced into the waste liquid wetting liquid F in the waste liquid tank 71 at one minute intervals in the HL environment until the waste liquid tank 71 became full. Thus, the process of accumulation of waste liquid was observed.

Along with the introduction of the waste recording liquid 5 into the first chamber 24 of the waste liquid tank 71, the liquid level of the waste liquid gradually rose while forming, as shown in FIG. 32B, two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. When the communication passage 77 became full of the waste recording liquid 5 due to rise of the liquid surface, the waste liquid wetting liquid 3 was separated (divided) into the first chamber 24 side and the second chamber 25 side by the communication passage 77. In this step, since the lowermost end face 26*a* of the second portion 26B of the receptacle member 26 in the second chamber 25 is located above the communication passage 77, the waste liquid wetting liquid 3 was out of contact with the second portion 26B of the receptacle member 26 and therefore was not absorbed by the receptacle member 26.

When the liquid level of the waste liquid wetting liquid 3 forming the surface layer further rose by subsequent introduction of the waste recording liquid 5, the waste liquid wetting liquid 3 in the second chamber 25 came into contact with the lowermost end face 26*a* of the second portion 26B of the receptacle member 26 so as to be absorbed by the receptacle member 26. In this step, since the waste liquid wetting liquid 3 was present at the surface, most of the waste liquid wetting liquid 3 in the second chamber 25 was absorbed locally into the second portion 26B of the receptacle member 26. Since the receptacle member 26 is divided by the cut 79 as a diffusion limitation unit into the first portion 26A and the second portion 26B, the absorbed waste liquid wetting liquid 3 was held in the second portion 26B.

With still further introduction of the waste recording liquid 5, as shown in FIG. 34C, the waste recording liquid 5 came into contact with the lower end face 26*b* of the first portion 26A of the receptacle member 26 so as to be absorbed by the receptacle member 26. In this step, since the layer of the waste liquid wetting liquid 3 was no longer present at the surface, the waste recording liquid 5 quickly penetrated into the first portion 26A of the receptacle member 26.

As described above, the lower end face 26*a* of the second portion 26B defines the lowermost end face of the receptacle member 26. Further, the cut 79 is formed for dividing the receptacle member 26 into the second portion 26B forming the projection 31 and the first portion 26A forming the rest of the part of the receptacle member 26, and thereby preventing the waste liquid wetting liquid 3 from diffusing out of the second portion 26B. With this configuration, the area of the lower end face of the receptacle member 26 that is out of contact with organic solvent is increased, so that the waste recording liquid 5 quickly penetrates and is absorbed into the receptacle member 26.

Figure 35A:
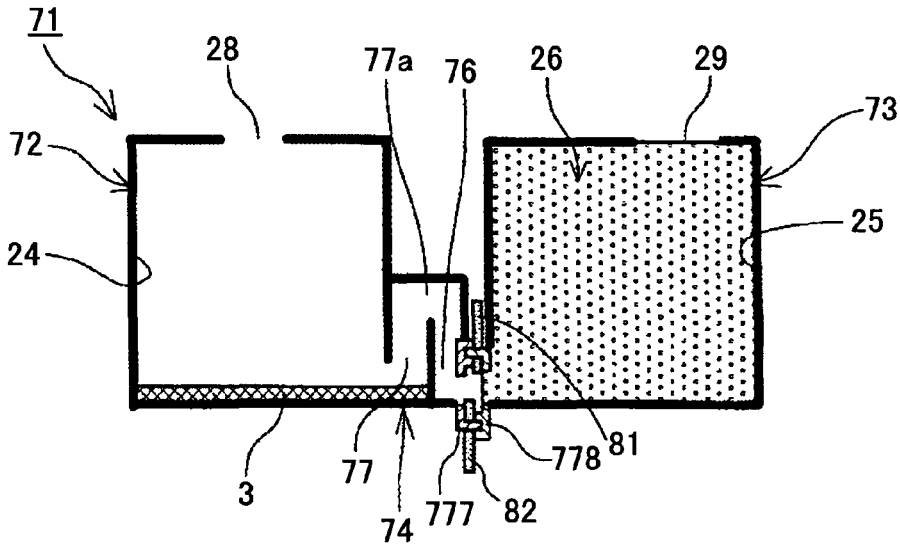
FIGS. 35A through 35C are schematic diagrams for explaining the process of separating a first unit and a second unit of a waste liquid tank from each other.
Figure 35B:
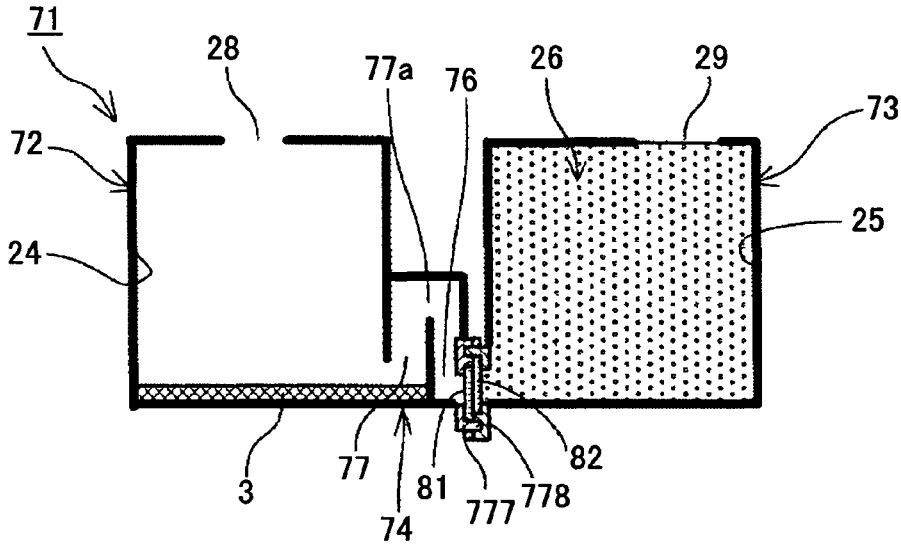
Figure 35C:
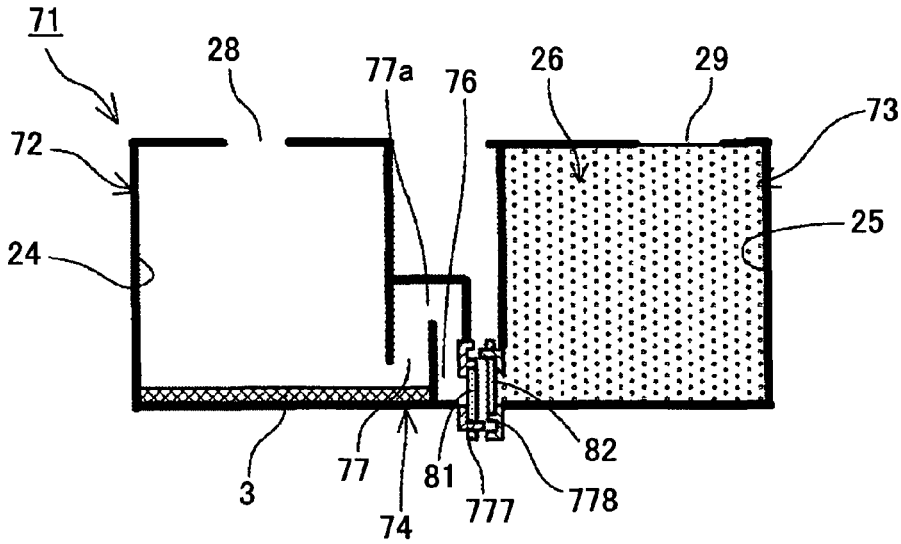
Figure 36A:
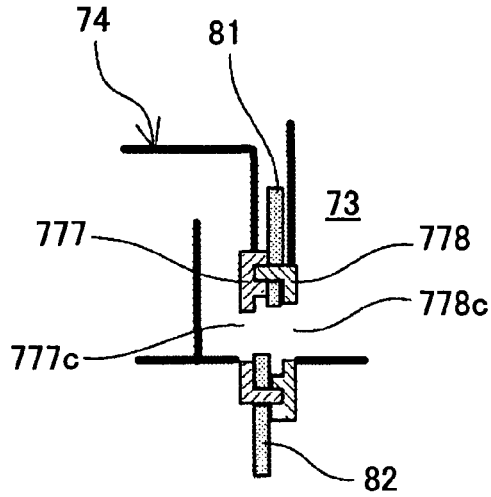
FIGS. 36A through 36C are enlarged views each showing joint portions of the liquid waste liquid tank of FIGS. 36A through 36C.
Figure 36B:
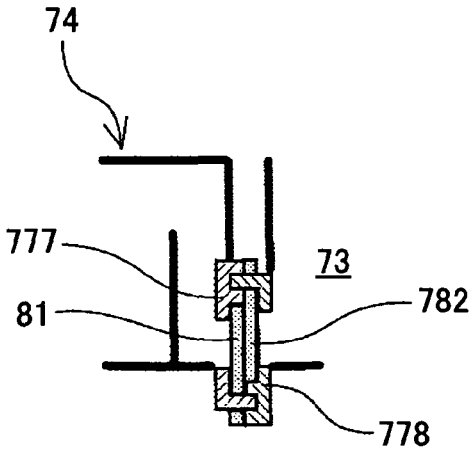
Figure 36C:
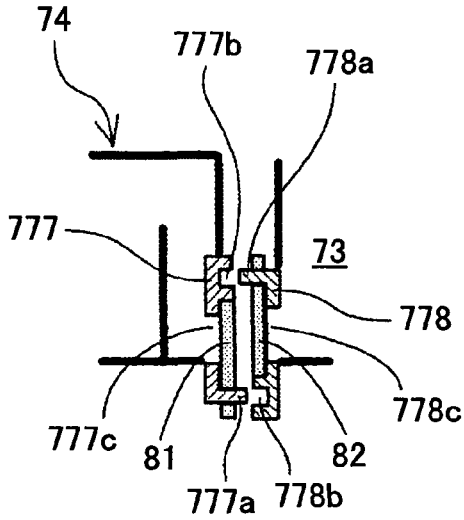

The following describes an exemplary configuration for detachably connecting the first unit 72 and the second unit 73 of the waste liquid tank 71 with each other with reference to FIGS. 35A through 35C and FIGS. 36A through 36C. FIGS. 35A through 35C are schematic diagrams for explaining the process of separating the first unit 72 and the second unit 73 of the waste liquid tank 71 from each other. FIGS. 36A through 36C are enlarged views each showing a part of the liquid waste liquid tank 71.

In this example, the first unit 72 is integral with the communication passage section 74, while the second unit 73 is detachably connectable to the communication passage section 74.

As best shown in FIG. 36C, the communication passage section 74 and the second unit 73 are provided with coupling portions (joint portions) 777 and 778, respectively. The coupling portions 777 and 778 have projections 777*a* and 778*a*, recesses 777*b* and 778*b* detachably fitted to the projections 778*a* and the 777*a*, and openings 777*c* and 778*c*, respectively. The coupling portion 777 of the communication passage section 74 is provided with an insertable valve element 81 for opening and closing the opening 777*c*. Similarly, the coupling portion 778 of the second unit 73 is provided with an insertable valve element 82 for opening and closing the opening 778*c*. When the valve elements 81 and 82 of the coupling portions 777 and 778 are placed in inserted positions to close the openings 777*c* and 778*c*, respectively, the valve elements 81 and 82 are in tight contact with each other (FIG. 36B).

With this configuration, as shown in FIGS. 35A and 36A, when the first unit 72 (the communication passage section 74) and the second unit 73 are connected to each other, the projections 777*a* and 778*a* are fitted and connected to the recesses 778*b* and 777*b* of the coupling portions 77 and 78, respectively. The valve elements 81 and 82 are pulled out to open the openings 77*c* and 78*c*, respectively, so that the first unit 72 and the second unit 73 are connected to each other through the communication passage section 74.

In the case of detaching the second unit 73 from the first unit 72 to replace it with a new second unit 73, as shown in FIGS. 35B and 36B, the valve element 81 of the coupling portion 777 at the first unit 72 side (the communication passage section 74 side) and the valve element 82 of the coupling portion 778 of the second unit 73 are pulled in so as to close the openings 777*c* and 778*c*, respectively. In this step, as mentioned above, the valve elements 81 and 82 come into tight contact with each other.

Then, as shown in FIGS. 35C and 36C, the coupling portion 778 of the second unit 773 is detached from the coupling portion 777 at the first unit 72 side (communication passage section 74 side). The tight contact between the valve elements 81 and 82 prevents the waste liquid from being leaked.

After the second unit 73 is detached in this way, the new second unit 73 is coupled to the first unit 72 by performing the reverse operations described above, i.e., by coupling the coupling portion 778.*to* the coupling portion 777 (FIGS. 35B and 36B) and then pulling out the valve elements 81 and 82 to open the openings 777*c* and 778*c*, respectively (FIGS. 35A and 36A).

It is to be noted that the first unit 72 may be detachably coupled to the communication passage section 74.

Figure 37:
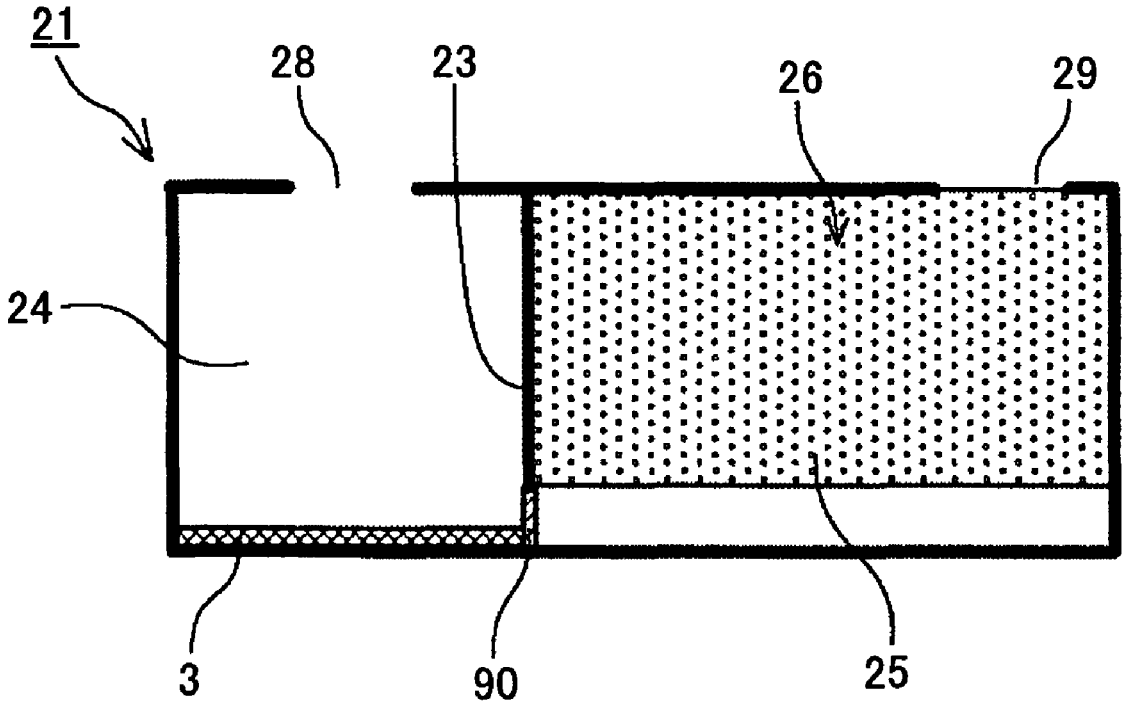
FIG. 37 is a schematic diagram showing a waste liquid tank according to a fifteenth embodiment of the present invention.

A waste liquid tank 21 according to a fifteenth embodiment of the present invention is described below with reference to FIG. 37. FIG. 37 is a schematic diagram showing the waste liquid tank 21 of this embodiment.

This waste liquid tank 21 of this embodiment is different from the waste liquid tank 21 of the third embodiment in that a member 90 is provided at the bottom of the tank case 22 (at the bottom in the waste liquid tank 21) under the partition plate 23 dividing the first chamber 24 from the second chamber 25. The member 90 is insoluble in oil and soluble in the waste recording liquid and closes a passage between the first chamber 24 and the second chamber 25.

Figure 38A:
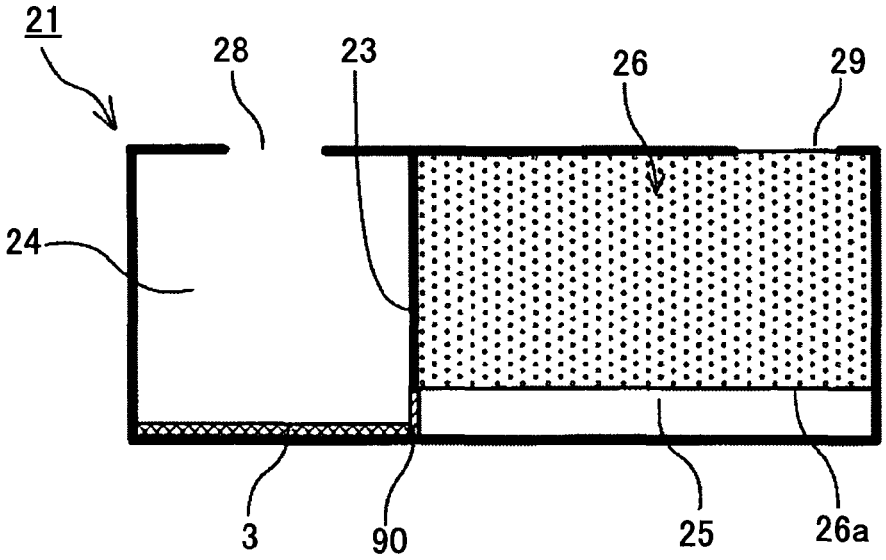
FIGS. 38A through 38C are schematic diagrams for explaining operations of the waste liquid tank of FIG. 37.
Figure 38B:
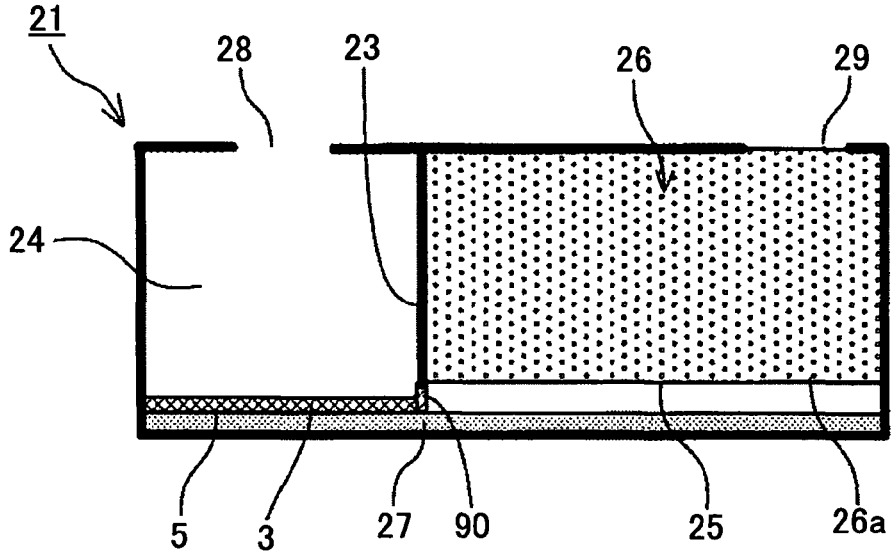
Figure 38C:
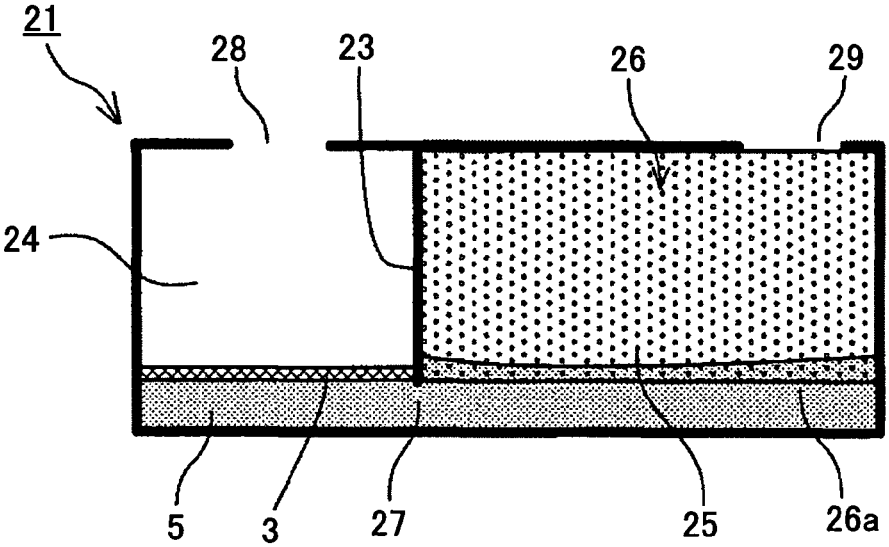

The following provides an example wherein the waste recording liquid is introduced into the waste liquid tank 21 of this embodiment with reference to FIGS. 38A through 38C.

In this example, as shown in FIG. 38A, the waste liquid wetting liquid F (20 ml: silicone oil . . . 100 parts) as the waste liquid wetting liquid 3 was placed in the bottom of the tank case 22 of the waste liquid tank 21. Since the first chamber 24 and the second chamber 25 are separated from each other by the member 90 that is insoluble in oil and soluble in the waste recording liquid, the waste liquid wetting liquid F remained in the first chamber 24.

With use of the evaluation printer, evaluation recording liquid (waste recording liquid 5) of 0.2 ml was introduced into the waste liquid wetting liquid F in the waste liquid tank 21 at one minute intervals in the HL environment until the waste liquid tank 21 became full. (In this example, the evaluation recording liquid was forcibly introduced into the waste liquid wetting liquid 3 through the waste recording liquid introduction tube 7. The same applies in the following examples if not otherwise specified.) Thus, the process of accumulation of waste liquid was observed.

When the waste recording liquid was introduced into the waste liquid tank 21, as shown in FIG. 38B, the waste liquid was separated into two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. In this step, a part of the member 90 was dissolved through contact with the waste recording liquid 5, so that the communication passage 27 was formed. Thus, a part of the waste recording liquid 5 flowed into the second chamber 25 through the communication passage 27. Meanwhile, since the waste liquid wetting liquid 3 was held on the upper side of the waste recording liquid 5, most of the waste liquid wetting liquid 3 did not flow into the second chamber 25.

As shown in FIG. 38C, the liquid level of the waste liquid wetting liquid 3 forming the surface layer further rose by subsequent introduction of the waste recording liquid 5, so that the waste liquid wetting liquid 3 was absorbed by the receptacle member 26 in the second chamber 25.

As can be seen, the waste liquid tank 21 includes the first chamber 24 that receives the waste recording liquid and the second chamber 25 that accommodates the receptacle member 26 capable of absorbing the waste liquid. Further, the member 90 insoluble in oil and soluble in the waste recording liquid is provided between the first chamber 24 and the second chamber 25 at least at the bottom in the waste liquid tank 21. With this configuration, since the waste liquid is held in the first chamber 24 side, usage of the waste liquid wetting liquid 3 can be significantly reduced.

Figure 39:
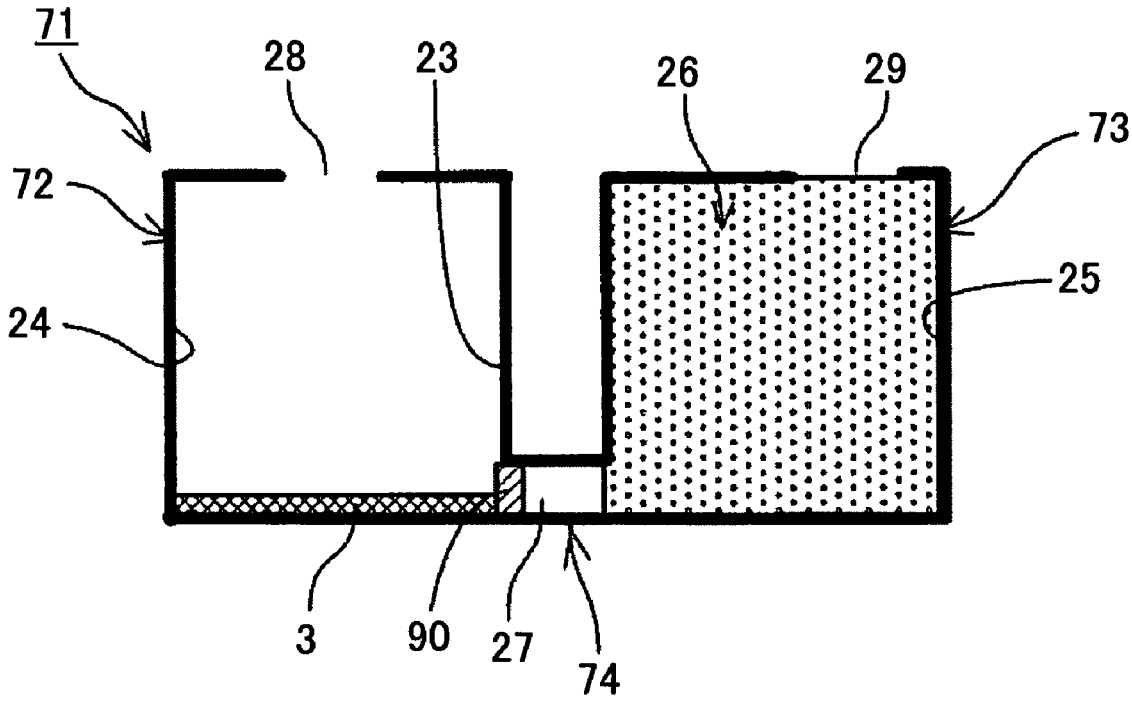
FIG. 39 is a schematic diagram showing a waste liquid tank according to a sixteenth embodiment of the present invention.

A waste liquid tank 71 according to a sixteenth embodiment of the present invention is described below with reference to FIG. 39. FIG. 39 is a schematic diagram showing the waste liquid tank 71 of this embodiment.

The waste liquid tank 71 of this embodiment is different from the waste liquid tank 71 of the eleventh embodiment in that a member 90 is provided at the first chamber 24 side of the communication passage section 74 forming the communication passage 27 for communication between the first chamber 24 and the second chamber 25. As in the case of the fifteenth embodiment, the member 90 is insoluble in oil and soluble in the waste recording liquid.

Figure 40A:
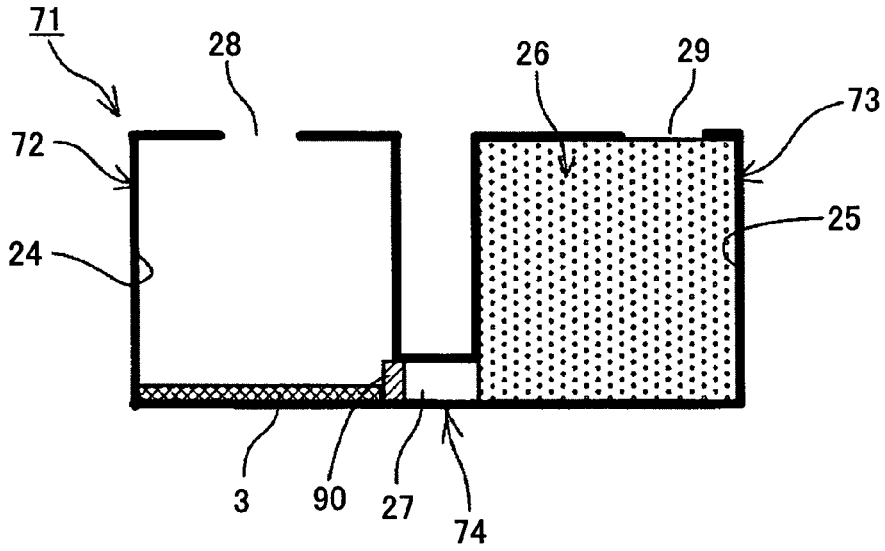
FIGS. 40A through 40C are schematic diagrams for explaining operations of the waste liquid tank of FIG. 39.
Figure 40B:
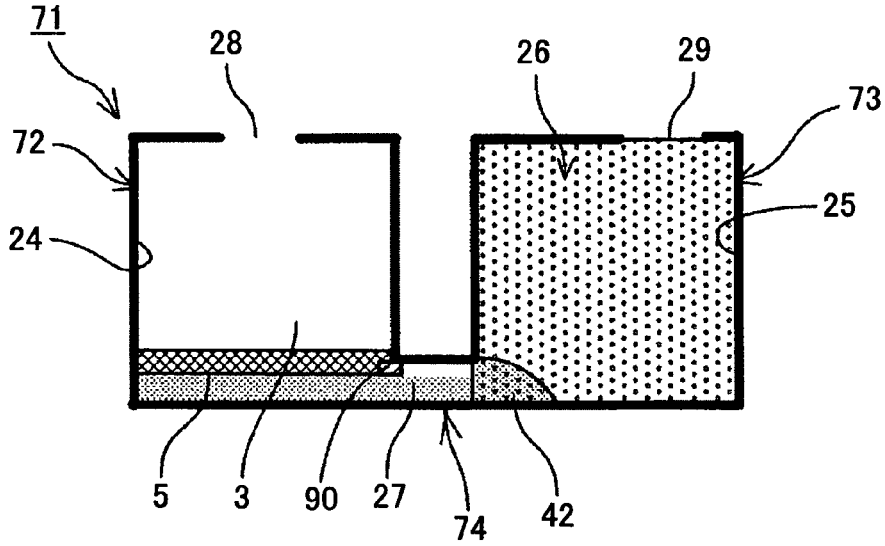
Figure 40C:
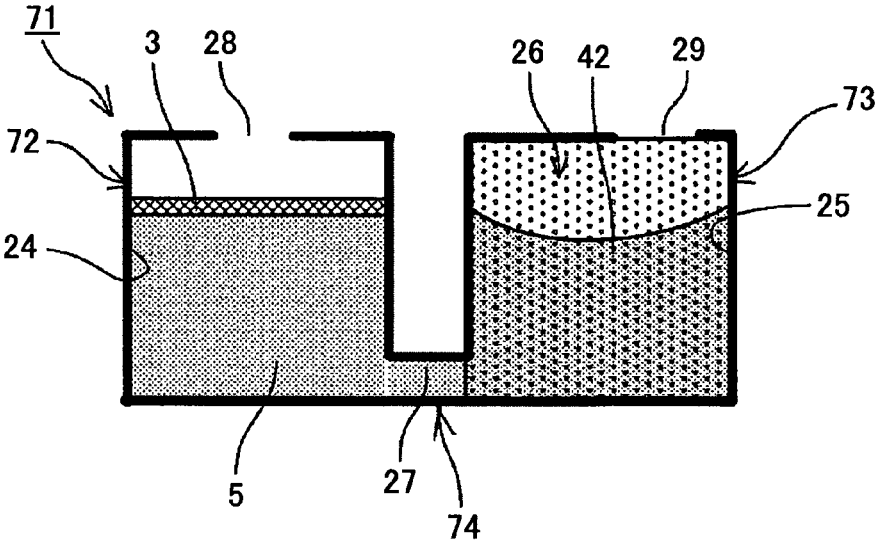

The following provides an example wherein the waste recording liquid is introduced into the waste liquid tank 21 of this embodiment with reference to FIGS. 40A through 40C.

In this example, as shown in FIG. 40A, the waste liquid wetting liquid F (20 ml: silicone oil . . . 100 parts) as the waste liquid wetting liquid 3 was placed in the bottom of the tank case 22 of the waste liquid tank 21. Since the opening of the communication passage section 74 of the first chamber 24 side is closed by the member 90 that is insoluble in oil and soluble in the waste recording liquid, the waste liquid wetting liquid F remained in the first chamber 24.

With use of the evaluation printer, evaluation recording liquid (waste recording liquid 5) of 0.2 ml was introduced into the waste liquid wetting liquid F in the waste liquid tank 71 at one minute intervals in the HL environment until the waste liquid tank 71 became full. (In this example, the evaluation recording liquid was forcibly introduced into the waste liquid wetting liquid 3 through the waste recording liquid introduction tube 7. The same applies in the following examples if not otherwise specified.) Thus, the process of accumulation of waste liquid was observed.

When the waste recording liquid was introduced into the waste liquid tank 71, as shown in FIG. 40B, the waste liquid was separated into two layers: a layer of the waste liquid wetting liquid 3 having lower specific gravity than the waste recording liquid 5 and low compatibility therewith at the surface; and a layer of the waste recording liquid 5 under the layer of the waste liquid wetting liquid 3. In this step, a part of the member 90 was dissolved through contact with the waste recording liquid 5, so that an opening to the communication passage 27 of a communication passage section 74 was formed. Thus, a part of the waste recording liquid 5 flowed into the second chamber 25, and was absorbed by the receptacle member 26. Meanwhile, since the waste liquid wetting liquid 3 was held on the upper side of the waste recording liquid 5, most of the waste liquid wetting liquid 3 did not move to the second chamber 25.

As shown in FIG. 40C, the liquid level of the waste liquid wetting liquid 3 forming the surface layer further rose by subsequent introduction of the waste recording liquid 5, so that the waste liquid wetting liquid 3 in the second chamber 25 was absorbed by the receptacle member 26.

With this configuration, as in the case of the fifteenth embodiment, usage of the waste liquid wetting liquid is significantly reduced.

Figure 41:
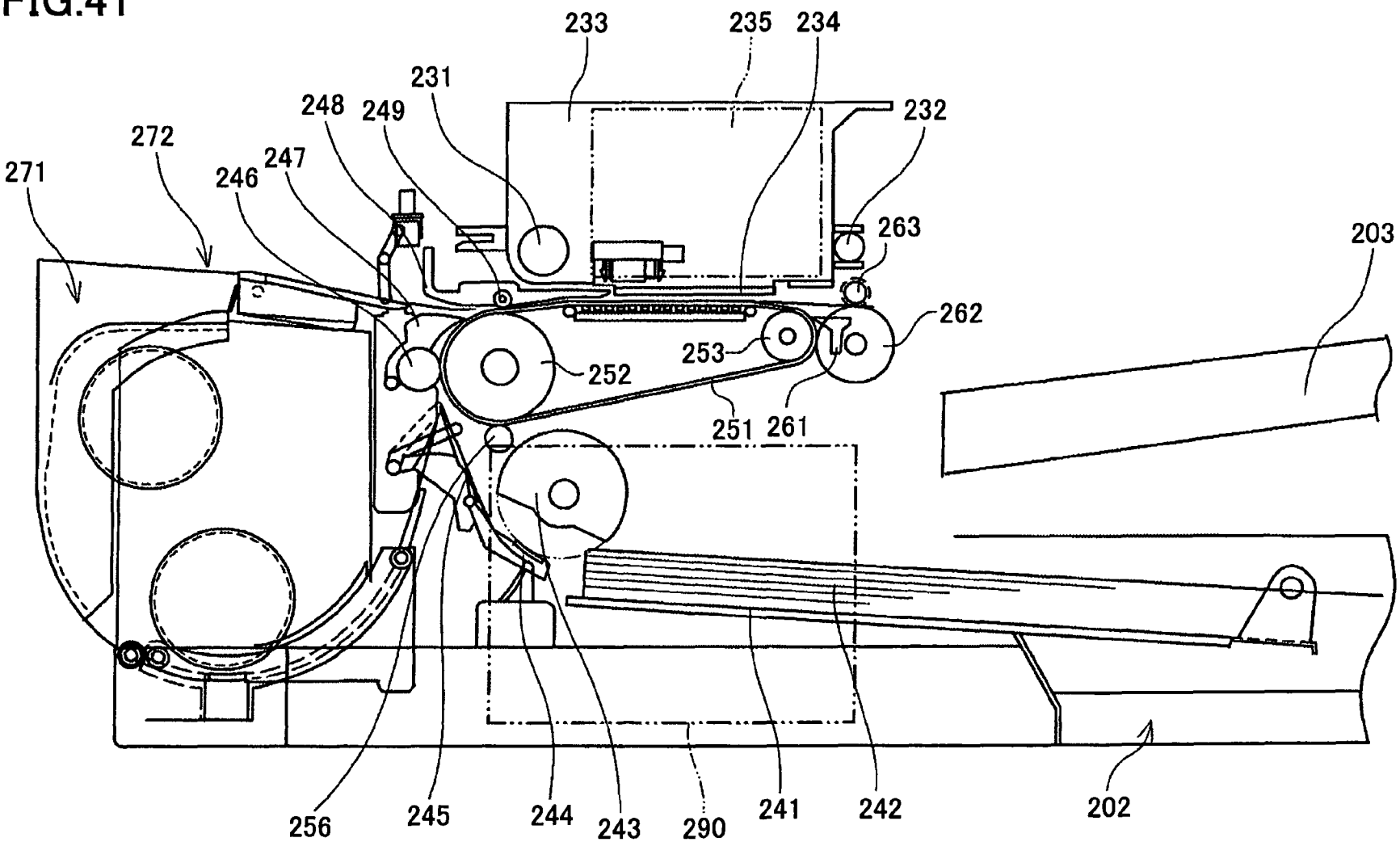
FIG. 41 is a schematic diagram illustrating an image forming apparatus that comprises a liquid ejection device including a waste liquid tank according to an embodiment of the present invention.
Figure 42:
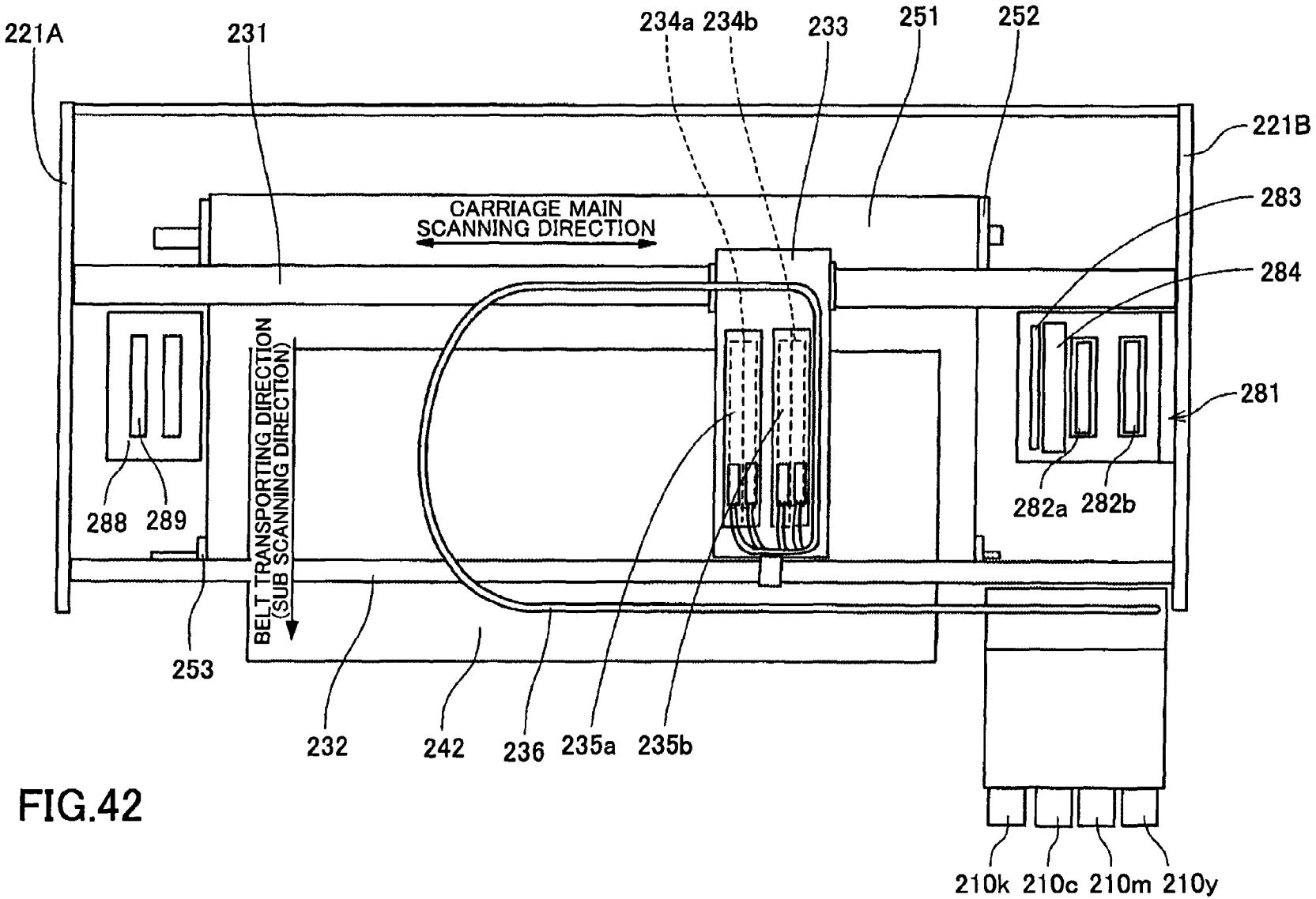
FIG. 42 is a schematic diagram illustrating a part of the image forming apparatus of FIG. 41.

The following describes an example of an image forming apparatus including a liquid ejection device of an embodiment of the present invention with reference to FIGS. 41 and 42. FIG. 41 is a schematic diagram illustrating a mechanical section of the image forming apparatus. FIG. 42 is a plan view illustrating a part of the mechanical section.

The image forming apparatus is of a serial type. A carriage 233 is held slidably in a carriage main scanning direction by main and sub guide rods 231 and 232 extending between left and right side plates 221A and 221B. A main scanning motor (not shown) moves the carriage 233 in the carriage main scanning direction (see FIG. 42) through a timing belt not shown.

In the carriage 233, recording heads 234*a* and 234*b* (referred to also as simply "heads 234") are mounted such that ink droplets are ejected downward. The heads 234 include liquid ejection heads for ejecting inks of yellow (Y), cyan (C), magenta (M), and black (B).

Each recording head 234 has two nozzle arrays. Each of the nozzle arrays is arranged in a sub scanning direction orthogonal to the main scanning direction and comprises plural nozzles. The recording head 234*a* has one nozzle array for ejecting black (K) droplets and the other nozzle array for ejecting cyan (C) droplets. The recording head 234*b* has one nozzle array for ejecting magenta (M) droplets and the other nozzle array for ejecting yellow (Y) droplets.

In the carriage 233 are head tanks 235*a* and 235*b* (referred to collectively as "head tanks 235") for supplying color inks corresponding to the nozzle arrays of the recording heads 234. Color inks are supplied to the head tanks 235 from color ink cartridges 210 through a supply tube 236.

There is provided a sheet feeding unit for feeding sheets 242 stacked on a sheet stacker (a pressure plate) 241 of a sheet feed tray 202. The sheet feeding unit includes a semicircular roller (sheet feed roller) 243 for transporting the sheets 242 one by one and a separation pad 244 made of a material with a high friction coefficient. The separation pad 244 opposes and is biased toward the sheet feed roller 243.

For transporting the sheets 242 transported from the sheet feeding unit to the lower side of the recording heads 234, there are provided a guide member 245 for guiding the sheets 242, a counter roller 246, a transport guide member 247, and a retainer member 248 having a pressure roller 249. There is also provided a transport belt 251 as a transporting unit for transporting the sheets 242 so as to face the recording heads 234 by electrostatically attracting the sheet 242.

The transport belt 251 is an endless belt extending around a transport roller 252 and a tension roller 253. The transport belt 251 rotates in a belt transporting direction (sub scanning direction). A charging roller 256 is provided as a charger that charges the surface of the transport belt 251. The charging roller 256 is disposed in contact with the surface of the transport belt 251 so as to be rotated by rotation of the transport belt 251. The transport belt 251 is rotated in a belt transporting direction shown in FIG. 42 along with rotation of the transport roller 252 by a sub scanning motor (not shown) through a timing mechanism.

As a sheet ejection unit for ejecting the sheet 242 with images recorded by the recording heads 234, there are provided a separation claw 261 for separating the sheets 242 from the transport belt 251 and sheet ejection rollers 262 and 263. There is also provided a sheet collection tray 203 under the sheet ejection roller 262.

A duplexing unit 271 is detachably attached to the back face of an apparatus main body. The duplexing unit 271 receives the sheet 242 returned by inverse rotation of the transport belt 251, flips over the sheet 242, and transports the sheet 242 again between the counter roller 246 and the transport belt 251. The upper face of the duplexing unit 271 serves as a manual feed tray.

With reference to FIG. 42, a maintenance recovery mechanism 281 for the recording heads 234 is provided in a non-printing area at one side in the main scanning direction of the carriage 233. The maintenance recovery mechanism 281 includes a restoring unit for maintaining and restoring the condition of nozzles of the recording heads 234.

The maintenance recovery mechanism 281 comprises cap members (hereinafter referred to as caps) 282*a* and 282*b* (hereinafter also referred to as simply as "caps 282") for capping nozzle faces of the recording heads 234, a wiper blade 283 for wiping the nozzle faces, an idle ejection receiver 284 that receives droplets ejected upon idle ejection for non-recording purposes, i.e., for the purpose of discharging recording liquid with increased viscosity, etc.

As shown in FIG. 42, in a non-printing area located at the other side in the scanning direction of the carriage 233, there is provided an ink collecting unit (an idle ejection receiver) 288 as a liquid collecting container for receiving droplets ejected upon idle ejection for non-recording purposes, i.e., for the purpose of discharging recording liquid with increased viscosity during recording or the like. The ink collecting unit 288 includes an opening 289 parallel to the nozzle array direction of the recording heads 234.

Further, a waste liquid tank 290 is provided as an embodiment of the present invention for holding waste recording liquid resulting from maintenance and restoring operations by the maintenance and recovering mechanism 281 and the like (see FIG. 41).

In the image forming apparatus with the above-described configuration, the sheets 242 are transported substantially vertically upward from the sheet feed tray 202 one by one. Then, the sheet 242 is guided by the guide member 245 so as to be transported between the transport belt 251 and the counter roller 246. The sheet 242 is further guided at the front end by the transport guide member 247 and pressed by the pressure roller 249 onto the transport belt 251, so that the transportation direction is rotated by about 90 degrees.

In this step, positive outputs and negative outputs are alternately repeatedly applied to the charging roller 256 through application of alternating voltage to the charging roller 256. Thus, an alternating charged voltage pattern is formed on the transport belt 251. In other words, the transport belt 251 is alternately positively and negatively charged at predetermined widths in the sub scanning direction, i.e., the rotational direction of the transport belt 251. When the sheet 242 is transported onto the alternately positively and negatively charged transport belt 251, the sheet 242 is attracted by the transport belt 251 and transported in the sub scanning direction by the rotational movement of the transport belt 251.

According to image signals, the recording heads 234 are driven to eject ink droplets onto the sheet 242 not in motion while moving the carriage 233. Each time upon completing recording of one line, the sheet 242 is moved by a predetermined distance for recording the next line. Upon receipt of a recording end signal or a signal indicating that the rear edge of the sheet 242 has reached a recording area, the recording operation is ended. Then, the sheet 242 is ejected onto the sheet collection tray 203.

This image forming apparatus including the waste liquid tank of an embodiment of the present invention can prevent viscosity increase of the waste recording liquid even if the recording liquid to be ejected has quick-drying properties or originally has a high viscosity, or even if the color material includes pigment. Therefore, problems associated with formation of a mountain-like buildup of waste recording liquid do not occur. Accordingly, it is possible to record high quality and durable images with use of a quick-drying and highly viscous recording liquid containing pigment as a color material. Moreover, problems such as recording failures due to clogged heads and contamination of recording media by the buildup are preventable, so that images with high reliability and high quality can be formed.

It is to be noted that the waste liquid tank 290 may be detachably attached to the apparatus main body of the image forming apparatus. Especially when pigment ink is used, only pigment components are accumulated but moisture is absorbed into the absorbent member. In such a case, the expected service life of the waste liquid tank 290 is likely to be significantly shorter than that of the image forming apparatus. If it is difficult to replacement waste liquid tanks 290, the image forming apparatus needs to be sent to a service site or a factory at least temporarily for replacing the waste liquid tanks 290. This might be inconvenient for users because the users cannot use the image forming apparatus during that period. Since the waste liquid tank 290 of this embodiment of the present invention is detachable and easily replaceable, these problems are eliminated.

Although a printer is described as an image forming apparatus in the above embodiment, the present invention is also applicable to, for example, multifunction machines having printer, fax and copier functions. The present invention is also applicable to image forming apparatuses using recording liquids other than inks or fixer solution.

The present application is based on Japanese Priority Application No. 2006-144788 filed on May 25, 2006, and Japanese Priority Application No. 2007-034055 filed on Feb. 14, 2007, with the Japanese Patent Office, the entire contents of which are hereby incorporated by reference.

What is claimed is:

1. A waste liquid tank that holds waste recording liquid, wherein a waste liquid wetting liquid that forms a liquid layer on the surface of the waste recording liquid is placed in the form of a liquid;

wherein the waste liquid wetting liquid contains an organic solvent that has a lower specific gravity than the waste recording liquid and has low compatibility with the waste recording liquid.

2. The waste liquid tank as claimed in claim 1, wherein the organic solvent has a lower vapor pressure than water in an environment of 25° C. and 1 atm.

3. The waste liquid tank as claimed in claim 1, wherein the organic solvent is refractory enough to form the liquid layer of the waste liquid wetting liquid during a period until the waste liquid tank becomes full.

4. The waste liquid tank as claimed in claim 1, wherein the organic solvent is either a paraffin oil or a silicone oil.

5. The waste liquid tank as claimed in claim 1, comprising:

a first chamber that receives the waste recording liquid; and a second chamber that accommodates a receptacle member capable of absorbing a waste liquid;

wherein, when a liquid level of the waste liquid wetting liquid rises due to reception of the waste recording liquid, the waste liquid wetting liquid is separated into a first chamber side and a second chamber side.

6. The waste liquid tank as claimed in claim 5, further comprising:

a communication passage for communication between the first chamber and the second chamber is provided in a partition separating the first chamber and the second chamber;

wherein, when the liquid level of the waste liquid wetting liquid rises above the communication passage, the waste liquid wetting liquid is separated into the first chamber side and the second chamber side or a communication passage side.

7. The waste liquid tank as claimed in claim 6, wherein a lowermost end face of the receptacle member is located above the communication passage.

8. The waste liquid tank as claimed in claim 7, wherein the lowermost end face of the receptacle member is defined by a lower end face of a projection formed on a part of a lower end face of the receptacle member.

9. The waste liquid tank as claimed in claim 8, wherein a diffusion limitation unit is provided at least partly around the projection, the diffusion limitation unit limiting diffusion of the waste liquid wetting liquid upon absorption of the waste liquid wetting liquid.

10. The waste liquid tank as claimed in claim 9, wherein the diffusion limitation unit is a partition wall member.

11. The waste liquid tank as claimed in claim 7, wherein the receptacle member is divided into a first part that defines the lowermost end face and a second part excluding the first part.

12. The waste liquid tank as claimed in claim 9, wherein the diffusion limitation unit is a cut formed in the receptacle member.

13. The waste liquid tank as claimed in claim 5, further comprising:

a communication passage for communication between the first chamber and the second chamber;

wherein an opening of the communication passage at the first chamber side is located at a position relatively higher than an opening of the communication passage at the second chamber side.

14. The waste liquid tank as claimed in claim 13, wherein the opening of the communication passage at the second chamber side faces a clearance defined by the receptacle member.

15. The waste liquid tank as claimed in claim 14, wherein a diffusion limitation member is provided that separates a part defining a bottom surface of the clearance from the rest of the part so as to limit diffusion of the waste liquid wetting liquid upon absorption of the waste liquid wetting liquid.

16. The waste liquid tank as claimed in claim 5, further comprising:

a communication passage for communication between the first chamber and the second chamber;

wherein the communication passage includes a portion at a position relatively higher than an opening thereof at the first chamber side and an opening thereof at the second chamber side.

17. The waste liquid tank as claimed in claim 1, comprising:

a first chamber that receives the waste recording liquid;

a second chamber that accommodates a receptacle member capable of absorbing a waste liquid;

a communication passage for communication between the first chamber and the second chamber; and a valve unit that opens and closes the communication passage depending on a liquid level of the waste liquid wetting liquid in the first chamber;

wherein the valve unit opens the communication passage while keeping the waste liquid wetting liquid at a first chamber side.

18. A liquid ejection device that ejects a recording liquid from a liquid ejection head, comprising:

a waste liquid tank that holds waste recording liquid, wherein a waste liquid wetting liquid that forms a liquid layer on the surface of the waste recording liquid is placed in the form of a liquid wherein the waste liquid wetting liquid contains an organic solvent that has a lower specific gravity than the waste recording liquid and has low compatibility with the waste recording liquid.

19. An image forming apparatus that forms an image by ejecting a recording liquid from a liquid ejection head, comprising:

a waste liquid tank that holds waste recording liquid, wherein a waste liquid wetting liquid that forms a liquid layer on the surface of the waste recording liquid is placed in the form of a liquid wherein the waste liquid wetting liquid contains an organic solvent that has a lower specific gravity than the waste recording liquid and has low compatibility with the waste recording liquid.

* * * * *